US006459877B1

(12) United States Patent
Yoda et al.

(10) Patent No.: US 6,459,877 B1
(45) Date of Patent: Oct. 1, 2002

(54) FIXING DEVICE WHICH PREVENTS DAMAGE TO A FIXING BELT

(75) Inventors: Kaneo Yoda; Kazutoshi Fujisawa; Naoyuki Okumura; Tahei Ishiwatari; Hiroshi Tanaka; Kenjiro Yoshioka, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/487,731

(22) Filed: Jan. 19, 2000

(30) Foreign Application Priority Data

| | | |
|---|---|---|
| Jan. 19, 1999 | (JP) | 11-010460 |
| Jan. 19, 1999 | (JP) | 11-010462 |
| Feb. 23, 1999 | (JP) | 11-045566 |
| Feb. 23, 1999 | (JP) | 11-045567 |
| Feb. 23, 1999 | (JP) | 11-045568 |
| Feb. 23, 1999 | (JP) | 11-045569 |
| Mar. 3, 1999 | (JP) | 11-056217 |
| Apr. 28, 1999 | (JP) | 11-123081 |
| May 18, 1999 | (JP) | 11-137801 |
| May 28, 1999 | (JP) | 11-150028 |

(51) Int. Cl.[7] ..... G03G 15/20
(52) U.S. Cl. ..... 399/325; 219/216; 399/329
(58) Field of Search ..... 399/325, 326, 399/307, 328, 329; 219/216; 432/59, 60

(56) References Cited

U.S. PATENT DOCUMENTS

| | | | | |
|---|---|---|---|---|
| 4,977,308 A | * | 12/1990 | Soga | 219/216 X |
| 5,465,146 A | | 11/1995 | Higashi et al. | |
| 5,666,623 A | * | 9/1997 | Yamada et al. | 399/325 X |
| 5,729,812 A | * | 3/1998 | Moser | 399/329 |
| 6,137,984 A | * | 10/2000 | Higashi et al. | 399/329 |

FOREIGN PATENT DOCUMENTS

| | | | |
|---|---|---|---|
| EP | 0 935 175 A2 | 11/1999 | |
| JP | 57063570 | 4/1982 | |
| JP | 61-110179 | 5/1986 | |
| JP | 02291590 | 12/1990 | |
| JP | 3-210587 | 9/1991 | G03G/15/20 |
| JP | 05127557 | 5/1993 | |
| JP | 8-334997 | 12/1996 | G03G/15/20 |
| JP | 9-138600 | 5/1997 | G03G/15/20 |
| JP | 09165122 | 6/1997 | |
| JP | 10078725 | 3/1998 | |
| JP | 10-186927 | * 7/1998 | |
| JP | 2813297 B2 | 8/1998 | G03G/15/20 |
| JP | 10268688 | 10/1998 | |

* cited by examiner

*Primary Examiner*—Joan Pendegrass
(74) *Attorney, Agent, or Firm*—Sughrue Mion, PLLC

(57) ABSTRACT

A recording medium having a toner image formed thereon is moved to pass through a press contact portion between an endless belt being heated and an pressure roller pressed against the endless belt. When passing through the press contact portion, the toner image is fused and permanently affixed onto the recording medium. An oil application width O of an oil application roller is shorter than belt width B of the endless belt, and a maximum passing width P of a recording medium that may be supplied for the image formation, but is longer than a maximum image-forming width I within which an image may be formed on the recording medium.

35 Claims, 27 Drawing Sheets

FIXING DEVICE WHICH PREVENTS DAMAGE TO A FIXING BELT

BACKGROUND OF THE INVENTION

The present invention relates to an image forming apparatus, such as a printer, a facsimile machine or a copy machine, which is capable of forming a toner image on a recording medium, such as a paper sheet, by the electrophotography technique. More particularly, the invention relates to a fixing device for the image forming apparatus.

Generally, the image forming apparatus for forming a toner image on a recording medium by the electrophotography technique includes a photosensitive member to be driven to rotate, an exposure mechanism for forming an electrostatic latent image on the surface of the photosensitive member, a developing mechanism for developing the latent image into a toner image, a transfer mechanism for transferring the toner image onto a recording medium, and a fixing device for thermally fixing the toner image on the recording medium while allowing the recording medium having the toner image transferred by the transfer mechanism to pass therethrough.

FIG. 27 shows a fixing device of the belt fixing type (JP-A-8-334997).

In the fixing device, a fixing belt 1 extends around a fixing roller 2 driven to rotate and a heating roller 3. An pressure roller 4 is pressed against the fixing roller 2 with the fixing belt 1 being interposed therebetween. A recording medium S on which a toner image T is formed is moved to pass through a pressure contact portion (fixing nip) N therebetween in the direction of an arrow in the figure, whereby the toner image T is fused and permanently affixed onto the recording medium S.

In the fixing device thus constructed, if a peripheral speed difference is present between two rotary members, a toner image on the recording medium passing through the press contact portion between the rotary members is blurred to disturb the image. For this reason, usually, such a method that the rotary members are both driven to rotate is not employed, and one of the rotary members is driven to rotate, while the other rotary member is rotated as a follower. That is, the fixing roller 2 is driven to rotate, whereas the fixing belt 1 follows the fixing roller 2 and the pressure roller 4 follows the fixing belt 1. In case of another type of a fixing device in which a fixing belt is not used, one of a fixing roller and a pressure roller which cooperatively form a nip is driven to rotate, whereas the other of the fixing roller and the pressure roller follows the one.

The heating roller 3 includes guide rings 3a as restricting which come in contact with the side ends 1*b* of the fixing belt 1 to restrict lateral offset of the fixing belt 1.

To prevent such a phenomenon that toner is transferred from the recording medium onto the surface of the fixing belt 1 (called offset phenomenon), the fixing device includes an oil application roller 5 for applying release oil, such as silicone oil, as release agent onto the surface of the fixing belt 1.

A length (as viewed in the belt width) of the oil application roller 5 as a oil application mechanism is longer than the width of the fixing belt 1, so that the oil is applied to the belt 1 over its entire width.

The oil application roller 5 is pressed against the fixing belt 1 at a position other than positions where the fixing belt 1 is wound on the rollers 2 and 3. Therefore, it also functions as a tension applying mechanism for applying a tension to the fixing belt.

In the fixing device, an oil application width by the oil application roller 5 of the release agent application mechanism is longer than the width of the fixing belt 1. Therefore, the oil that has been once applied to the top surface of the fixing belt 1 is easy to flow to the back surface la of the fixing belt 1.

Generally, the oil application roller 5 includes a shaft and an oil holding layer, made of, for example, felt, provided around the shaft. The oil application roller 5 is pressed against a rotary member (here, fixing belt or endless belt 1), so that oil is squeezed out of the oil holding layer and it is applied to the rotary member. Because of the structure, a pressing force to the rotary member by the oil application roller 5 at the ends of the roller is larger than that at the central portion. Therefore, the end portions of the roller are more greatly compressed than the central portion thereof, and hence the oil application amount at the end portions of the roller is larger than that at the central portion thereof. The fixing device of the image forming apparatus is designed such that the width (length in the axial direction) of the rotary member is longer than the width (maximum passing width) of a recording medium of which the passing width is the largest of those media that may be supplied for the image formation, although such a design is a nature choice when considering its function. For this reason, both ends of the rotary member (including the fixing belt 1), which are not in contact with the recording medium having the maximum passing width, are coated with a relatively large amount of oil, which, however, is not absorbed by or transferred to the recording medium. As a result, a relatively large amount of oil is accumulated there. Where t amount of the accumulated oil is excessive, it creeps to the central portion of the rotary member. Because of the creeping oil, a slip will occur between the driving rotary member and the follower rotary member or between the rotary member and the recording medium. This possibly results in that the toner image on the recording medium is blurred to disturb the image.

In particular, in case where the recording medium is a sheet which does not absorb oil, such as a synthetic resin sheet, the slip is likely to occur.

Further, as described above, a relatively large amount of oil applied to both ends of the surface of the fixing belt 1 is easy to flow to the back side 1*a* of the fixing belt 1.

The oil that has flowed to the back side 1*a* of the fixing belt 1 gradually moves to between the fixing belt 1 and the fixing roller 2 as its drive roller. When the amount of the oil moving thereto exceeds a predetermined level, a slip occurs between the fixing roller 2 and the fixing belt 1, and as a result, the fixing operation will be instable.

Accordingly, an object of the present invention is to solve the above problems and to provide a fixing device which eliminates the above-mentioned slip, thereby providing a stable fixing operation.

In the publication, JP-A-8-334997, there is no description about the heating width (heating width as viewed in the width direction of the fixing belt 1) by a heater contained in the heating roller 3.

Oil impregnated in the oil holding layer stays within the layer at normal temperature since its viscosity is high, and never leaks out of the layer. In a fixing operation, the belt is heated, and the viscosity of the oil decreases while it is thermally expanded, so that it leaks out of the layer and flows to the belt.

Accordingly, if in the fixing device of FIG. 27, the heating width by the heater of a heating mechanism is longer than the oil application width by the oil application roller 5 of the oil application mechanism (equal to the width of the fixing belt 1 in FIG. 27), the oil application roller 5 is heated over its entire oil application width (the full width of the fixing belt 1 in FIG. 27), the oil is applied to the fixing belt 1 over its entire width.

If the oil is applied to the fixing belt 1 over the entire oil application width, the oil applied to the end portions of the surface of the fixing belt 1 will flow to the back side 1*a* of the fixing belt 1.

The oil flowing to the back side 1*a* of the fixing belt 1 gradually moves to between the fixing belt 1 and the fixing roller 2 as its drive roller. When the amount of the oil exceeds a predetermined level, a slip will occur between the fixing roller 2 and the fixing belt 1 because of presence of the oil. As a result, there is a possibility that a stable fixing operation is not performed.

Accordingly, an object of the present invention is to solve the above problems, and to provide a fixing device which eliminates the above-mentioned slip, thereby providing a stable fixing operation.

In the fixing device of FIG. 27, the oil application roller 5 is pressed against the fixing belt 1 at a position other than positions where the fixing belt 1 is wound on the rollers 2 and 3. Therefore, the oil application roller 5 also functions as a tension applying mechanism for applying a tension to the fixing belt 1. If the length of the oil application roller 5 is shorter than the width of the fixing belt 1, the fixing belt 1 is bent at both ends of the press contact portion 1*c* by the oil application roller 5 (the bending portions are designated by 1*d*), as shown in FIGS. 28A and 28B.

Therefore, the following problems arise.

The bending gradually decreases with the movement of the fixing belt 1, and is removed (flattened) when the belt 1 is wound on the roller (in this case, the heating roller 3) located just downstream of the press contact portion 1*c*. At this time, as shown in FIG. 28C, if the side end 1*b* of the fixing belt 1 comes in contact with the inner wall 3*b* of the guide ring 3*a*, a stress is generated in the bending portions 1*d* (near the side end 1*b*) during the flattening of the bending portions 1*d*. That is, as indicated by an arrow in FIG. 28C, when the belt 1 is wound on the roller 3, the bending portions 1*d* are turned as indicated by an arrow to be flattened as indicated a phantom line 1*d*', and at this time, the side ends 1*b* of the belt 1 come in contact with the inner walls 3*b* of the guide rings 3*a*. However, the bending portions 1*d* are finally flattened. As a result, a stress is generated in the bending portions 1*d* (near the side ends 1*b*).

The stress is large as the bending state of the bending potions 1*d* at the start of winding the fixing belt 1 around the heating roller 3 is large. With repetition of the stress generation, the vicinal portions of the side ends 1*b* of the fixing belt 1 are easy to be damaged. This fact was confirmed by us.

Accordingly, an object of the present invention is to solve the above problems and to provide a fixing device which protects the fixing belt from being damaged.

The problem that the vicinal portions of the side ends 1*b* of the fixing belt 1 is easy to be damaged arises not only when the length of the oil application roller 5 is shorter than the width of the fixing belt 1 but also when a press contact member, such as a cleaning blade or a cleaning pad, which is shorter than the width of the fixing belt 1, is pressed against the fixing belt at a position other than a position where the fixing belt is wound on the roller.

Accordingly, an object of the present invention is to solve the above problem and to provide fixing device which prevent the fixing belt from being damaged even if the press contact member is used.

FIG. 29 is a diagram schematically showing a fixing device disclosed in JP-A-8-334997; FIG. 29A is a front view of the fixing device and FIG. 29B is a plan view showing mainly a fixing nip N.

As shown in FIG. 29A, the rotational center of the heating roller 3 is located downstream with respect to the passing or traveling direction (see an arrow S1) of the recording medium, which passes through the fixing nip N, with respect to a straight line A connecting the rotational centers of the fixing roller 2 and the pressure roller 4, when viewed in the axial direction of the fixing roller 2.

Therefore, a force F2 acting on the fixing roller 2 by a tension of the fixing belt 1 suspended between the fixing roller 2 and a heating roller 3 is directed upstream with respect to the passing direction S1 of the recording medium. Accordingly, the resultant force F3 of the forces F1 and F2 is also directed upstream with respect to the passing direction S1 of the recording medium.

Therefore, as shown in FIG. 29B, an axial line 2*a* of the fixing roller 2 is deflected in a convex shape toward the upstream side of the passing direction S1, by the force F3.

Accordingly, a transporting force acting on the fixing belt 1 at the fixing nip N is a force F4 which acts, at both sides of the fixing nip N, on the fixing belt 1 so as to cause the fixing belt 1 to move toward the center of the fixing belt 1.

At the fixing nip N, the fixing belt 1 is nipped between the fixing roller 2 and a pressure roller 4. Therefore, a transporting force acting on the fixing belt 1 at the fixing nip N greatly influences the fixing belt 1.

Accordingly, if a force F4 acts, at both sides of the fixing nip N, on the fixing belt 1 so as to cause it to move toward the center of the fixing belt 1 as viewed in its width direction, the fixing belt 1 is likely to be creased through the action of the force F4 at a location downstream of the nip N. When the influence by the crease is still left at the contact portion of the fixing belt 1 with the oil application roller 5, the crease hinders the oil application roller 5 from coming in uniform contact with the fixing belt 1. This causes an irregularity in the oil application on the belt 1.

Thus, the fixing device of JP-A-8-334997 has a disadvantage an irregularity of the oil application is easy to occur.

A belt fixing device shown in FIG. 30 (JP-A-9-138600) is free from the above-mentioned problem since the oil application mechanism is not included. In the fixing device (FIG. 30), a belt 7 extends around four rollers 6*a* to 6*d*. A heater 8 is disposed between a belt portion 7*a* extending from the roller 6*a* to the roller 6*d*, and another belt portion 7*b* extending from the roller 6*d* to the roller 6*b*. The structure of the fixing device is extremely complicated.

Accordingly, an object of the present invention is to solve the above problems, and to provide a fixing device which prevents an irregularity of release agent application with a relatively simple construction.

FIG. 31 shows a fixing device of the belt fixing type disclosed in Japanese patent No. 2813297.

The fixing device includes a circulating, endless fixing belt B suspended between a heating roller R3 containing a main heat source H1 and a backup roller R1, a pressure roller R2 pressed against the backup roller R1 with the endless fixing belt B being interposed therebetween, to form a fixing nip N in connection with the endless fixing belt B, an auxiliary heat source H2 as auxiliary heating mechanism for heating the pressure roller R2, and an oil application roller R4 as an oil application mechanism for applying release oil onto the endless fixing belt B when it is brought into contact with the endless fixing belt B at a position located downstream of the fixing nip N but upstream of the heating roller R3 when viewed in the circulating direction of the endless fixing belt B. A recording medium C having a toner image thereon is moved to pass through the fixing nip N, whereby the toner image is fused and fixed on the recording medium.

Generally, a viscosity of release agent, such as release oil depends largely on temperature. The application amount of release agent on the fixing belt varies with temperature of the release oil application mechanism.

In the fixing device shown in FIG. 31, the oil application roller R4 is located above the auxiliary heat source H2 of the pressing roller R2, but is located downstream (i.e., the right side in FIG. 31) of the fixing nip N in the passing direction (from right to left in FIG. 31). Therefore, radiation and hot air stream from the auxiliary heat source H2 substantially fail to reach the oil application roller R4 since those are interrupted by the backup roller R1 and the endless fixing belt B.

Therefore, the oil application roller R4 is heated mainly by the endless fixing belt B alone. Accordingly, in the initial stage of operation of the fixing device, temperature rise of the oil application roller R4 is slow.

When the recording medium C passes through the fixing nip N, a temperature of the endless fixing belt B at a location where it is in contact with the recording medium C remarkably reduces. Therefore, a great temperature difference is present when viewed in its width direction. The temperature difference reflects on the temperature of the release agent application roller R4. In particular in the early stage of the device operation where the temperature rise of the oil application roller R4 is not satisfactory, the temperature difference is easy to occur in the axial direction o the oil application roller. As a result, the oil application amount becomes different also in the axial direction of the oil application roller R4 or in the width direction of the endless fixing belt B. This results in an irregularity of oil application, and thus an irregularity on the fixed image.

Accordingly, an object of the present invention is to solve the above problems and to provide a fixing device which prevents the irregularity of oil application.

Usually, the fixing device of the other type includes a fixing roller containing a heat source and a pressure roller pressed against the fixing roller. A recording medium is moved to pass through a press contact portion between these rollers, whereby a toner image is fused and fixed on the recording medium.

In the fixing device, one (usually the fixing roller) of the paired rollers is rotatably mounted on the frame, while the shaft of the other roller (usually the pressure roller) is urged to the one roller by an urging mechanism such as a spring, whereby those rollers are pressed on each other. That is, a distance of the shafts of both the rollers is not fixed.

In the case of the fixing device of the type in which the roller is heated, a long time is consumed for the initial heating. There is known a fixing device (belt fixing device) in which the endless belt is heated, whereby the initial heating time is reduced.

FIG. 32 is a diagram showing a model of the belt fixing device disclosed in the publication, JP-A-9-138600.

The fixing device includes a heat-resistant endless belt 6, rollers 7*a* and 7*b* for supporting the belt 6 on the inner side thereof, a roller 8 for heating the belt 6, and an pressure roller 9 in contact with the outer peripheral surface of the belt 6. The pressure roller 9 is urged at its shaft 9*a* toward the roller 7*a* by a spring 9*b*, whereby the pressure roller 9 is pressed against the roller 7*a* with the belt 6 being interposed therebetween. Therefore, a distance between the shafts of both the rollers 8 and 7*a* is not fixed.

In the fixing device, the pressure roller 9 is driven, by a motor M, to turn in a direction of an arrow "a". The belt 6 follows the pressure roller 9, and the rollers 7*a*, 7*b* and 8 follow the belt 6. A recording medium having a toner image thereon is moved to pass through a press contact portion (nip) N in the direction of an arrow "b", whereby the toner image is heated and fixed on the recording medium.

FIG. 33 is a diagram showing a fixing device disclosed in JP-A-61-110179.

The belt fixing device includes an endless belt 1 to be heated, an pressure roller 2 pressed against the endless belt 1, a non-rotation mandrel 3 for supporting the inner side of the endless belt 1 at the press contact portion N, and a tube heater 4 for heating the endless belt 1.

The non-rotation mandrel 3 is provided with a cam follower 3*a*, and a cam C is provided for engagement with the cam follower 3*a*. A desired pressure is generated at the press contact portion N through the operation of the cam C.

In the fixing device, when the pressure roller 2 is driven to rotate, the endless belt 1 follows the pressure roller 2 to move on and along the non-rotation mandrel 3.

A recording medium having a toner image thereon is moved to pass through the press contact portion N, whereby the toner image is heated and fixed on the recording medium. To prevent such a phenmenon that toner is transferred from the recording medium onto the surface of the endless belt 1 (called offset phenomenon), the fixing device includes an oil application roller 5 for applying release oil, such as silicone oil, as release agent onto the surface of the fixing belt 1.

In the fixing device in which one roller is pressed against the other roller by an urging mechanism, such as a spring, the axis-to-axis distance between the paired rollers is not fixed, and hence axis-to-axis distance varies. Therefore, it is difficult to secure a parallelism deviation between both the shafts of those rollers.

Where the parallelism deviation between both the shafts of those rollers is low, there is created a great deviation between a medium transportation direction FA by the roller A at the press contact portion N and a medium transportation direction FB by the roller B at the press contact portion N. This will crease the recording medium.

Since the axis-to-axis distance varies, when a relatively thick recording medium, for example, passes through the press contact portion between the rollers, the roller B moves so as to separate from the roller A in accordance with a thickness of the recording medium. Accordingly, the pressing force at the press contact portion N and the width W (length in the passing direction the recording medium) at the press contact portion N do not substantively change regardless of whether a relatively thin recording medium or a relatively thick recording medium passes through the press contact portion.

In contrast, the heat capacity of the relatively thick recording medium is large. To fix the toner image on such a thick recording medium satisfactorily, a great amount of heat is required.

To cope with this, when a relatively thick recording medium passes through the press contact portion, the conventional technique applies a great amount of heat to the recording medium in a manner that a fixing temperature is increased or a fixing speed (transporting speed of the recording medium by both the rollers) is made slow. In this way, a fixing defect of the relatively thick recording medium is prevented.

In other words, fixing conditions (fixing temperature and/or fixing speed) must be changed in accordance with the medium thickness.

In the fixing device shown in FIG. 32, the pressure roller 9 is pressed against the roller 7*a* by the spring 9*b*. Therefore, the axis-to-axis distance between the rollers is not fixed, and hence axis-to-axis distance varies. Therefore, it is difficult to secure a parallelism deviation between both the shafts of those rollers.

In the fixing device shown in FIG. 33, the non-rotation mandrel 3 is vertically moved in FIG. 33 through the action of the cam C. Therefore, a distance between the non-rotation mandrel 3 and the pressure roller 2 is not fixed. Accordingly, it is difficult to secure a parallelism deviation between the non-rotation mandrel 3 and the pressure roller 2.

For this reason, as described with reference to FIG. 34, where the parallelism deviation between the roller A (in this case, the roller 7*a* or the non-rotation mandrel 3) and the roller B (in this case, the roller 9 or the pressure roller 2) is low, there is created a great deviation between a medium transportation direction FA of the belt 6 or 1 (FIGS. 32 and 33) by the roller A at the press contact portion N and that FB by the roller B. This will crease the belt 6 (or 1, the same thing will be applied to the subsequent description) or the belt 6 is easy to be damaged. If the belt 6 is not damaged, a force to move the belt 6 in its width direction (for example, arrow FS direction in FIG. 34) constantly acts on the belt 6. The surface of the belt 6 is easy to deteriorate and its life is reduced.

Further, the axis-to-axis distance varies, and hence fixing conditions (fixing temperature and/or fixing speed) must be changed in accordance with the medium thickness.

Accordingly, an object of the present invention to provide a fixing device which prevents the recording medium from creasing, which does not require changing fixing conditions (fixing temperature and/or fixing speed) in accordance with the medium thickness, and which fixes a good toner image on a relatively thick recording medium.

Another object of the present invention to provide a fixing device which prevents the recording medium from creasing, which elongates the life of the belt, which does not require changing fixing conditions (fixing temperature and/or fixing speed) in accordance with the medium thickness, and which fix a good toner image on a relatively thick recording medium.

SUMMARY OF THE INVENTION

A first aspect of the invention is directed to a fixing device including: a first rotary member; a second rotary member contacting said first rotary member and forming a nip in corporation with said first rotary member; and an oil application mechanism, which applies oil to at least one of said first and second rotary members. The first aspect is featured in that a width of oil applied by said oil application mechanism is smaller than a width of said at least one of said first and second rotary members to which said oil is applied.

A second aspect of the invention is directed to a fixing device including: a first rotary member; a second rotary member contacting said first rotary member and forming a nip in corporation with said first rotary member; and an oil application mechanism, which applies oil to at least one of said first and second rotary member; and a heating mechanism, which applies heat to at least one of said first and second rotary members. The second aspect if featured in that a width of heat applied by said heating mechanism is smaller than a width of oil applied by said oil application mechanism.

A third aspect of the invention is directed to a fixing device including: a first rotary member; a second rotary member contacting said first rotary member and forming a nip in corporation with said first rotary member; and a heating mechanism, which applies heat to at least one of said first and second rotary member. The third aspect is featured in that said heating mechanism generates larger heat at a central portion thereof than at lateral end portions thereof.

A fourth aspect of the invention is directed to a fixing device including: a first rotary member; a second rotary member contacting said first rotary member and forming a nip in corporation with said first rotary member; and an oil application mechanism, which applies oil to at least one of said first and second rotary member. The fourth aspect of the invention is featured by an oil absorbing mechanism (170, 170', 170"), which absorbs oil applied by said oil application mechanism.

A fifth aspect of the invention is directed to a fixing device including: a first rotary member; a second rotary member contacting said first rotary member and forming a nip in corporation with said first rotary member; and an oil application mechanism, which applies oil to at least one of said first and second rotary members. The fifth aspect is featured by a blade, which collects oil applied by said oil application mechanism toward a laterally central portion of said at least one of said first and second rotary members to which said oil is applied.

A sixth aspect of the invention is directed to a fixing device including: a first roller; a second roller; an endless belt suspended between said first and second rollers; and a third roller forming a nip in cooperation with said endless belt and said second roller. The sixth aspect is featured in that a rotational axis of said first roller is located in a downstream side of a traveling direction of a sheet with respect to an imaginary line connecting a rotational axis of said second roller to a rotational axis of said third roller.

A seventh aspect of the invention is directed to a fixing device including: a first roller having restricting portions; a second roller; an endless belt suspended between said first and second rollers; a third roller forming a nip in cooperation with said endless belt and said second roller; and a tension application mechanism, which applies tension to said endless belt. The seventh aspect is featured in that a width of said tension application mechanism is shorter than a width of said endless belt, and said tension application mechanism is located closer to a position at which said endless belt commences separation from said second roller than to a position at which said endless belt commences contact with said first roller.

An eighth aspect of the invention is directed to a fixing device including: a first roller; a second roller; an endless belt suspended between said first and second rollers; a third roller forming a nip in cooperation with said endless belt and said second roller; an oil application mechanism, which applies oil to said endless belt; and a heating mechanism, which applied heat to said third roller. The eighth aspect is featured in that said oil application mechanism is located above said heating mechanism , and said oil application mechanism is located in a downstream side of a traveling direction of a sheet with respect to said nip.

A ninth aspect of the invention is directed to a fixing device including: a first roller; and a second roller contacting said first roller and forming a nip in corporation with said first roller. The ninth aspect is featured in that an axis-to-axis distance between said first and second rollers is fixed.

A tenth aspect of the invention is directed to a fixing device including: a first roller; a second roller; an endless belt suspended between said first and second rollers; and a third roller forming a nip in cooperation with said endless belt and said second roller. The tenth aspect is featured in that an axis-to-axis distance between said second and third rollers is fixed.

Two or more of the features of the first to tenth aspects may be selectively combined together.

The present disclosure relates to the subject matter contained in Japanese patent applications Nos.

1) Hei 11-10460 (filed on Jan. 19, 1999);

2) Hei 11-10462 (filed on Jan. 19, 1999);

3) Hei 11-45569 (filed on Feb. 23, 1999);

4) Hei 11-45567 (filed on Feb. 23, 1999);

5) Hei 11-45566 (filed on Feb. 23, 1999);

6) Hei 11-45568 (filed on Feb. 23, 1999);

7) Hei 11-56217 (filed on Mar. 3, 1999);

8) Hei 11-123081 (filed on Apr. 28, 1999);

9) Hei 11-137081 (filed on May 18, 1999);

10) Hei 11-150028 (filed on May 28, 1999);

all of which are expressly incorporated herein by reference in their entireties.

DESCRIPTION OF THE PREFERRED EMBODIMENTS

Figure 1:
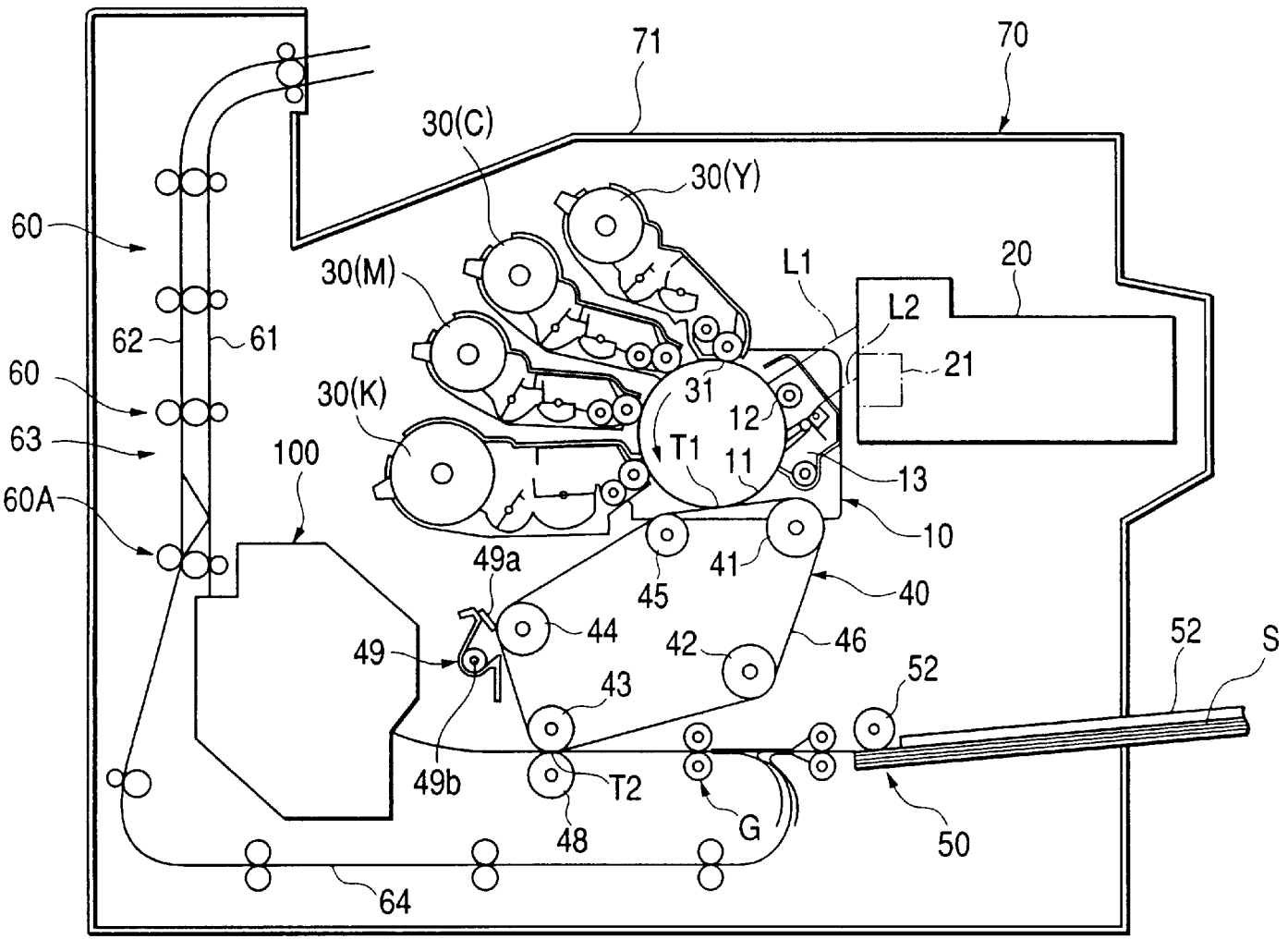
FIG. 1 schematically shows an example of an image forming apparatus, to which a fixing device constructed according to the present invention is applicable.

The preferred embodiments of the present invention will be described in detail with reference to the accompanying drawings.

It is preferable that a fixing device of the present invention has the following structures.

1. A fixing device having an endless belt to be heated, a rotary member being pressed against the endless belt, a backup member for supporting the endless belt on the inner side thereof at a press contact portion between the endless belt and the rotary member, and an oil application mechanism for applying release oil to a surface of the endless belt, wherein a recording medium having a toner image formed thereon is moved to pass through the press contact portion between the endless belt and the rotary member, whereby the toner image is fused and permanently affixed onto the recording medium, and an oil application width of the oil application mechanism is set to be shorter than the width of the endless belt.

2. In the fixing device of item 1 above, the oil application width is set to be shorter than a maximum passing width of the recording medium that may be supplied for the purpose of image formation.

3. In the fixing device of item 1 above, the oil application width is set to be longer than a maximum image-forming width within which an image may be formed on the recording medium.

4. In the fixing device of item 1 above, the oil application width is set to be shorter than a maximum passing width of the recording medium that may be that may be supplied for the purpose of image formation, but is set to be longer than a maximum image-forming width within which an image may be formed on the recording medium.

5. An image forming apparatus including the fixing device defined in any of items 1, 2, 3 or 4 above, wherein the image forming apparatus is capable of forming toner images on both sides of the recording medium.

6. An image forming apparatus including the fixing device defined in any of items 1, 2, 3, 4 or 5 above, wherein the image forming apparatus is capable of forming a full color toner image that results from superposing toner of a plurality of colors on the recording medium.

In the thus constructed fixing device of the item 1, which has an endless belt heated, a rotary member being pressed against the endless belt, and a backup member for supporting the endless belt on the inner side thereof at a press contact portion between the endless belt and the rotary member, a recording medium having a toner image formed thereon is moved to pass through the press contact portion between the endless belt and the rotary member, whereby the toner image is fused and permanently affixed onto the recording medium. The fixing device includes an oil application mechanism for applying release oil to a surface of the endless belt. Because of this, an offset phenomenon does not occur easily.

Since an oil application width of the oil application mechanism is set to be shorter than the width of the endless belt, the side end portions of the surface of the endless belt contain area portions onto which oil is not applied. Those area portions function to block the spreading of the oil. Therefore, there is a little chance that the oil applied to the top surface of the endless belt flows to the back side of the endless belt (at least the oil flowing to the back side of the belt is remarkably reduced in amount.).

For this reason, in the fixing device of the item 1, when the endless belt is driven by the drive roller disposed on the inner side of the belt, it is natural that because of the presence of the area portions not coated with the oil, the endless belt is stably driven and as a result, a stable fixing operation is secured. The same thing is true also when it is drive by a drive roller located outside the belt.

In the fixing device of the item 2, the oil application width is set to be shorter than a maximum passing width of the recording medium that may be supplied for the purpose of image formation. Therefore, when a recording medium that is supplied for the image formation purpose has the maximum passing width, the oil applied by the oil application mechanism is mostly absorbed by or transferred to that recording medium of the maximum passing width. Therefore, the oil that is accumulated on the endless belt (particularly on its side end potions) after that recording medium has passed is reduced to zero or remarkably reduced in amount. Even if the oil is accumulated on the belt outside passing widths of recording media of various sizes which are smaller than the oil application width as a consequence of image formation on these recording media, the accumulated oil is mostly absorbed by or transferred to the recording medium of the maximum passing width, which has subsequently passed through the fixing device for the image formation. Therefore, the oil that is accumulated on the endless belt is reduced to zero or remarkably reduced in amount.

The area portions coated with no oil on the end portions of the surface of the endless belt is satisfactorily secured, and further the oil applied to the top side or surface of the endless belt is surely prevented from flowing to the back surface thereof.

Thus, the fixing device of the item 2 performs a more stable fixing operation.

In the fixing device of the item 3, the oil application width is set to be longer than a maximum image-forming width within which an image may be formed on the recording medium. In other words, the maximum image-forming width is shorter than the oil application width. Therefore, an offset phenomenon is prevented with certainty.

In the fixing device of the item 4, the oil application width is set to be shorter than a maximum passing width of the recording medium that may be supplied for the purpose of image formation, but is set to be longer than a maximum image-forming width within which an image may be formed on the recording medium. Therefore, the advantageous effects of the fixing devices of both the items 2 and 3 can be obtained.

The fixing device of the item 4 performs a more stable fixing operation and prevents an offset phenomenon.

The image forming apparatus of the item 5 is capable of forming toner images on both sides of the recording medium. Therefore, sometimes a recording medium having toner images formed on both sides thereof passes through the press contact portion of the fixing device.

The toner present on the recording medium hinders the absorption of oil by the recording medium. Accordingly, where toner images are formed on both sides of the recording medium, oil is less absorbed by the recording medium when comparing with a case where a toner image is formed on only one side of the recording medium. In the case of the recording medium having toner images on both sides thereof, an amount of oil flowing to the back side of the belt is large in the conventional fixing device, and hence the above-mentioned slip will occur more easily.

On the other hand, the oil application width of the oil application mechanism is shorter than the belt width of the endless belt. Therefore, even in the case of the recording medium having toner images on both sides thereof, a stable fixing operation is secured.

Thus, the image forming apparatus of the item 5 is capable of forming (fixing) images on both sides of the recording medium through a stable fixing operation.

The image forming apparatus of the item 6 includes the fixing device defined in any of the items 1, 2, 3, 4 or 5. The image forming apparatus is capable of forming a full color toner image that results from superposing toner of a plurality of colors on the recording medium. Therefore, there is a case where a recording medium having a full color image formed on one of the sides of the recording medium passes through the press contact portion of the fixing device.

As described above, the toner present on the recording medium hinders the absorption of oil by the recording medium. Accordingly, where a full color image that results from superimposing toner of a plurality of colors is formed on the recording medium, oil is less absorbed by the recording medium when comparing with a case where a monochromatic toner image is formed on the recording medium. When a full color image that results from superimposing toner of a plurality of colors is formed on the recording medium, the amount of oil flowing onto the back side of the endless belt is large, and the slip will occur more easily.

On the other hand, in the image forming apparatus of the item 6, the oil application width of the oil application mechanism is shorter than the belt width of the endless belt. Therefore, even where a full color image is formed by superimposing toner of a plurality of colors, a stable fixing operation is secured.

The image forming apparatus of the item 6 is capable of forming a stable full color image. When combined with the construction of the item 5, it is capable of forming (fixing) stable full color images on both sides of the recording medium.

7. A fixing device having an endless belt being circulated, a heating mechanism, disposed along the widthwise direction of the endless belt, for heating the endless belt, a rotary member being pressed against the endless belt, a backup member for supporting the endless belt on the inner side thereof at a press contact portion between the endless belt and the rotary member, and an oil application mechanism for applying release oil to a surface of the endless belt, wherein a recording medium having a toner image formed thereon is moved to pass through the press contact portion between the endless belt and the rotary member, whereby the toner image is fused and permanently affixed onto the recording medium, and a heating width of the heating mechanism when viewed in the width direction of the endless belt is shorter than an oil application width of the oil application mechanism, and a heat distribution along the heating width direction is profiled such that an amplitude of temperature at the side ends of the endless belt is lower than that at a central portion of the endless belt.

8. In the fixing device of item 7 above, the oil application width is shorter than the width of the endless belt.

9. In the fixing device of items 7 or 8, the oil application width is shorter than a maximum passing width of the recording medium that may be supplied for the image formation.

10. In the fixing device of items 7 or 8, the oil application width is longer than maximum image-forming width within which an image may be formed on the recording medium.

11. In the fixing device of items 7 or 8, the oil application width is shorter than a maximum passing width of the recording medium that may be supplied for the image formation, but longer than maximum image-forming width within which an image may be formed on the recording medium.

12. An image forming apparatus including the fixing device defined in any of items 7, 8, 9, 10, and 11 above, wherein the image forming apparatus is capable of forming toner images on both sides of the recording medium.

13. An image forming apparatus including the fixing device defined in any of items 7, 8, 9, 10, 11 and 12 above, wherein the image forming apparatus is capable of forming a full color toner image that results from superposing toner of a plurality of colors on the recording medium.

In the thus constructed fixing device of the item 7, which has an endless belt heated by the heating mechanism, a rotary member being pressed against the endless belt, and a backup member for supporting the endless belt on the inner side thereof at a press contact portion between the endless belt and the rotary member, a recording medium having a toner image formed thereon is moved to pass through the press contact portion between the endless belt and the rotary member, whereby the toner image is fused and permanently affixed onto the recording medium. The fixing device includes an oil application mechanism for applying release oil to a surface of the endless belt. Because of this, an offset phenomenon does not occur easily.

The heating width of the heating mechanism when viewed in the width direction of the endless belt is shorter than the oil application width of the oil application mechanism, and the heat distribution along the heating width direction is profiled such that an amplitude of temperature at the side ends of the endless belt is lower than that at a central portion of the endless belt. Therefore, the oil application mechanism is heated such that the central portion of the endless belt is heated to a relatively high temperature, and the end portions are heated to a relatively low temperature.

For this reason, a relatively large amount of oil is applied to the central portion of the endless belt, but a relatively small amount of oil is applied to the end portions of the endless belt.

Therefore, in the fixing device of the item 7, an area portion coated with a small amount of oil is present in each of the end portions on the surface of the endless belt. Those area portions function to block the spreading of a relatively large amount of oil applied to the central portion. Therefore, the oil applied to the top surface of the endless belt is prevented from flowing to the back side of the endless belt (at least the oil flowing to the back side of the belt is remarkably reduced in amount.).

Therefore, when the endless belt is driven by the drive roller disposed on the inner side the belt, it is natural that the endless belt is stably driven and as a result, a stable fixing operation is secured. The same thing is true also when it is drive by a drive roller located outside the belt.

In the fixing device of the item 8, the oil application width is shorter than the width of the endless belt. Therefore, the following advantageous effects are obtained.

Figure 27:
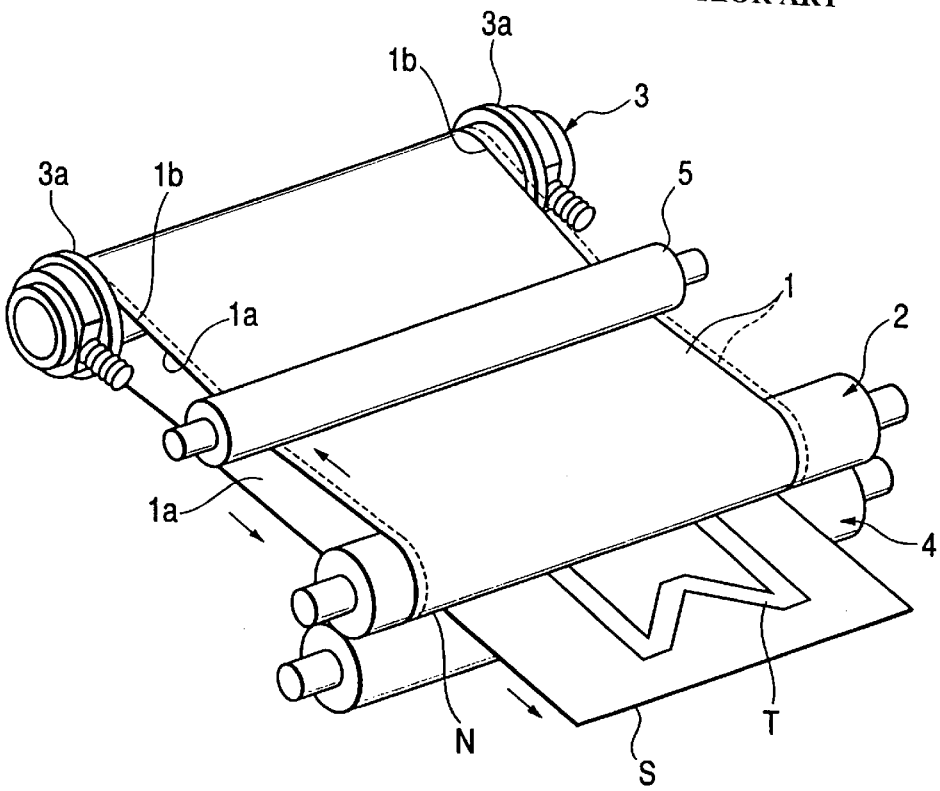
FIG. 27 PRIOR ART
FIG. 27 shows a fixing device disclosed in JP-A-8-334997.

The oil application width of the oil application roller 5 as the oil application mechanism of the fixing device (FIG. 27) is longer than the width of the fixing belt 1. Accordingly, the fixing belt 1 is coated with oil over its entire width.

For this reason, the oil applied to the surface of the fixing belt 1 is easy to flow to the back surface 1*a* of the fixing belt 1.

In the fixing device of the item *b 8*, since an oil application width of the oil application mechanism is set to be shorter than the width of the endless belt, the side end portions of the surface of the endless belt contain area portions not coated with oil. Those area portions function to block the spreading of the oil. Therefore, the oil applied to the top surface of the endless belt is prevented from flowing to the back side of the endless belt (at least the oil flowing to the back side of the belt is remarkably reduced in amount.).

For this reason, in the fixing device of the item 8, when the endless belt is driven by the drive roller disposed on the inner side of the belt, it is natural that because of the presence of the area portions not coated with the oil, the endless belt is stably driven and as a result, a stable fixing operation is secured. The same thing is true also when it is drive by a drive roller located outside the belt.

In the fixing device of the item 9, the oil application width is shorter than a maximum passing width of the recording medium that may be supplied for the image formation.

Therefore, the fixing device of the item 9 has the following advantageous effects in addition to those of the item 7 or 8.

When a recording medium that may be supplied for the image formation purpose is a recording medium of the maximum passing width, the oil applied by the oil application mechanism is mostly absorbed by or transferred to the recording medium. Accordingly, the amount of the oil left on the endless belt (particularly in its end portions) after the recording medium runs past is zero or extremely small. Recording media of various sizes may be supplied for the image forming purpose. Accordingly, there is a case where a recording medium having a passing width shorter than the oil application width is supplied for the image forming purpose, and oil is accumulated on the belt outside the passing width of that recording medium. In this case, when a recording medium of the maximum passing width is then supplied for the image forming purpose and passes through the fixing device, the oil accumulated on the belt is mostly absorbed by or transferred to the recording medium of the maximum passing width. Therefore, the oil that is accumulated on the endless belt (particularly on its side end potions) after the recording medium runs past is also reduced to zero or remarkably reduced in amount.

The area portions coated with a little (or no) oil on the end portions of the surface of the endless belt is satisfactorily secured, and further the oil applied to the top side or surface of the endless belt is surely prevented from flowing to the back surface thereof.

Therefore, a more stable fixing operation is performed in the fixing device of the item 9.

In the fixing device of the item 10, the oil application width is longer than maximum image-forming width within which an image maybe formed on the recording medium. In other words, the maximum image-forming width is shorter than the oil application width. Therefore, the offset phenomenon is surely prevented.

In the fixing device of the item 11, the oil application width is shorter than a maximum passing width of the recording medium that may be supplied for the image formation, but longer than maximum image-forming width within which an image may be formed on the recording medium. Therefore, this fixing device simultaneously provides advantageous effects of those obtained by the fixing device of the item 9 and 10.

The fixing device of the item 11 performs a more stable fixing operation, and prevents an offset phenomenon with certainty.

An image forming apparatus of the item 12 includes the fixing device defined in any of items 7, 8, 9, 10, and 11 above, and is capable of forming toner images on both sides of the recording medium. Therefore, sometimes, a recording medium having toner images formed on both sides thereof passes through the press contact portion of the fixing device.

The toner present on the recording medium hinders the absorption of oil by the recording medium. Accordingly, where toner images are formed on both sides of the recording medium, oil is less absorbed by the recording medium when comparing with a case where a toner image is formed on only one side of the recording medium. In the case of the recording medium having toner images on both sides thereof, an amount of oil flowing to the back side of the belt is large in the conventional fixing device, and hence a possibility that the above-mentioned slip will occur more easily is high.

On the other hand, in the image forming apparatus of the item 12, a heating width of the heating mechanism when viewed in the width direction of the endless belt is shorter than an oil application width of the oil application mechanism, and a heat distribution along the heating width direction is profiled such that an amplitude of temperature at the side ends of the endless belt is lower than that at a central portion of the endless belt. Therefore, even in the case of the recording medium having toner images on both sides thereof, a stable fixing operation is secured.

Thus, the image forming apparatus of the item 12 is capable of forming (fixing) images on both sides of the recording medium through a stable fixing operation.

The image forming apparatus of the item 13 includes the fixing device defined in any of items 7, 8, 9, 10, 11 and 12 above, and is capable of forming a full color toner image that results from superposing toner of a plurality of colors on the recording medium. Therefore, there is a case that a recording medium having full color toner image formed on at least one side thereof passes through the pressure contact portion of this fixing device.

As described above, the toner present on the recording medium hinders the absorption of oil by the recording medium. Accordingly, where a full color image that results from superimposing toner of a plurality of colors is formed on the recording medium, oil is less absorbed by the recording medium when comparing with a case where a monochromatic toner image is formed on the recording medium. When a full color image that results from superimposing toner of a plurality of colors is formed on the recording medium, the amount of oil flowing onto the back side of the endless belt is large, and a possibility that the slip will occur more easily is high.

On the other hand, a heating width of the heating mechanism when viewed in the width direction of the endless belt is shorter than an oil application width of the oil application mechanism, and a heat distribution along the heating width direction is profiled such that an amplitude of temperature at the side ends of the endless belt is lower than that at a central portion of the endless belt.

The image forming apparatus of the item 13 is capable of forming a stable full color image. When combined with the construction of the item 12, it is capable of forming (fixing) stable full color images on both sides of the recording medium.

14. A fixing device having an endless belt extending around a plurality of rollers, the endless belt being heated and circulated, a rotary member being pressed against the endless belt, a backup member for supporting the endless belt on the inner side thereof at a press contact portion between the endless belt and the rotary member, and an oil application mechanism for applying release oil to a surface of the endless belt, wherein a recording medium having a toner image formed thereon is moved to pass through the press contact portion between the endless belt and the rotary member, whereby the toner image is fused and permanently affixed onto the recording medium, and an oil absorbing member for absorbing oil on the surface of the endless belt is provided downstream of the press contact portion but upstream of an oil application position by the oil application mechanism when viewed in the circulating direction of the endless belt, and the oil absorbing member is brought into contact with the endless belt at a position where the endless belt is put on the roller.

15. In the fixing device of the item 14, a length of the oil absorbing member when viewed in the widthwise direction of the endless belt is longer than a maximum passing width of the recording medium that may be supplied for the image formation.

16. In the fixing device of item 14 or 15 above, the oil absorbing member comes in contact with the endless belt at portions corresponding to at least the end portions of a passing area of a recording medium of which the passing width is the largest of those recording media that may be that may be supplied for the image formation purpose, and portions respectively extended outward beyond the end portions when viewed in the widthwise direction, whereby it absorbs the oil.

17. In the fixing device of item 14, 15 or 16 above, the oil absorbing member is a roller which absorbs oil in a state that it is in contact with the endless belt and rotates with a circulation of the endless belt in a follower manner.

18. In the fixing device of any of items 14 to 17 above, both outside ends of the oil absorbing member as viewed in the widthwise direction of the endless belt are located within the side edges of the endless belt.

19. In the fixing device of any of items 14 to 18 above, an oil application width of the oil application mechanism is longer than a maximum image-forming width within which an image may be formed on the recording medium.

20. An image forming apparatus having the fixing device defined in any of items 14 to 19 above, wherein the image forming apparatus is capable of forming toner images on both sides of the recording medium.

21. An image forming apparatus having the fixing device defined in any of items 14 to 20 above, wherein the image forming apparatus is capable of forming a full color toner image that results from superposing toner of a plurality of colors on the recording medium.

In the thus constructed fixing device of the item 14, which has an endless belt extending around a plurality of rollers and being heated and circulated, a rotary member being pressed against the endless belt, and a backup member for supporting the endless belt on the inner side thereof at a press contact portion between the endless belt and the rotary member, a recording medium having a toner image formed thereon is moved to pass through the press contact portion between the endless belt and the rotary member, whereby the toner image is fused and permanently affixed onto the recording medium. The fixing device includes an oil application mechanism for applying release oil to a surface of the endless belt. Because of this, an offset phenomenon does not occur easily.

Further, an oil absorbing member for absorbing oil on the surface of the endless belt of which the surface is coated with oil is provided downstream of the press contact portion but upstream of an oil application position by the oil application mechanism when viewed in the circulating direction of the endless belt. Therefore, if the oil passes through the pressure contact region of the press contact portion and still adheres to the surface of the endless belt downstream of the pressure contact portion, the oil is absorbed by the oil absorbing member at a position located upstream of the oil application position.

Therefore, the oil is prevented from being accumulated on the endless belt, and flowing to the back side of the endless belt (at least the oil flowing to the back side of the belt is remarkably reduced in amount.).

For this reason, in the fixing device of the item 14, when the endless belt is driven by the drive roller disposed on the inner side of the belt, it is natural that the endless belt is stably driven and as a result, a stable fixing operation is secured. The same thing is true also when it is drive by a drive roller located outside the belt.

Further, since the oil absorbing member contacts the endless belt at a location where the endless belt is wound on the roller, the oil absorbing member is surely kept in contact with the endless belt. Therefore, it is possible to reliably obtain the absorbing effect of oil from the endless belt.

In the fixing device of the item 15, a length of the oil absorbing member when viewed in the widthwise direction of the endless belt is longer than a maximum passing width of the recording medium that may be supplied for the image formation.

Therefore, the oil that is not absorbed by or transferred to the recording medium is absorbed by the oil absorbing member without fail.

Thus, the fixing operation of the fixing device is further stable.

In the fixing device of the item 16, the oil absorbing member comes in contact with the endless belt at portions corresponding to at least the end portions of a passing area of a recording medium of which the passing width is the largest of those recording media that may be that may be supplied for the image formation purpose, and portions respectively extended outward beyond the end portions when viewed in the widthwise direction, whereby it absorbs the oil. Therefore, the oil that is not absorbed by or transferred to the recording medium of the maximum passing width, is effectively absorbed.

Further, the oil absorbing member is not brought into contact with the endless belt within the passing area of the recording medium of the maximum passing width. Therefore, a chance of damaging the endless belt is lessened and a wear of the same is reduced.

In the fixing device of the item 17, the oil absorbing member is a roller which absorbs oil in a state that it is in contact with the endless belt and rotates with a circulation of the endless belt in a follower manner. Therefore, a chance of damaging the endless belt is lessened and a wear of the same is reduced.

In the fixing device of the item 18, both outside ends of the oil absorbing member as viewed in the widthwise direction of the endless belt are located within the side edges of the endless belt. Even if oil which has been once absorbed by the oil absorbing member leaks for some reason or other, the leaking oil is prevented from flowing to the back side of the endless belt (at least the amount of the leaking oil is remarkably reduced)

Accordingly, a more stable fixing operation is performed.

In the fixing device of the item 19, an oil application width of oil application mechanism is longer than a maximum image forming width within which an image may be formed on the recording medium. In other words, the maximum image-forming width is shorter than the oil application width. Therefore, an offset phenomenon is prevented with certainty.

An image forming apparatus of the item 20 has the fixing device defined in any of items 14 to 19 above, and is capable of forming toner images on both sides of the recording medium. Therefore, sometimes, a recording medium having toner images formed on both sides thereof passes through the press contact portion of the fixing device.

The toner present on the recording medium hinders the absorption of oil by the recording medium. Accordingly, where toner images are formed on both sides of the recording medium, oil is less absorbed by the recording medium when comparing with a case where a toner image is formed on only one side of the recording medium. In the case of the recording medium having toner images on both sides thereof, a possibility that the above-mentioned slip more easily occurs is high.

On the other hand, in the image forming apparatus of the item 20, at least an oil absorbing member for absorbing oil on the surface of the endless belt of which the surface is coated with oil is provided downstream of the press contact portion but upstream of an oil application position by the oil application mechanism when viewed in the circulating direction of the endless belt. Therefore, even when toner images are formed on both sides of the recording medium, a stable fixing operation is performed.

Thus, the image forming apparatus of the item 20 is capable of forming (fixing) images on both sides of the recording medium through a stable fixing operation.

An image forming apparatus of the item 21 has the fixing device defined in any of items 14 to 20 above, and is capable of forming a full color toner image that results from superposing toner of a plurality of colors on the recording medium. Therefore, there is a case where a recording medium having a full color image formed on one of the sides of the recording medium passes through the press contact portion of the fixing device.

As described above, the toner present on the recording medium hinders the absorption of oil by the recording medium. Accordingly, where a full color image that results from superimposing toner of a plurality of colors is formed on the recording medium, oil is less absorbed by the recording medium when comparing with a case where a monochromatic toner image is formed on the recording medium. When a full color image that results from superimposing toner of a plurality of colors is formed on the recording medium, and possibility that the slip will occur more easily is high.

On the other hand, in the image forming apparatus of the item 21, at least an oil absorbing member for absorbing oil on the surface of the endless belt of which the surface is coated with oil is provided downstream of the press contact portion but upstream of an oil application position by the oil application mechanism when viewed in the circulating direction of the endless belt. Therefore, even when toner images are formed on both sides of the recording medium, a stable fixing operation is performed. Therefore, even if a full color image that results of superimposing a plurality of colors is formed on the recording medium, a stable fixing operation is performed.

The image forming apparatus of the item 21 is capable of forming a stable full color image. When combined with the construction of the item 20, it is capable of forming (fixing) stable full color images on both sides of the recording medium.

22. A fixing device having a first rotary member to be heated, a second rotary member being pressed against the first rotary member, and an oil application mechanism for applying release oil to a surface of one of the first and second rotary members, wherein a recording medium having a toner image formed thereon is moved to pass through a press contact portion between the first and second rotary members, whereby the toner image is fused and permanently affixed onto the recording medium, and an oil absorbing member for absorbing oil on the surface of the rotary member of which the surface is coated with release oil is provided downstream of the press contact portion but upstream of an oil application position by the oil application mechanism when viewed in the rotational direction of the rotary member.

23. A fixing device having a first rotary member to be heated, a second rotary member being pressed against the first rotary member, and an oil application mechanism for applying release oil to a surface of one of the first and second rotary members, wherein a recording medium having a toner image formed thereon is moved to pass through a press contact portion between the first and second rotary members, whereby the toner image is fused and permanently affixed onto the recording medium, and an oil absorbing member is provided in association with one of the first and second rotary members, the oil absorbing member absorbs oil transferred from the surface of the other rotary member.

24. In the fixing device of item 22 or 23 above, a length of the oil absorbing member when viewed in the widthwise direction of the rotary member is longer than a maximum passing width of the recording medium that may be supplied for the image formation.

25. In the fixing device of any of items 22, 23 and 24, the oil absorbing member comes in contact with the rotary member at portions corresponding to at least the end portions of a passing area of a recording medium of which the passing width is the largest of those recording media that may be supplied for the image formation purpose, and portions respectively extended outward beyond the end portions when viewed in the widthwise direction, whereby it absorbs the oil.

26. In the fixing device of any of items 22 to 25, the oil absorbing member is a roller which absorbs oil in a state that it is in contact with the rotary member and rotates with a circulation of the endless belt in a follower manner.

27. In the fixing device of any of items 22 to 26, the first rotary member is an endless belt extending around a plurality of rollers, and the oil absorbing member is in contact with the endless belt over the full oil application width by the oil application mechanism at a position other than a position where the endless belt is put on the roller.

28. In the fixing device of the item 27, both outside ends of the oil absorbing member as viewed in the widthwise direction of the endless belt are located within the side edges of the endless belt.

29. In the fixing device of any of items 22 to 28, an oil application width of the oil application mechanism is longer than a maximum image-forming width within which an image may be formed on the recording medium.

30. An image forming apparatus having the fixing device defined in any of items 22 to 29 above, wherein the image forming apparatus is capable of forming toner images on both sides of the recording medium.

31. An image forming apparatus having the fixing device defined in any of items 22 to 30 above, wherein the image forming apparatus is capable of forming a full color toner image that results from superposing toner of a plurality of colors on the recording medium.

In the fixing device of the item 22, a recording medium having a toner image formed thereon is moved to pass through a press contact portion between the first rotary member heated and the second rotary member pressed against the first rotary member, whereby the toner image is fused and permanently affixed onto the recording medium. The fixing device includes an oil application mechanism for applying release oil to a surface of one of the first and second rotary members. Because of this, an offset phenomenon does not occur easily.

Further, in the fixing device, an oil absorbing member for absorbing oil on the surface of the rotary member is provided downstream of the press contact portion but upstream of an oil application position by the oil application mechanism when viewed in the rotational direction of the rotary member. Therefore, if the oil passes through the pressure contact region of the press contact portion and still adheres to the surface of the endless belt downstream of the press contact portion, the oil is absorbed by the oil absorbing member at a position located upstream of the oil application position.

Accordingly, no oil is accumulated on the rotary member, so that a slip between the driving rotary member and the rotary member as a follower or between the rotary member and the recording medium is prevented, and a stable fixing operation is performed.

In the fixing device of the item 23, a recording medium having a toner image formed thereon is moved to pass through a press contact portion between the first rotary member heated and the second rotary member pressed against the first rotary member, whereby the toner image is fused and permanently affixed onto the recording medium. The fixing device includes an oil application mechanism for applying release oil to a surface of one of the first and second rotary members. Because of this, an offset phenomenon does not occur easily.

Thus, oil applied on the surface of one of the rotary member may be transferred onto the other rotary member. If no measure is taken, there is a possibility that oil is accumulated on both end portions of both the rotary members where those members are not in contact with the recording medium.

In the fixing device of the item 23, an oil absorbing member is provided in association with one of the first and second rotary members, the oil absorbing member absorbs oil transferred from the surface of the other rotary member. Therefore, the oil on the surfaces of both the rotary members is absorbed by the oil absorbing member, through "the other rotary member".

Accordingly, no oil is accumulated on the rotary member, so that a slip between the driving rotary member and the rotary member as a follower or between the rotary member and the recording medium is prevented, and a stable fixing operation is performed.

In the fixing device of the item 24, a length of the oil absorbing member when viewed in the widthwise direction of the rotary member is longer than a maximum passing width of the recording medium that may be supplied for the image formation. Therefore, the oil that is not absorbed by or transferred to the recording medium is absorbed by the oil absorbing member with certainty.

Accordingly, a more stable fixing operation is performed.

In the fixing device of the item 25, the oil absorbing member comes in contact with the rotary member at portions corresponding to at least the end portions of a passing area of a recording medium of which the passing width is the largest of those recording media that may be supplied for the image formation purpose, and portions respectively extended outward beyond the end portions when viewed in the widthwise direction, whereby it absorbs the oil. Therefore, the oil that is not absorbed by or transferred to the recording medium of the maximum passing width, is effectively absorbed.

Further, the oil absorbing member is not brought into contact with the endless belt within the passing area of the recording medium of the maximum passing width. Therefore, a chance of damaging the endless belt is lessened and a wear of the same is reduced.

In the fixing device of the item 26, the oil absorbing member is a roller which absorbs oil in a state that it is in contact with the rotary member and rotates with a circulation of the endless belt in a follower manner. Therefore, a chance of damaging the endless belt is lessened and a wear of the same is reduced.

In the fixing device of the item 27, the first rotary member heated is an endless belt. It is quickly heated when comparing with a case where it is a roller.

In the fixing device, an oil absorbing member for absorbing oil on the surface of the endless belt is provided downstream of the press contact portion but upstream of an oil application position by the oil application mechanism when viewed in the rotational direction of the endless belt. Therefore, if the oil passes through the pressure contact region of the press contact portion and still adheres to the surface of the endless belt downstream of the pressure contact region, the oil is absorbed by the oil absorbing member at a position located upstream of the oil application position.

Therefore, the oil is prevented from being accumulated on the endless belt, and flowing to the back side of the endless belt (at least the oil flowing to the back side of the belt is remarkably reduced in amount.).

For this reason, in the fixing device of the item 27, when the endless belt is driven by the drive roller disposed on the inner side of the belt, it is natural that the endless belt is stably driven and as a result, a stable fixing operation is secured. The same thing is true also when it is drive by a drive roller located outside the belt.

Further, in the fixing device, the oil absorbing member is in contact with the endless belt over the full oil application width by the oil application mechanism at a position other than a position where the endless belt is put on the roller. This contact prior to the oil application position makes the state of belt stable, and suppresses creases that are likely to be formed on the belt. Therefore, and a good oil application state is obtained.

In the fixing device of the item 28, both outside ends of the oil absorbing member as viewed in the widthwise direction of the endless belt are located within the side edges of the endless belt. Even if oil which has been once absorbed by the oil absorbing member leaks for some reason or other, the leaking oil is prevented from flowing to the back side of the endless belt (at least the amount of the leaking oil is remarkably reduced).

Accordingly, a more stable fixing operation is performed.

In the fixing device of the item 29, an oil application width of the oil application mechanism is longer than a maximum image-forming width within which an image may be formed on the recording medium. In other words, the maximum image-forming width is shorter than the oil application width. Therefore, an offset phenomenon is prevented with certainty.

An image forming apparatus of the item 30 has the fixing device defined in any of items 22 to 29 above, and is capable of forming toner images on both sides of the recording medium. Therefore, sometimes, a recording medium having toner images formed on both sides thereof passes through the press contact portion of the fixing device.

The toner present on the recording medium hinders the absorption of oil by the recording medium. Accordingly, where toner images are formed on both sides of the recording medium, oil is less absorbed by the recording medium when comparing with a case where a toner image is formed on only one side of the recording medium. In the case of the recording medium having toner images on both sides thereof, a possibility that the above-mentioned slip more easily occurs is high.

On the other hand, in the image forming apparatus of the item 30, at least an oil absorbing member for absorbing oil on the surface of the rotary member of which the surface is coated with oil is provided downstream of the press contact portion but upstream of an oil application position by the oil application mechanism when viewed in the circulating direction of the rotary member (in the construction of the item 23, the oil absorbing member is provided for absorbing the oil transferred to "the other rotary member"). Therefore, even when toner images are formed on both sides of the recording medium, a stable fixing operation is performed.

Thus, the image forming apparatus of the item 30 is capable of forming (fixing) images on both sides of the recording medium through a stable fixing operation.

An image forming apparatus of the item 31 has the fixing device defined in any of items 22 to 30 above, and is capable of forming a full color toner image that results from superposing toner of a plurality of colors on the recording medium. Therefore, there is a case where a recording medium having a full color image formed on one of the sides of the recording medium passes through the press contact portion of the fixing device.

As described above, the toner present on the recording medium hinders the absorption of oil by the recording medium. Accordingly, where a full color image that results from superimposing toner of a plurality of colors is formed on the recording medium, oil is less absorbed by the recording medium when comparing with a case where a monochromatic toner image is formed on the recording medium. When a full color image that results from superimposing toner of a plurality of colors is formed on the recording medium, and possibility that the slip will occur more easily is high.

On the other hand, in the image forming apparatus of the item 31, at least an oil absorbing member for absorbing oil on the surface of the rotary member of which the surface is coated with oil is provided downstream of the press contact portion but upstream of an oil application position by the oil application mechanism when viewed in the circulating direction of the rotary member (in the construction of the item 23, the oil absorbing member is provided for absorbing the oil transferred to "the other rotary member"). Therefore, even if a full color image that results of superimposing a plurality of colors is formed on the recording medium, a stable fixing operation is performed.

The image forming apparatus of the item 31 is capable of forming a stable full color image. When combined with the construction of the item 30, it is capable of forming (fixing) stable full color images on both sides of the recording medium.

32. A fixing device having a first rotary member to be heated, a second rotary member being pressed against the first rotary member, and an oil application roller for applying release oil to a surface of one of the first and second rotary members, wherein a recording medium having a toner image formed thereon is moved to pass through a press contact portion between the first and second rotary members, whereby the toner image is fused and permanently affixed onto the recording medium, and an oil absorbing member for absorbing only the oil applied by the end portions of the oil application roller, which the oil is part of the release oil applied onto the surface of the rotary member by the oil application roller, is provided downstream of the press contact portion but upstream of an oil application position by the oil application roller when viewed in the rotational direction of the rotary member of which the surface is coated with release oil.

33. In the fixing device of item 32 above, the oil absorbing member comes in contact with the rotary member at portions corresponding to at least portions respectively extended outward beyond the end portions of a passing area of a recording medium of which the passing width is the largest of those recording media that may be supplied for the image formation purpose, when viewed in the widthwise direction, whereby it absorbs the oil.

34. In the fixing device of item 32 or 33, the oil absorbing member is a roller which absorbs oil in a state that it is in contact with the endless belt and rotates with a rotation of the rotary member in a follower manner.

35. In the fixing device of any of items 32 to 34 above, the first rotary member is an endless belt extending around a plurality of rollers, the oil application width of the oil application roller is shorter than the width of the endless belt, and both outside ends of the oil absorbing member as viewed in the widthwise direction of the endless belt are located within the side edges of the endless belt.

36. In the fixing device of any of items 32 to 35 above, the oil absorbing member includes a pair of contact portions which are brought into contact with the rotary member at portions thereof which are coated with oil by both ends of the oil application roller, to thereby absorb the oil as part of oil applied by the oil application roller, and the oil holder portion, which interconnects the contact portions, for holding the oil absorbed from those contact portions in a state that it is not brought into contact with the rotary member.

37. In the fixing device of any of items 32 to 36 above, an application width of a part of the oil applied by the oil application roller, which is not absorbed by the oil absorbing roller, is longer than the maximum image-forming width within which an image may be formed on the recording medium.

38. An image forming apparatus having the fixing device defined in any of items 32 to 37 above, wherein the image forming apparatus is capable of forming toner images on both sides of the recording medium.

39. An image forming apparatus having the fixing device defined in any of items 32 to 38 above, wherein the image forming apparatus is capable of forming a full color toner image that results from superposing toner of a plurality of colors on the recording medium.

In the fixing device of the item 32, a recording medium having a toner image formed thereon is moved to pass through a press contact portion between the first rotary member heated and the second rotary member pressed against the first rotary member, whereby the toner image is fused and permanently affixed onto the recording medium. The fixing device includes an oil application mechanism for applying release oil to a surface of at least one of the first and second rotary members. Because of this, an offset phenomenon does not occur easily.

Further, in the fixing device, an oil absorbing member for absorbing only the oil applied by the end portions of the oil application roller, which the oil is part of the release oil applied onto the surface of the rotary member by the oil application roller, is provided downstream of the press contact portion but upstream of an oil application position by the oil application roller when viewed in the rotational direction of the rotary member of which the surface is coated with release oil. Therefore, the oil applied by the end portions of the oil application roller, which the oil is part of the release oil applied onto the surface of the rotary member by the oil application roller, is absorbed by the oil absorbing member.

Accordingly, if a relatively large amount of oil is applied by the ends of the oil application roller, the oil is absorbed by the oil absorbing member before it reaches the press contact portion. For this reason, in this fixing device, no oil is accumulated at the ends of the rotary member, while the oil accumulation at the ends is inevitable in the convention art.

As a result, a slip between the driving rotary member and the rotary member as a follower or between the rotary member and the recording medium is prevented, and a stable fixing operation is performed.

In the fixing device of the item 33, the oil absorbing member comes in contact with the rotary member at portions corresponding to at least portions respectively extended outward beyond the end portions of a passing area of a recording medium of which the passing width is the largest of those recording media that may be supplied for the image formation purpose, when viewed in the widthwise direction, whereby it absorbs the oil. Therefore, such oil that is not absorbed by the recording medium of the maximum passing width or not transferred to the same in a fixing device not provided with the oil absorbing member, is effectively absorbed before it reaches the press contact portion.

Accordingly, in the fixing device of the item 33, a more stable fixing operation is performed.

Since the oil absorbing member is not in contact with the rotary member in a zone within the passing area of the recording medium of the maximum passing width, a chance of damaging the passing area of the rotary member is lessened and a wear of the same is reduced.

In the fixing device of the item 34, the oil absorbing member is a roller which absorbs oil in a state that it is in contact with the endless belt and rotates with a rotation of the rotary member in a follower manner. Therefore, a chance of damaging the passing area of the rotary member is lessened and a wear of the same is reduced.

In the fixing device of the item 35, the first rotary member is an endless belt. It is quickly heated when comparing with a case where it is a roller.

The endless belt extends around a plurality of rollers, and the oil application width of the oil application roller is shorter than the width of the endless belt. Therefore, the end portions of the surface of the endless belt contain area portions not coated with the oil. The portions serves to block the spreading of the oil. Therefore, oil that is applied on the top side of the endless belt is prevented from flowing to the back side of the belt.

Further, both outside ends of the oil absorbing member as viewed in the widthwise direction of the endless belt are located within the side edges of the endless belt. Even if oil which has been once absorbed by the oil absorbing member leaks for some reason or other, there is less chance that the leaking oil flows to the back side of the endless belt (at least the amount of the leaking oil is remarkably reduced).

For this reason, in the fixing device of the item 35, when the endless belt is driven by the drive roller disposed on the inner side of the belt, it is natural that the endless belt is stably driven and as a result, a stable fixing operation is secured. The same thing is true also when it is drive by a drive roller located outside the belt.

In the fixing device of the item 36, the oil absorbing member includes a pair of contact portions are brought into contact with the rotary member at portions thereof which are coated with oil by both ends of the oil application roller, to thereby absorb the oil as part of oil applied by the oil application roller, and the oil holder portion, which interconnects the contact portions, for holding the oil absorbed from those contact portions in a state that it is not brought into contact with the rotary member. Therefore, when an amount of oil absorbed by the contact portions increases in excess of a predetermined level of amount, it moves from the contact portions to the oil holder portion, and is held there.

Accordingly, the amount of oil that can be absorbed by the oil absorbing member is increased in the fixing device of the item 36.

In the fixing device of the item 37, a width of a part of the oil applied by the oil application roller but not absorbed by the oil absorbing roller, i.e., the width of oil entering the contact potion, is longer than the maximum image-forming width within which an image may be formed on the recording medium. occurrence of the offset phenomenon is prevented with certainty.

An image forming apparatus of the item 38 has the fixing device defined in any of items 32 to 37 above, and is capable of forming toner images on both sides of the recording medium. Therefore, sometimes, a recording medium having toner images formed on both sides thereof passes through the press contact portion of the fixing device.

The toner present on the recording medium hinders the absorption of oil by the recording medium. Accordingly, where toner images are formed on both sides of the recording medium, oil is less absorbed by the recording medium when comparing with a case where a toner image is formed on only one side of the recording medium. In the case of the recording medium having toner images on both sides thereof, a possibility that the above-mentioned slip more easily occurs is high.

On the other hand, in the image forming apparatus of the item 38, at least an oil absorbing member for absorbing only the oil applied by the end portions of the oil application roller, which the oil is part of the release oil applied onto the surface of the rotary member by the oil application roller, is provided downstream of the press contact portion but upstream of an oil application position by the oil application roller when viewed in the rotational direction of the rotary member of which the surface is coated with release oil. Therefore, even when toner images are formed on both sides of the recording medium, a stable fixing operation is performed.

Thus, the image forming apparatus of the item 38 is capable of forming (fixing) images on both sides of the recording medium through a stable fixing operation.

An image forming apparatus of the item 39 has the fixing device defined in any of items 32 to 38 above, and is capable of forming a full color toner image that results from superposing toner of a plurality of colors on the recording medium. Therefore, there is a case where a recording medium having a full color image formed on one of the sides of the recording medium passes through the press contact portion of the fixing device.

As described above, the toner present on the recording medium hinders the absorption of oil by the recording medium. Accordingly, where a full color image that results from superimposing toner of a plurality of colors is formed on the recording medium, oil is less absorbed by the recording medium when comparing with a case where a monochromatic toner image is formed on the recording medium. When a full color image that results from superimposing toner of a plurality of colors is formed on the recording medium, and a possibility that the slip will occur more easily is high.

On the other hand, in the image forming apparatus of the item 39, at least an oil absorbing member for absorbing only the oil applied by the end portions of the oil application roller, which the oil is part of the release oil applied onto the surface of the rotary member by the oil application roller, is provided downstream of the press contact portion but upstream of an oil application position by the oil application roller when viewed in the rotational direction of the rotary member of which the surface is coated with release oil. Therefore, even if a full color image that results of superimposing a plurality of colors is formed on the recording medium, a stable fixing operation is performed.

The image forming apparatus of the item 39 is capable of forming a stable full color image. When combined with the construction of the item 38, it is capable of forming (fixing) stable full color images on both sides of the recording medium.

40. A fixing device having an endless belt being heated and circulated, a rotary member being pressed against the endless belt, a backup member for supporting the endless belt on the inner side thereof at a press contact portion between the endless belt and the rotary member, and an oil application roller for applying release oil to a surface of the endless belt, wherein a recording medium having a toner image formed there on is moved to pass through the press contact portion between the endless belt and the rotary member, whereby the toner image is fused and permanently affixed onto the recording medium, and blades for gathering or collecting the oil applied by the end portions of the oil application roller, which the oil is part of the release oil applied onto the surface of the endless belt by the oil application roller, toward a central part of the surface of the endless belt are provided upstream of the press contact portion but downstream of an oil application position by the oil application roller when viewed in the circulating direction of the endless belt.

41. In the fixing device of item 40 above, the blades come in contact with the endless belt at portions of the belt corresponding to portions respectively extended outward beyond the end portions, when viewed in the widthwise direction, which the portions are those of a passing area of a recording medium of which the passing width is the largest of those recording media that may be supplied for the image formation purpose, and gathers the oil to within the maximum passing width.

42. In the fixing device of item 40 or 41 above, an oil application width of the oil application roller is set to be shorter than the width of the endless belt.

43. In the fixing device of any of items 40 to 42 above, an oil length after the oil is gathered by the blades is longer than the maximum image-forming width within which an image may be formed on the recording medium.

44. An image forming apparatus having the fixing device defined in any of items 40 to 43 above, wherein the image forming apparatus is capable of forming toner images on both sides of the recording medium.

45. An image forming apparatus having the fixing device defined in any of items 40 to 44 above, wherein the image forming apparatus is capable of forming a full color toner image that results from superposing toner of a plurality of colors on the recording medium.

In the thus constructed fixing device of the item 40, which has an endless belt being heated and circulated, a rotary member being pressed against the endless belt, and a backup member for supporting the endless belt on the inner side thereof at a press contact portion between the endless belt and the rotary member, a recording medium having a toner image formed thereon is moved to pass through the press contact portion between the endless belt and the rotary member, whereby the toner image is fused and permanently affixed onto the recording medium. The fixing device includes an oil application roller for applying release oil to a surface of the endless belt. Because of this, an offset phenomenon does not occur easily.

Further, in the fixing device, blades for gathering the oil applied by the end portions of the oil application roller, which the oil is part of the release oil applied onto the surface of the endless belt by the oil application roller, toward a central part of the surface of the endless belt are provided upstream of the press contact portion but downstream of an oil application position by the oil application roller when viewed in the circulating direction of the endless belt. Therefore, the oil applied by the end portions of the oil application roller, which the oil is part of the release oil applied onto the surface of the endless belt by the oil application roller, is gathered toward a central part of the surface of the endless belt by the blades.

When a relatively large amount of oil is applied by the ends of the oil application roller, the oil is gathered toward a central part of the surface of the endless belt by the blades before the oil reaches the press contact portion. Thus, the oil applied to the surface of the endless belt is prevented from flowing to the back side of the endless belt (At least, the oil flowing to the back side of the endless belt is remarkably reduced).

As a result, not only in a case where the endless belt is driven by a roller disposed inside of the endless belt, but also in a case where the endless belt is driven by a roller disposed outside of the endless belt, a more stable driving and a more stable fixing operation is performed.

In the fixing device of the item 41, the blades are designed to contact the endless belt at positions extends laterally outwardly from the ends of the passing area of the recording medium having the maximum passing width among the recording media to be subjected to the image formation, and to collect the oil at least within the maximum passing width. Therefore, the oil thus collected by the blades toward the central portion of the endless belt is substantially absorbed by or transferred to the recording medium having the maximum passing width. Even if the recording media of various sizes, which have passing widths smaller than the maximum passing width, are subjected to the image formation so that the oil may remain outside of the passing widths, the remaining oil is substantially absorbed by or transferred to the recording medium once the recording medium having the maximum passing width passes through the fixing device to be subjected to the image formation.

Therefore, even if a relatively large amount of the oil is applied by the end portions of the oil application roller, the oil is more positively prevented from flowing to the backside of the endless belt. Consequently, a more stable fixing operation is realized.

In the fixing device of the item 42, an oil application width of the oil application roller is set to be shorter than the width of the endless belt. Therefore, the end portions of the surface of the endless belt contain area portions not coated with the oil. The portions serves as portions to block the spreading of the oil. Therefore, the oil that is applied on the top side of the endless belt is more positively prevented from flowing to the back side of the belt. As a result, a more stable fixing operation is performed.

In the fixing device of the item 43, an oil length after the oil is gathered by the blades is longer than the maximum image-forming width within which an image may be formed on the recording medium. Therefore, an offset phenomenon is prevented with certainty.

An image forming apparatus of the item 44 has the fixing device defined in any of items 40 to 43 above, and is capable of forming toner images on both sides of the recording medium. Therefore, sometimes, a recording medium having toner images formed on both sides thereof passes through the press contact portion of the fixing device.

The toner present on the recording medium hinders the absorption of oil by the recording medium. Accordingly, where toner images are formed on both sides of the recording medium, oil is less absorbed by the recording medium when comparing with a case where a toner image is formed on only one side of the recording medium. In the case of the recording medium having toner images on both sides thereof, a possibility that the above-mentioned slip more easily occurs is high.

On the other hand, in the image forming apparatus of the item 44, at least the blades for gathering the oil applied by the end portions of the oil application roller, which the oil is part of the release oil applied onto the surface of the endless belt by the oil application roller, toward a central part of the surface of the endless belt are provided upstream of the press contact portion but downstream of an oil application position by the oil application roller when viewed in the circulating direction of the endless belt. Therefore, even when toner images are formed on both sides of the recording medium, a stable fixing operation is performed.

Thus, the image forming apparatus of the item 44 is capable of forming (fixing) images on both sides of the recording medium through a stable fixing operation.

An image forming apparatus of the item 45 has the fixing device defined in any of items 40 to 44 above, and is capable of forming a full color toner image that results from superposing toner of a plurality of colors on the recording medium. Therefore, there is a case where a recording medium having a full color image formed on one of the sides of the recording medium passes through the press contact portion of the fixing device.

As described above, the toner present on the recording medium hinders the absorption of oil by the recording medium. Accordingly, where a full color image that results from superimposing toner of a plurality of colors is formed on the recording medium, oil is less absorbed by the recording medium when comparing with a case where a monochromatic toner image is formed on the recording medium. When a full color image that results from superimposing toner of a plurality of colors is formed on the recording medium, and a possibility that the slip will occur more easily is high.

On the other hand, in the image forming apparatus of the item 45, at least the blades for gathering the oil applied by the end portions of the oil application roller, which the oil is part of the release oil applied onto the surface of the endless belt by the oil application roller, toward a central part of the surface of the endless belt are provided upstream of the press contact portion but downstream of an oil application position by the oil application roller when viewed in the circulating direction of the endless belt. Therefore, even if a full color image that results of superimposing a plurality of colors is formed on the recording medium, a stable fixing operation is performed.

The image forming apparatus of the item 45 is capable of forming a stable full color image. When combined with the construction of the item 44, it is capable of forming (fixing) stable full color images on both sides of the recording medium.

46. A fixing device having an endless belt extending around a heating roller and a backup roller and being circulated, an pressure roller being pressed against the backup roller with the endless belt being interposed therebetween to thereby form a fixing nip in connection with the endless belt, and a parting-agent application mechanism being pressed against the endless belt to apply release agent onto the endless belt at a position located downstream of said backup roller and upstream of said heating roller in the circulating direction of the endless belt, wherein a recording medium having a toner image thereon is moved to pass through the fixing nip whereby the toner image is fused and permanently affixed onto the recording medium, and when viewed in the axial direction of the backup roller, the rotational center of the heating roller is located downstream of a straight line connecting the rotational centers or the rotational axes of the backup roller and the pressure roller with respect to a passing direction of the recording medium passing through the fixing nip.

47. In the fixing device of item 46, the parting-agent application mechanism is brought into contact with the endless belt at a position closer to the backup roller than a mid position between a winding-end position of the endless belt onto the backup roller and a winding-start position of the same onto the heating roller.

48. In the fixing device of item 46 or 47, a circumscribed line that is drawn on the surfaces of the backup roller and the heating roller and that is located in a side where the endless belt is in contact with the parting-agent application mechanism is inclined toward the heating roller and toward the upstream side with respect to the passing direction of the recording medium beyond a perpendicular line.

The fixing device of the item 46 includes an endless belt extending around a heating roller and a backup roller and being circulated, and an pressure roller being pressed against the backup roller with the endless belt being interposed therebetween to thereby form a fixing nip in connection with the endless belt. Accordingly, a recording medium having a toner image formed thereon is moved to pass through the press contact portion between the endless belt heated by the heat roller, and the pressure roller, whereby the toner image is fused and permanently affixed onto the recording medium. The fixing device includes a parting-agent application mechanism which is brought into contact with the endless belt and applies release agent onto a surface of the endless belt. Because of this, an offset phenomenon in which the toner image is transferred from the recording medium onto the endless belt does not occur easily. The parting-agent application mechanism is brought into contact with the endless belt at a position downstream of the backup roller but upstream of the heating roller when viewed in the circulating direction of the endless belt. Therefore, there is little chance that endless belt heated by the heating roller drops in temperature due to the application of the release agent before it reaches the fixing nip.

In the fixing device of the item 46, when viewed in the axial direction of the backup roller, the rotational center of the heating roller is located downstream of a straight line connecting the rotational centers of the backup roller and the pressure roller with respect to a passing direction of the recording medium passing through the fixing nip. A force acting on the backup roller, caused by a tension of the endless belt extending around the backup roller and the heating roller, is directed downstream with respect to the passing direction of the recording medium. The resultant force obtained by combining a force acting on the backup roller when it is pressed against the pressure roller with the force, is also directed downward with respect to the passing direction of the recording medium.

Therefore, the rotational center of the backup roller is deflected in a convex manner toward the downstream with respect to the passing direction of the recording medium.

Accordingly, a transporting force acting on the endless belt at the fixing nip is represented by forces acting in directions in which the endless belt is spread outward at both sides of the fixing nip.

As described above, the endless belt is compressed together between the backup roller and the pressure roller by the strong force. Therefore, the transporting force acting on the endless belt at the fixing nip has a large effect on the endless belt.

Accordingly, when the forces to spread the belt outward act at the fixing nip N, the endless belt is not creased in a region located downstream of the fixing nip N. Because of this, a uniform contact is obtained between the parting-agent application mechanism and the belt, and as a result, no irregularity is formed in the oil applied to the endless belt.

The endless belt extends around the heating roller and the backup roller. Accordingly, its construction is relatively simple.

In the fixing device of the item 46, an oil application irregularity can be prevented with a relatively simple structure.

In the fixing device of the item 47, the parting-agent application mechanism is brought into contact with the endless belt at a position closer to the backup roller than a mid position between a winding-end position of the endless belt onto the backup roller and a winding-start position of the same onto the heating roller. Therefore, the parting-agent application mechanism is in contact with the endless belt at a position immediately after the belt passes through the fixing nip while being spread outward by the nip.

For this reason, the endless belt does not crease easily, and as a result, formation of an irregularity of the oil application is prevented more reliably.

In the fixing device of the item 48, a circumscribed line that is drawn on the surfaces of the backup roller and the heating roller and that is located in a side where the endless belt is in contact with the parting-agent application mechanism is inclined toward the heating roller and toward the upstream side with respect to the passing direction of the recording medium beyond a perpendicular line. Therefore, the influence of a vibration, which is caused by the weight of the endless belt, on the fixing device is lessened.

Accordingly, the endless belt does not crease easily, and the oil application nonuniformity is further reliably prevented.

49. A fixing device having an endless fixing belt extending around a plurality of rollers and being circulated, an pressure roller being brought into contact with one of the plurality of rollers while the fixing belt being interposed therebetween, to thereby form a fixing nip therebetween in connection with the fixing belt, a parting-agent/tension application mechanism being brought into contact with the fixing belt at a position other than a position where the fixing belt is put on the roller, to thereby apply release agent and tension to the fixing belt, and restricting portions for restricting such a behavior of the traveling fixing belt as to move aside when said restricting portions come in contact with the side ends of the fixing belt, the restricting portions being provided on a first roller located just downstream of the press contact portion of the parting-agent/tension application mechanism as viewed in the circulating direction of the fixing belt, and a length of the release-agent application/tension applying is shorter than the width of the fixing belt, and the parting-agent/tension application mechanism is brought into contact with the fixing belt at a position closer to a second roller than a midposition between a winding-start position of the endless belt onto the first roller and a winding-end position of the same onto the second roller located just upstream of the first roller.

50. In the fixing device of item 49, a tension that the fixing belt applies to the one roller is directed to the downstream side of the passing direction of the recording medium which passes through fixing nip.

51. In the fixing device of item 49 or 50, the parting-agent/tension application mechanism is an elastic roller having a hardness of JIS-A30° or lower.

52. In the fixing device of item 49 or 50, the parting-agent/tension application mechanism is a rigid roller, and the ends of the rigid roller are each formed to have a curved surface of 0.1 mm or longer in radius.

53. A fixing device having an endless fixing belt extending around a plurality of rollers and being circulated, a pressure roller being brought into contact with one of the plurality of rollers while the fixing belt being interposed therebetween, to thereby form a fixing nip therebetween in connection with the fixing belt, a press contact member being brought into contact with the fixing belt at a position other than a position where the fixing belt is put on the roller, to thereby apply a tension to the fixing belt, and restricting portions for restricting such a behavior of the traveling fixing belt as to move aside when said restricting portions come in contact with the side ends of the fixing belt, the restricting portions being provided on a first roller located just downstream of the press contact portion of the press contact member as viewed in the circulating direction of the fixing belt, and a length of the press contact member is shorter than the width of the fixing belt, and the press contact member is brought into contact with the fixing belt at a position closer to a second roller than a mid position between a winding-start position of the endless belt onto the first roller and a winding-end position of the same onto the second roller located just upstream of the first roller.

54. In the fixing device of item 53, a tension that the fixing belt applies to the one roller is directed to the downstream side of the passing direction of the recording medium which passes through fixing nip.

The fixing device of the item 49 includes an endless fixing belt extending around a plurality of rollers and being circulated, and a pressure roller being brought into contact with one of the plurality of rollers while the fixing belt being interposed therebetween, to thereby form a fixing nip therebetween in connection with the fixing belt. Therefore, a recording medium having a toner image formed thereon is moved to pass through the press contact portion, whereby the toner image is permanently affixed onto the recording medium. Further, it includes a parting-agent/tension application mechanism being brought into contact with the fixing belt at a position other than a position where the fixing belt is put on the roller, to thereby apply release agent and tension to the fixing belt. Accordingly, an offset phenomenon does not occur easily, and the tension is applied to the fixing belt. Further, restricting portions for restricting such a behavior of the traveling fixing belt as to move aside when said restricting portions come in contact with the side ends of the fixing belt, is provided on a first roller located just downstream of the press contact portion of the parting-agent/tension application mechanism as viewed in the circulating direction of the fixing belt. Therefore, such a behavior of the traveling fixing belt as to move aside is restricted.

A length of the release-agent/tension application mechanism is shorter than the width of the fixing belt. Therefore, the release agent application width is shorter than the belt width. The side end portions of the surface of the endless belt contain area portions not coated with oil. Those area portions function to block the spreading of the oil. Therefore, the oil applied to the top surface of the endless belt is prevented from flowing to the back side of the endless belt (at least the oil flowing to the back side of the belt is remarkably reduced in amount.).

In the fixing device of the item 49, when the endless belt is driven by the drive roller disposed on the inner side of the belt, it is natural that because of the presence of the area portions not coated with the oil, the endless belt is stably driven and as a result, a stable fixing operation is secured.

The same thing is true also when it is drive by a drive roller (e.g., the pressure roller) located outside the belt.

Further, the parting-agent/tension application mechanism is brought into contact with the fixing belt at a position closer to a second roller than a mid position between a winding-start position of the endless belt onto the first roller and a winding-end position of the same onto the second roller located just upstream of the first roller. A degree of the bending of both sides of the fixing belt at the press contact portion of the release-agent/tension application mechanism is smaller than that in a case where the release-agent/tension application mechanism is located at a position closer to the first roller than the mid position.

Accordingly, a stress that is generated as mentioned above in the belt side edges of the endless belt is also reduced when the bending is removed by winding the fixing belt on the first roller is also small. As a result, the belt side edges and their vicinal portions are rarely damaged.

As described, in the fixing device of the item 49, the slip does not occur easily, a stable fixing operation is performed, and the fixing belt is also difficult to be damaged.

In the fixing device of the item 50, a tension that the fixing belt applies to the one roller is directed to the downstream side of the passing direction of the recording medium which passes through the fixing nip. Therefore, the following advantageous effects can be obtained.

Figure 29A:
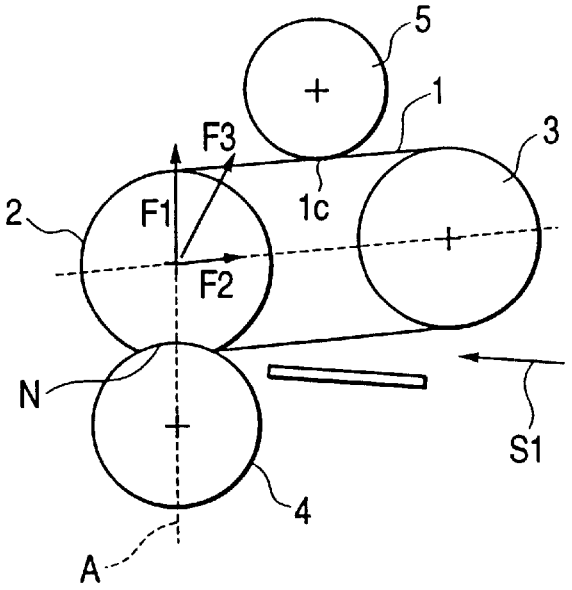
FIG. 29A PRIOR ART
FIGS. 29A and 29B shows a fixing device disclosed in JP-A-8-334997.
Figure 29B:
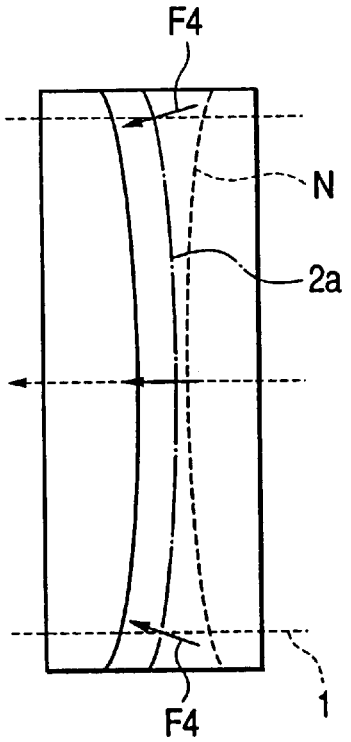
FIG. 29B PRIOR ART
Figure 30:
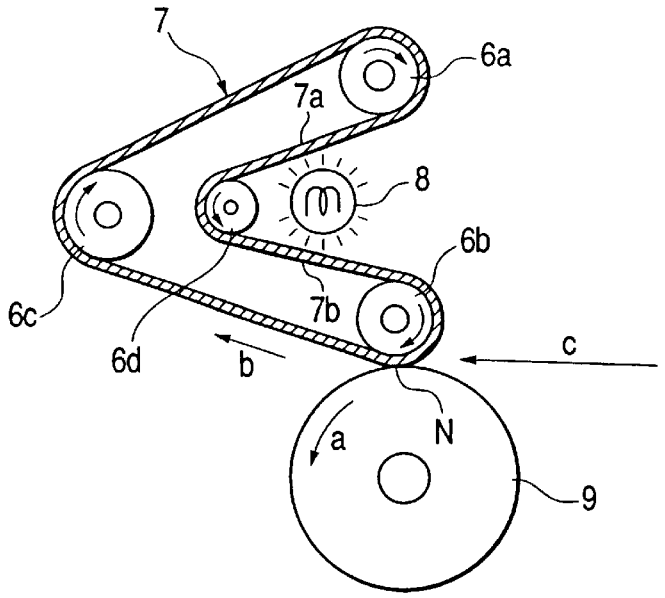
FIG. 30 PRIOR ART
FIG. 30 shows a fixing device disclosed in JP-A-9-138600.
Figure 31:
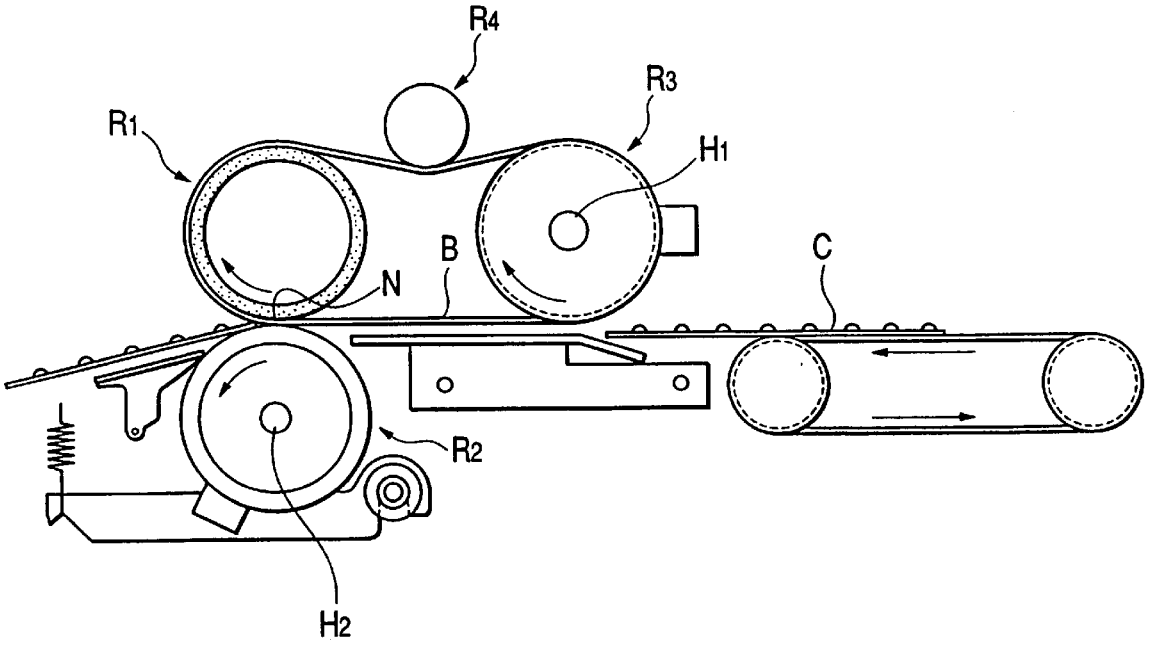
FIG. 31 PRIOR ART
FIG. 31 shows a fixing device disclosed in Japanese patent No. 2813297.
Figure 32:
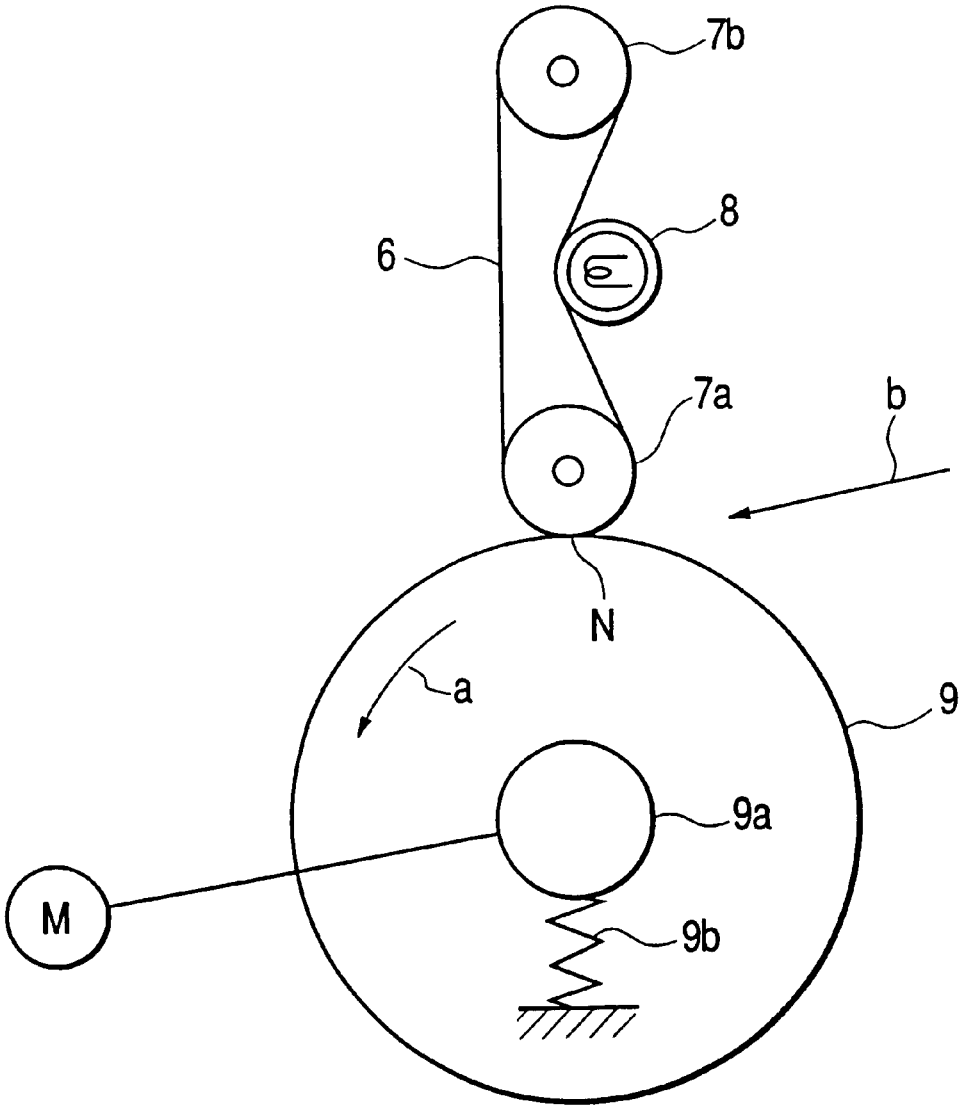
FIG. 32 PRIOR ART
FIG. 32 shows a fixing device disclosed in JP-A-9-138600.
Figure 33:
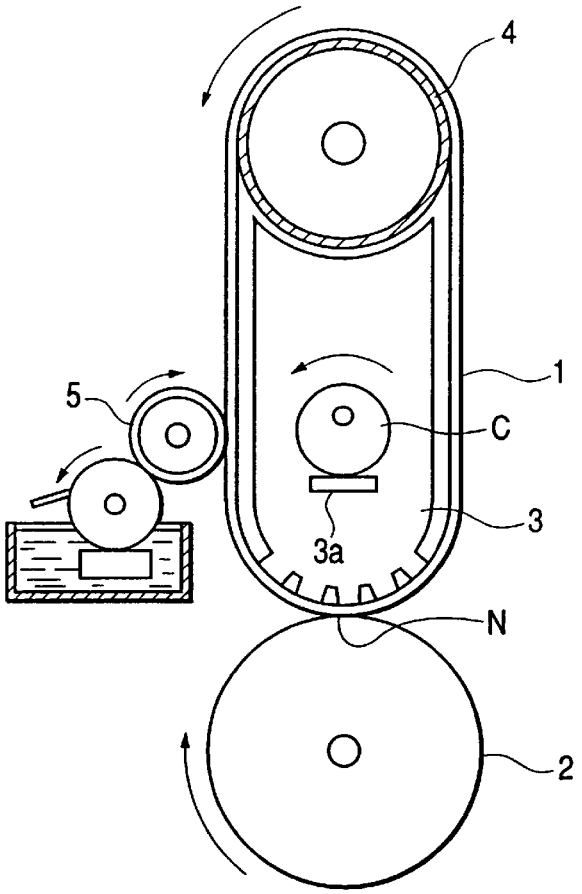
FIG. 33 PRIOR ART
FIG. 33 is a diagram showing a fixing device disclosed in JP-A-61-101179.

FIG. 29 is a diagram schematically showing a fixing device disclosed in JP-A-8-334997; FIG. 29A is a front view of the fixing device and FIG. 29B is a plan view showing mainly a fixing nip N.

As shown in FIG. 29A, a direction (seen an arrow F2) of a tension that the fixing belt 1 applies to a fixing roller 2 (corresponds to the "one roller" in the present invention) is directed upstream with respect to a passing direction S1 of a recording medium which passes through the fixing nip N.

Therefore, a force F2 acting on the fixing roller 2 by a tension of the fixing belt 1 extending around the fixing roller 2 and a heating roller 3 is directed upstream with respect to the passing direction S1 of the recording medium. Accordingly, the resultant force F3 of the forces F1 and F2 is also directed upstream with respect to the passing direction S1 of the recording medium, where the force F1 acts on the fixing roller by pressure contact with the pressure roller 4.

Therefore, as shown in FIG. 29B, an axial line 2*a* of the fixing roller 2 is deflected in a convex manner toward the upstream side with respect to the passing direction S1, by the force F3.

Accordingly, a transporting force acting on the fixing belt 1 at the fixing nip N is a force F4 which acts, at both sides of the fixing nip N, on the fixing belt 1 so as to cause it to move toward the lateral center of the fixing belt 1.

At the fixing nip N, the fixing belt 1 is nipped between the fixing roller 2 and a pressure roller 4. Therefore, a transporting force acting on the fixing belt 1 at the fixing nip N greatly influences the fixing belt 1.

Figure 28A:
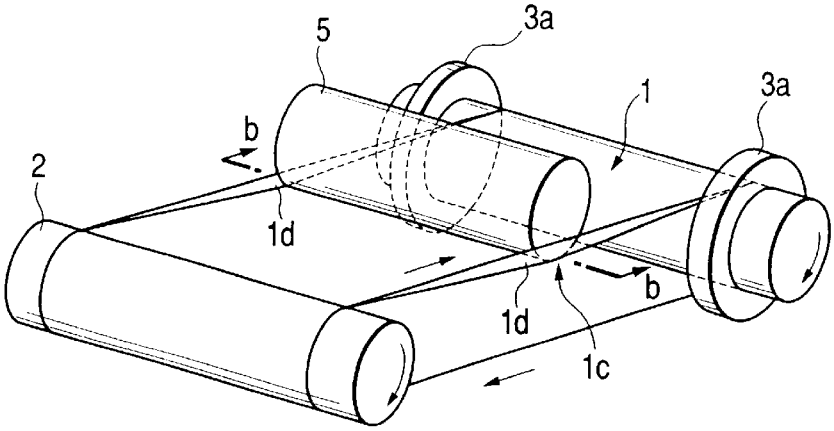
FIGS. 28A, 28B and 28C show a state of bending of an endless belt.
Figure 28B:
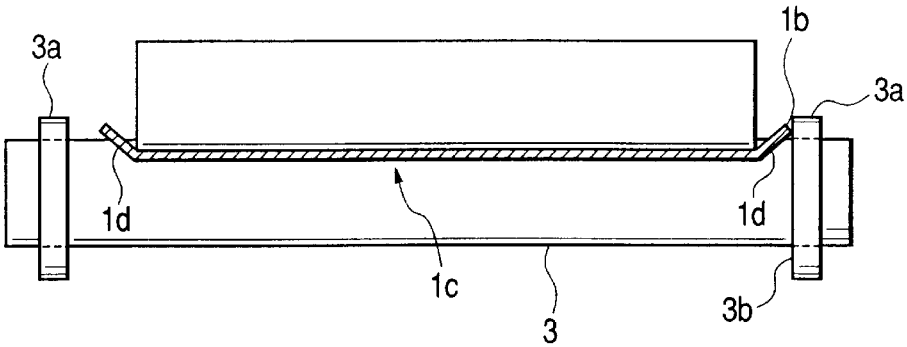
Figure 28C:
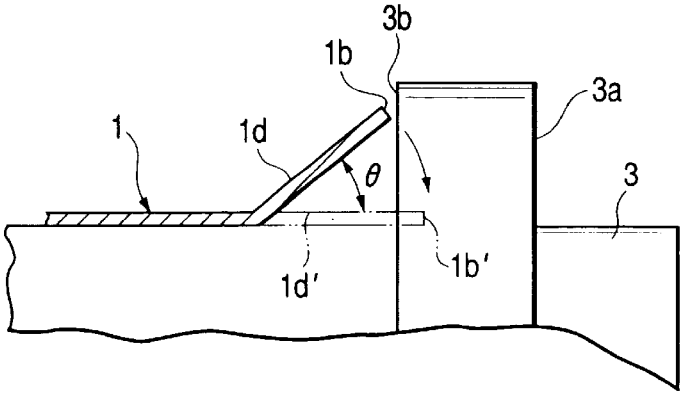

Accordingly, if a force F4 acts, at both sides of the fixing nip N, on the fixing belt 1 so as to cause it to move toward the center of the fixing belt 1 as viewed in its width direction, the fixing belt 1 is likely to be deflected in the width direction through the action of the force F4. By this influence of the deflection, a degree of bending of the bent portions 1*d* at both ends of the fixing belt 1 at the press contact portion 1*c* (see FIG. 28) of the oil application roller 5 is increased.

For this reason, the vicinal portions of the side ends 1*b* of the fixing belt 1 is easy to be damaged.

On the other hand, in the fixing device of the item 50, a tension that the fixing belt applies to the one roller is directed to the downstream side of the passing direction of the recording medium which passes through fixing nip. Therefore, a force that applies to the one roller by a tension of the fixing belt is a force directed downstream with respect to the passing direction of the recording medium. Therefore, the resultant force of this force and a force acting on the one roller when it is pressed against the pressure roller is also a force directed downstream with respect to the passing direction of the recording medium.

Therefore, the axial line of the one roller is deflected in a convex manner toward the downstream side with respect to the passing direction of the recording medium.

A transporting force acting on the belt at the fixing nip acts to spread the belt outward at both sides of the fixing nip.

As described above, the belt is nipped between the one roller and the pressure roller at the fixing nip, so that the transporting force acting on the belt at the fixing nip greatly influences the belt.

When the transporting force acts to spread the belt outward at both sides of the fixing nip, this force prevents the belt from deflecting or loosening in the width direction at a position located downstream of the fixing nip N. A degree of the bending of both sides of the fixing belt at the press contact portion of the release-agent/tension application mechanism is small.

Accordingly, a stress that is generated as mentioned above in the belt side edges of the endless belt is also reduced when the bending is removed by winding the fixing belt on the first roller. As a result, the belt side edges and their vicinal portions are rarely damaged.

Thus, in the fixing device of the item 50, the slip does not occur further easily, a stable fixing operation is performed, and the fixing belt is hard to be damaged.

In the fixing device of the item 51, the parting-agent/tension applying mechanism is an elastic roller having a hardness of JIS-A30° or lower. As a result, the belt side edges and their vicinal portions are rarely damaged.

Where the release-agent/tension applying mechanism is an elastic roller, if its hardness is greater than JIS-A30°, the bending at both sides edges of the fixing belt at the press contact portion of the release-agent/tension applying mechanism is acute (bending angle). On the other hand, its hardness is JIS-A30° or smaller, the bending is gentle.

Accordingly, in the fixing device of the item 51, a stress that is generated as mentioned above in the belt side edges of the endless belt when the bending is removed by winding the fixing belt on the first roller is further reduced. As a result, the belt side edges and their vicinal portions are rarely damaged.

In the fixing device of the item 52, the parting-agent/tension applying mechanism is a rigid roller, and the ends of the rigid roller are each formed to have a curved surface of 0.1 mm or longer in radius. Therefore, the belt side edges and their vicinal portions are rarely damaged.

Where the release-agent/tension applying mechanism is a rigid roller, if each end of it is shaped to have acute or sharp corners of which the radius is 0.1 mm or shorter, the bending (in this case, the bending corners) at both sides edges of the fixing belt at the press contact portion of the release-agent/tension applying mechanism is acute or sharp, and the possibility of damaging the bending corner itself is increased, in addition to the damage by the above-mentioned stress. On the other hand, if it is shaped to have a curved surface of which the radius is 0.1 mm or longer, the bending corner itself is not damaged easily.

Thus, in the fixing device of the item 52, the bending corner itself is not damaged easily although the release-agent/tension applying mechanism is the rigid roller. A stress that is generated, as described above, in the side edges 111 when the fixing belt is put on the first roller and the bending is removed, is further reduced, and as a result, the vicinal portions of the belt side edges is more difficult to be damaged.

The fixing device of the item 53 includes an endless fixing belt extending around a plurality of rollers and being circulated, and an pressure roller being brought into contact with one of the plurality of rollers while the fixing belt being interposed therebetween, to thereby form a fixing nip therebetween in connection with the fixing belt. Therefore, a recording medium having a toner image formed thereon is moved to pass through the press contact portion, whereby the toner image is permanently affixed onto the recording medium. Further, it includes a press contact member being brought into contact with the fixing belt at a position other than a position where the fixing belt is put on the roller, to thereby apply tension to the fixing belt. Accordingly, a tension is applied to the fixing belt by the press contact member. Further, restricting portions for restricting such a behavior of the traveling fixing belt as to move aside when said restricting portions come in contact with the side ends of the fixing belt, is provided on a first roller located just downstream of the press contact portion of the press contact member as viewed in the circulating direction of the fixing belt. Therefore, such a behavior of the traveling fixing belt as to move aside is restricted.

The press contact member may be a cleaning blade, cleaning pad or other suitable members.

A length of the press contact member is shorter than the width of the fixing belt, and the press contact member is brought into contact with the fixing belt at a position closer to a second roller than a mid position between a winding-start position of the endless belt onto the first roller and a winding-end position of the same onto the second roller located just upstream of the first roller. A degree of the bending of both sides of the fixing belt at the press contact portion of the press contact member is smaller than that in a case where the press contact member is located at a position closer to the first roller than the mid position.

Accordingly, a stress that is generated as mentioned above in the belt side edges of the endless belt when the bending is removed by winding the fixing belt on the first roller is also small. As a result, the belt side edges and their vicinal portions are rarely damaged.

As described, in the fixing device of the item 53, the fixing belt is also difficult to be damaged although the fixing device includes the press contact member shorter than the width of the belt.

In the fixing device of the item 54, a tension that the fixing belt applies to the one roller is directed to the downstream side of the passing direction of the recording medium which passes through fixing nip. Therefore, as referred to in the effect description of the item 50, the belt does not deflect easily in the width direction at a position located downstream of the fixing nip N. A degree of the bending of both sides of the fixing belt at the press contact portion of the press contact member is small. As a result, the belt side edges and their vicinal portions are rarely damaged.

55. A fixing device having an endless fixing roller extending around a heating roller and a backup roller and being circulated, a pressure roller being pressed against the backup roller with the fixing belt being interposed therebetween, to form a fixing nip therebetween in connection with the fixing belt, an auxiliary heating mechanism for heating the pressure roller, and a parting-agent application mechanism for applying release agent on the fixing belt while being brought into contact with the fixing belt at a position downstream of the fixing nip but upstream of the heating roller when viewed in the circulating direction of the fixing belt, wherein a recording medium having a toner image formed thereon is moved to pass through the fixing nip, whereby the toner image is fused and permanently affixed onto the recording medium, and the parting-agent application mechanism is disposed above the auxiliary heating mechanism and at a position located downstream of the fixing nip when viewed in the passing direction of the recording medium.

56. In the fixing device of item 55 above, the auxiliary heating mechanism includes a release agent holder for holding release agent to be applied and a contact portion for applying release agent to the fixing belt while being in contact with the fixing belt, and at least said contact portion is disposed above the auxiliary heating mechanism and at a position located downstream of the fixing nip when viewed in the passing direction of the recording medium.

57. In the fixing device of item 55 or 56 above, the auxiliary heating mechanism includes a release agent holder for holding release agent to be applied and a contact portion for applying release agent to the fixing belt while being in contact with the fixing belt, and at least said release agent holder is disposed above the auxiliary heating mechanism and at a position located downstream of the fixing nip when viewed in the passing direction of the recording medium.

The fixing device of the item 55 has an endless fixing roller extending around a heating roller and a backup roller and being circulated, a pressure roller being pressed against the backup roller with the fixing belt being interposed therebetween, to form a fixing nip therebetween in connection with the fixing belt, and an auxiliary heating mechanism for heating the pressure roller. When a recording medium having a toner image formed thereon is moved to pass through the fixing nip between the fixing belt heated by the heating roller and the pressure roller heated by the auxiliary heating mechanism, the toner image is fused and permanently affixed onto the recording medium. Further, it includes a parting-agent application mechanism for applying release agent on the fixing belt while being brought into contact with the fixing belt. Because of this, an offset phenomenon in which the toner image is transferred from the recording medium onto the endless belt does not occur easily. The parting-agent application mechanism applies release agent on the fixing belt while being brought into contact with the fixing belt at a position downstream of the fixing nip but upstream of the heating roller when viewed in the circulating direction of the fixing belt. Therefore, the endless belt heated by the heating roller is prevented from dropping in temperature due to the application of the release agent before it reaches the fixing nip.

In the fixing device of the item 55, the parting-agent application mechanism is disposed above the auxiliary heating mechanism and at a position located downstream of the fixing nip when viewed in the passing direction of the recording medium. The radiation heat and the hot air stream from the auxiliary heating mechanism will reach the parting-agent application mechanism without being substantially interrupted by the backup roller and the fixing belt.

Therefore, the release agent application mechanism is directly heated not only by its contact with the fixing belt but also by the radiation heat and the hot air stream from the auxiliary heating mechanism. For this reason, the release agent application mechanism is relatively quickly heated in an initial stage of the operation of the fixing device, and its temperature becomes stable quickly.

Accordingly, when the recording medium passes through the fixing nip N and as a result, a temperature of the fixing belt becomes different in its widthwise direction, and in this state the fixing belt comes in contact with there lease agent application mechanism, the temperature difference reflects a lesser influence on the temperature of the release agent application mechanism. As a result, the amount of release agent by the release agent application mechanism becomes less different in the belt width direction and hence a chance of formation of an irregularity on the fixed image is lessened.

Thus, the fixing device of the item 55 has such an advantage effect that it hardly gives rise to an application irregularity of the release agent.

In the fixing device of the item 56, the auxiliary heating mechanism includes a release agent holder for holding release agent to be applied and a contact portion for applying release agent to the fixing belt while being in contact with the fixing belt, and at least said contact portion is disposed above the auxiliary heating mechanism and at a position located downstream of the fixing nip when viewed in the passing direction of the recording medium. At least the contact portion of the parting-agent application mechanism is relatively quickly heated in the initial stage of the operation of the fixing device, and its temperature becomes stable quickly.

Accordingly, a less temperature difference is created in the belt width direction and hence the amount of application of the release agent over the width of the belt becomes less different. As a result, a chance of formation of an irregularity on the fixed image is lessened.

Thus, the fixing device of the item 56 has also such an advantage effect that it hardly gives rise to an application irregularity of the release agent.

In the fixing device of the item 57, the auxiliary heating mechanism includes a release agent holder for holding release agent to be applied and a contact portion for applying release agent to the fixing belt while being in contact with the fixing belt, and at least said release agent holder is disposed above the auxiliary heating mechanism and at a position located downstream of the fixing nip when viewed in the passing direction of the recording medium. At least the release agent holder of the parting-agent application mechanism is relatively quickly heated in the initial stage of the operation of the fixing device, and its temperature becomes stable quickly.

Accordingly, a less temperature difference is created in the belt width direction and hence the amount of application of the release agent over the width of the belt becomes less different. As a result, a chance of formation of an irregularity on the fixed image is lessened.

Thus, the fixing device of the item 57 has also such an advantage effect that it hardly gives rise to an application irregularity of the release agent.

When the fixing device of the item 56 is combined with the fixing device of the item 56, the release agent holder and the contact portion are relatively quickly heated in the initial stage of the operation of the fixing device, and their temperature becomes stable quickly. Accordingly, a less temperature difference is created in the belt width direction and hence the amount of application of the release agent over the width of the belt becomes less different. As a result, a chance of formation of an irregularity on the fixed image is much lessened.

58. A fixing device in which at least one of paired rollers has an elastic layer, one of the paired rollers are pressed against the other, a recording medium having a toner image thereon is moved to pass through a press contact portion of the paired rollers, to thereby fix the toner image on the recording medium, and a distance between the shafts or axes of the paired rollers is fixed.

59. A fixing device having an endless belt to be being heated, a pressure roller being pressed against the endless belt, a backup roller for supporting the endless belt on the inner side thereof at a press contact portion between the endless belt and the pressure roller, wherein at least one of the pressure roller and the backup roller has an elastic layer, and a recording medium having a toner image thereon is moved to pass through the press contact portion, to thereby fix the toner image on the recording medium, and a distance between the shafts or axes of the pressure roller and the backup roller is fixed.

In the fixing device of the item 58, a recording medium having a toner image thereon is moved to pass through a press contact portion of the paired rollers pressed to each other, to thereby fix the toner image on the recording medium.

The axis-to-axis distance between the paired rollers is fixed, and at least one of the rollers includes an elastic layer. Therefore, a pressing force acting between both the rollers is obtained by reaction force to the compression force of the elastic layer.

Since the axis-to-axis distance between the paired rollers is fixed, a parallelism deviation between both the axes of those rollers is readily secured.

Therefore, a noticeable deviation of the transportation direction of the recording medium is not created by both the rollers at the press contact portion between the rollers. The recording medium does not crease easily.

Figure 34:
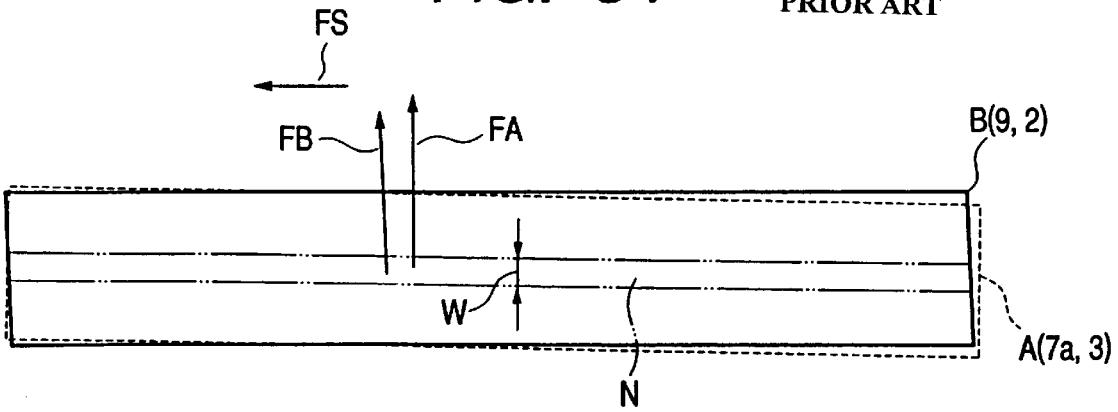
FIG. 34 PRIOR ART
FIG. 34 shows a state of parallelism deviation between two rollers.

Thus, the axis-to-axis distance between the rollers is fixed and invariable. Because of this, when a relatively thick recording medium passes through the press contact portion between the rollers, the elastic layer is greatly compressed in accordance with the thickness of the recording medium. When a relatively thick recording medium passes through the press contact portion N, the pressing force at the press contact portion N and the width of the same (see W in FIG. 34) are larger than those when a relatively thin recording medium passes therethrough.

Accordingly, when a relatively thick recording medium passes through the press contact portion N, a larger pressing force (also a larger heat when the roller is a heating roller) is applied to the recording medium for a longer time.

Thus, the fixing device of the item 58 is capable of fixing a good toner image even on a relatively thick recording medium without specifically changing fixing conditions in accordance with a thickness of the recording medium.

As described above, in the fixing device of the item 58, the recording medium does not crease easily. A good toner image can be formed even on a relatively thick recording medium in accordance with a thickness of the recording medium, without changing of fixing conditions.

In the fixing device of the item 59, a recording medium having a toner image thereon is moved to pass through a press contact portion of the endless belt heated and supported on the inside thereof by the back up roller, and the pressure roller, to thereby fix the toner image on the recording medium.

The axis-to-axis distance between the pressure roller and the backup roller is fixed, and at least one of the rollers includes an elastic layer. Therefore, a pressing force acting between both the rollers, i.e. a pressing force between the endless belt and the pressure roller, is obtained by reaction force to the compression force of the elastic layer.

Since the axis-to-axis distance between the pressure and backup rollers is fixed, a parallelism deviation between both the axes of those rollers is readily secured.

Therefore, a noticeable deviation of the transportation direction of the recording medium is not created by both the rollers at the press contact portion between the rollers. The recording medium does not crease easily, and the belt is hard to be damaged. Further, a force to move the belt in its width direction (e.g., an arrow FS in FIG. 34) is hard to generate. As a result, the surface of the belt is less deteriorated. This results in elongation of the belt life.

Further, the axis-to-axis distance between the rollers is fixed and invariable. Because of this, when a relatively thick recording medium passes through the press contact portion between the rollers, the elastic layer is greatly compressed in accordance with the thickness of the recording medium. When a relatively thick recording medium passes through the press contact portion N, the pressing force at the press contact portion N and the width of the same (see W in FIG. 34) are larger than those when a relatively thin recording medium passes therethrough.

Accordingly, when a relatively thick recording medium passes through the press contact portion N, a larger pressing force and heat are applied to the recording medium for a longer time.

Thus, the fixing device of the item 59 is capable of forming a good toner image even on a relatively thick recording medium in accordance with a thickness of the recording medium, without any special changing of fixing conditions.

As described above, in the fixing device of the item 59, the recording medium does not crease easily. And, its service life is elongated. Further, it is capable of forming a good toner image even on a relatively thick recording medium in accordance with a thickness of the recording medium, without changing of fixing conditions.

Image Forming Apparatus

FIG. 1 is a side view schematically showing an example of an image forming apparatus, to which a fixing device constructed according to the present invention is applicable.

The image forming apparatus is designed to be capable of forming a monochromatic color image and a full color image by use of a development unit of four colors, Y (yellow ), C(cyan), M (magenta) and K (black).

In FIG. 1, reference numeral 10 designates a photosensitive member unit, and its photosensitive member 11 is driven by an appropriate drive mechanism, not shown, to rotate in a direction of an arrow in the FIG.

The photosensitive member 11 includes an electrically conductive substrate and a photosensitive layer formed over the surface of the conductive substrate.

A charging roller 12 as a charging mechanism, an exposure unit 20 as an exposing mechanism, a development unit 30 (Y, C, M and K) as a developing mechanism, an intermediate transfer unit 40 as a transfer mechanism, and a cleaning mechanism 13 are disposed along the circumference of the photosensitive member 11 in its rotation direction. The photosensitive member 11, the charging roller 12 and the cleaning mechanism 13 are assembled into the photosensitive member unit 10.

The charging roller 12 comes in contact with the outer peripheral surface of the photosensitive member 11 to uniformly charge the outer peripheral surface. The exposure unit 20 selectively radiates exposing light L1 onto the uniformly charged outer peripheral surface of the photosensitive member 11 in accordance with desired image information, whereby an electrostatic latent image is formed on the photosensitive member 11 by the exposing light L1.

The development unit 30 applies toner to the electrostatic latent image to develop the latent image.

The development unit includes a yellow development sub-unit 30Y, a cyan development sub-unit 30C, a magenta development sub-unit 30M, and a black development sub-unit 30K. Those development sub-units 30Y, 30C, 30M, 30K are pivotably movable such that a development roller 31 of one of those development sub-units may selectively be brought into contact with the photosensitive member 11. The development unit 30 thus arranged is capable of selectively applying each of color toner of yellow, cyan, magenta and black onto the surface of the photosensitive member 11 to develop the electrostatic latent image on the photosensitive member 11 and to form a toner image.

The toner image thus formed is transferred onto an intermediate transfer belt 46, which forms an intermediate transfer member of the intermediate transfer unit 40.

The cleaning mechanism 13 includes a cleaner blade for scraping off toner left on the outer peripheral surface of the photosensitive member 11 and a toner receiving portion for receiving the toner thus scraped off by the cleaner blade.

The intermediate transfer unit 40 includes a drive roller 41, four roller followers 42 to 45, and an endless intermediate transfer belt 46 as intermediate transfer member suspended on those rollers.

A gear (not shown) fastened to an end of the drive roller 41 is in mesh with a drive gear (not shown) provided at an end of the photosensitive member 11. Accordingly, the drive roller 41 is rotated at a peripheral speed substantially equal to that of the photosensitive member 11, so that the intermediate transfer belt 46 is circulated in a direction of an arrow in the figure at a peripheral speed substantially equal to that of the photosensitive member 11.

The roller follower 45 is located at such a position that the intermediate transfer belt 46 is pressed against the photosensitive member 11 by a tension of the intermediate transfer belt 46 itself between the roller follower 45 and the drive roller 41. The pressing portion between the photosensitive member 11 and the intermediate transfer belt 46 forms a primary transfer portion T1.

An electrode roller, not shown, is provided in association with the drive roller 41 with the intermediate transfer belt 46 interposed therebetween. A primary transfer voltage is applied to the intermediate transfer belt 46 by way of the electrode roller.

The roller follower 42 is a tension roller, and urges the intermediate transfer belt 46 in its straining directions with the aid of urging mechanism (not shown).

The roller follower 43 is a backup roller forming a secondary transfer portion T2. A secondary transfer roller 48 as a secondary transfer mechanism is opposed to the backup roller 43 with respect to the intermediate transfer belt 46. The secondary transfer roller 48 may be brought into contact with the intermediate transfer belt 46 and separated from the same, by a contact/separation mechanism (not shown). A secondary transfer voltage is applied to the secondary transfer roller 48.

The roller follower 44 is a backup roller for a belt cleaner 49. The belt cleaner 49 includes a cleaner blade 49*a*, which is brought into contact with the intermediate transfer belt 46 to scrape off toner left on the outer peripheral surface thereof, and a receiving portion 49*b* for receiving toner scraped off by the cleaner blade 49*a*. The belt cleaner 49 may be brought into contact with and separated from the intermediate transfer belt 46 by a contact/separation mechanism (not shown).

The intermediate transfer belt 46 is a multi-layer belt including a conductive layer and a resistive layer, which is formed on the conductive layer and is to be brought into pressing contact with the photo sensitive member 11. The conductive layer is formed on an insulating substrate made of synthetic resin. A primary transfer voltage is applied to the conductive layer by way of the electrode roller.

During a circulation of the intermediate transfer belt 46, a toner image is transferred from the photosensitive member 11 onto the intermediate transfer belt 46 at the primary transfer portion T1. The toner image transferred onto the intermediate transfer belt 46 is transferred, at the secondary transfer portion T2, onto a sheet (recording medium) S, such as a sheet of paper, which is fed to between it and the secondary transfer roller 48.

The electrode roller, the urging mechanism for the tension roller 42, the secondary transfer roller 48 and the belt cleaner 49 are also assembled into the intermediate transfer unit 40.

The recording medium S is fed to the secondary transfer portion T2 at a predetermined timing by a gate roller pair G, from a sheet supplying unit 50. Reference numeral 51 designates a paper supply cassette 51 which holds a stack of recording media S, and numeral 52 represents a pickup roller 52.

A recording medium S to which a toner image has been transferred at the secondary transfer portion T2 passes through a fixing device 100 as a fixing mechanism, and as a result, the toner image is fixed on the recording medium S.

Reference numeral 100 indicates a fixing device which will be described in detail later.

After passing the fixing device 100, the recording medium S is finally transported through a sheet discharge path 60, and discharged to a sheet receiving portion 71, which is formed on a case 70 of the apparatus body. The image forming apparatus includes an inverting/returning path 60' which inverts the recording medium S having passed through the fixing device 100, and returns the inverted one to the secondary transfer portion T2. Specifically, a mechanism for transporting the recording medium S in this embodiment includes the sheet discharge path 60 and the inverting/returning path 60', and the sheet discharge path 60 forms a part of the inverting/returning path 60'.

The inverting/returning path 60' includes a switch-back path 63, and a return path 64. The switch-back path 63 has two separate sheet discharge paths 61 and 62, each of which is capable of transporting a recording medium S having passed through the fixing device 100 into the path per se, and transporting the recording medium S having been once transported thereinto in the reverse direction. The return path 64 returns the recording medium S, which is reversely transported from the switch-back path 63, to the secondary transfer portion T2, again. Accordingly, a recording medium S which is to be returned again to the secondary transfer portion T2 by the inverting/returning path 60' will be returned to the secondary transfer portion T2 in a state that the top and back surfaces or sides are inverted.

The image forming apparatus thus constructed is capable of forming a toner image on only the top surface (first surface) of the recording medium S and also both the top and back surfaces (first and second surfaces) of the same.

An operation of the overall image forming apparatus will briefly be described.

(i) When a print command signal (image forming signal) that is transferred from a host computer or the like (personal computer or the like) to a control unit (not shown) of the image forming apparatus, the photosensitive member 11, and the respective rollers 31 of the development unit 30, and the intermediate transfer belt 46 are driven to turn.

(ii) The outer peripheral surface of the photosensitive member 11 is uniformly charged by the charging roller 12.

(iii) The exposure unit 60 selectively exposes the uniformly charged outer peripheral surface of the photosensitive member in accordance with image information of a first color (for example, yellow), to thereby form an electrostatic latent image of yellow.

(iv) Only the development roller of the development sub-unit 30Y of the first color (for example, yellow) is brought into contact with the photosensitive member 11. The electrostatic latent image is developed and a toner image of the first color (for example, yellow) is formed on the photosensitive member 11.

(v) A primary transfer voltage the polarity of which is opposite to the charging polarity of the toner is applied to the intermediate transfer belt 46. As a result, the toner image is transferred from the photosensitive member 11 to the intermediate transfer belt 46 at the primary transfer portion T1. At this time, the secondary transfer roller 48 and the belt cleaner 49 are separated from the intermediate transfer belt 46.

(vi) Toner left on the photosensitive member 11 is removed by the cleaning mechanism 13, and the charge of the photosensitive member 11 is then removed by charge removal light L2 emitted from a charge removal mechanism 21.

(vii) A sequence of operation steps (ii) to (vi) is repeated as required. Specifically, toner images of second to fourth colors are transferred and formed onto the intermediate transfer belt 46 in a superimposing manner in accordance with print command signals.

(viii) Just before or after the leading edge of a recording medium S, which is supplied at a predetermined timing from the sheet supplying unit 50, reaches the secondary transfer portion T2 (viz., at a timing that a toner image is transferred from the intermediate transfer belt 46 onto a desired location on the recording medium S), the secondary transfer roller 48 is pressed against the intermediate transfer belt 46, while at the same time, a secondary transfer voltage is applied to the same, and the toner image (basically, a full color image formed by superimposing four color toner images) is transferred from the intermediate transfer belt 46 to the recording medium S. The belt cleaner 49 is brought into contact with the intermediate transfer belt 46 to remove toner still left on the intermediate transfer belt 46 after the secondary transfer.

(ix) The recording medium S passes through the fixing device 100, so that the toner image is fixed thereon. Thereafter, the recording medium S is directed to a predetermined position (the sheet receiving portion 71 when the print mode is not the both-side print mode, and the switch-back path 63 and the return path 64 when it is the both-side print mode).

To be more specific, when the image is formed on only the top side or surface (first surface) of the recording medium, the toner image is transferred onto the first surface of the recording medium S that is supplied from the sheet supplying unit 50 at the secondary transfer portion T2. After fixed by the fixing device 100, it is discharged into the sheet receiving portion 71 by way of the sheet discharge path 61 or 62. A path select mechanism (not shown) is provided at an entrance 60A of those paths 61 and 62. The path select mechanism selects the sheet discharge path (61 or 62) to which the recording medium S is to be transported.

When the image is formed on both sides (first and second sides or surfaces) of the recording medium, the toner image is transferred, at the secondary transfer portion T2, onto the first surface of the recording medium S which fed from the sheet supplying unit 50. And it is fixed by the fixing device 100. After the fixing, the recording medium enters the sheet discharge path 61 or 62 (switch-back path 63), and transported in the reverse direction through the return path 64, and transported back to the secondary transfer portion T2 by the gate roller pair G at a predetermined timing, and the toner image is transferred also onto the second surface of the recording medium. Thereafter, the fixing device 100 fixes the toner image also onto the second surface, and the resultant recording medium is discharged onto the sheet receiving portion 71 by way of the sheet discharge path 61 or 62.

<1st Embodiment>

Figure 2:
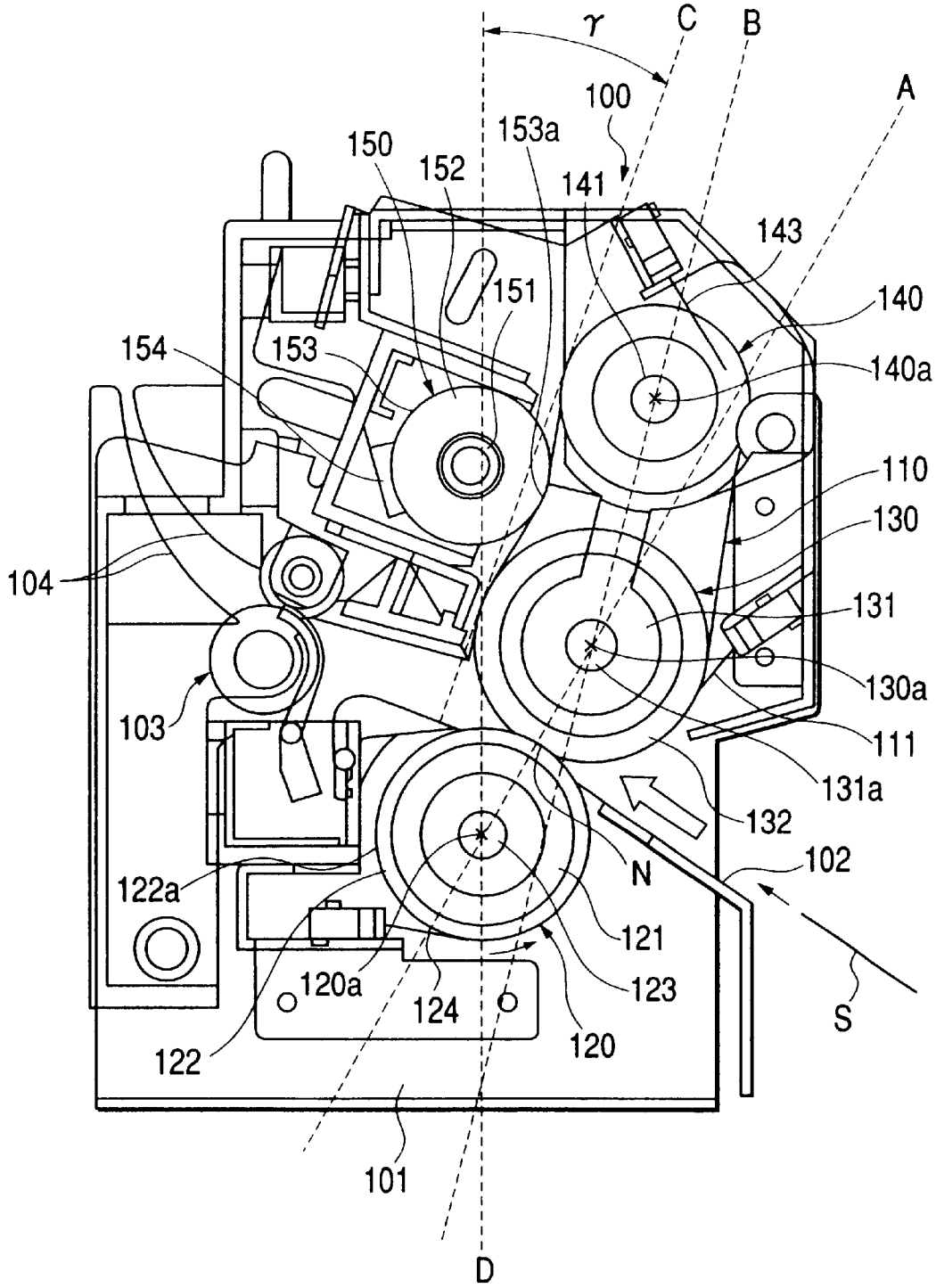
FIG. 2 schematically shows a major portion of a fixing device which constitutes a first embodiment of the present invention.
Figure 3:
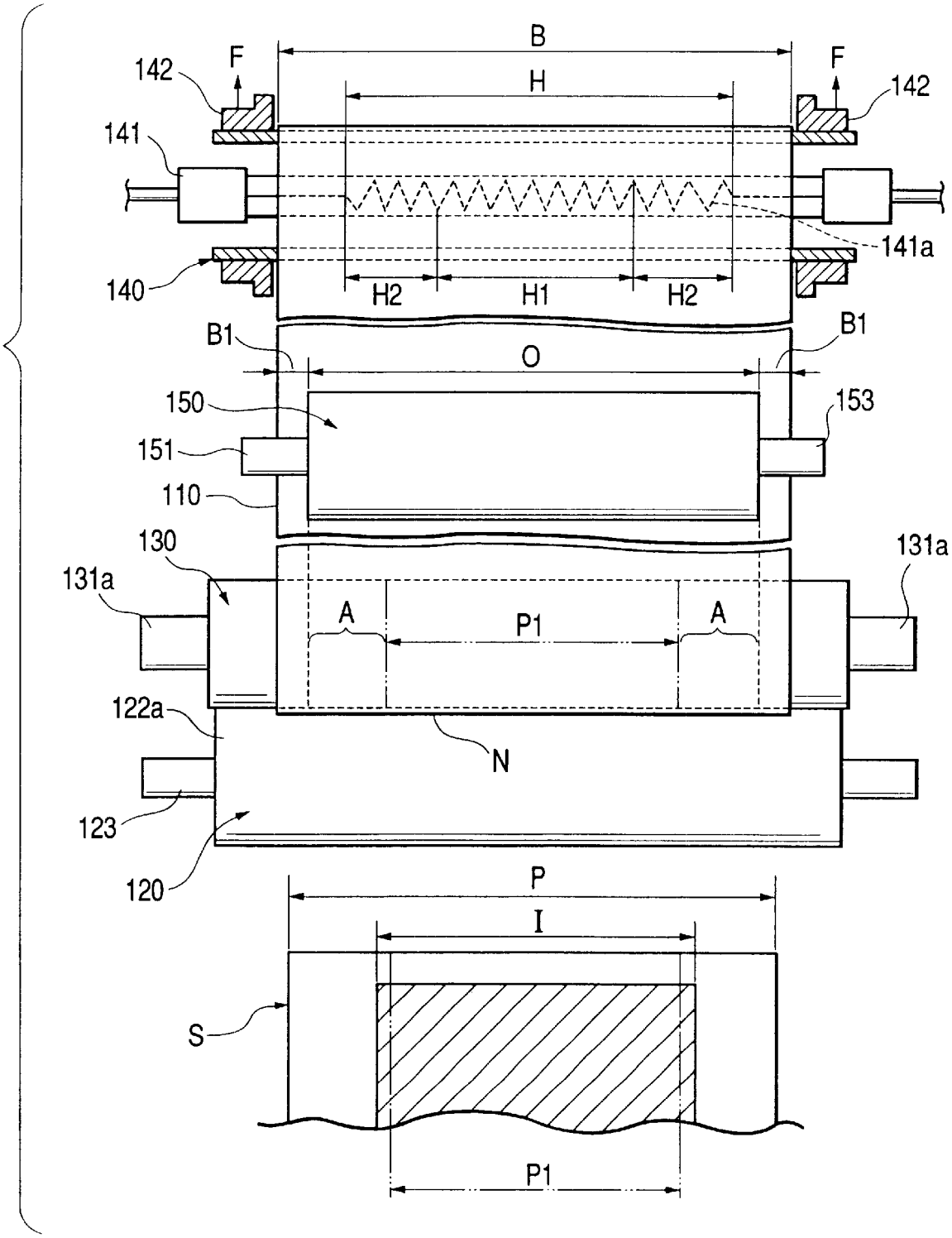
FIG. 3 schematically shows the fixing device of the first embodiment.

FIG. 2 is a view schematically showing a major portion of a fixing device 100 which constitutes a first embodiment of the present invention. FIG. 3 is a side view showing a major portion of the fixing device.

One of the features of the first embodiment resides in that an oil application width of an oil application mechanism is shorter than the width of an endless belt. Another feature of the embodiment resides in that a heating width of a heating mechanism is shorter than the oil application width of an oil application mechanism. Another feature of the embodiment resides in that a heat distribution along the heating width direction is profiled such that an amplitude of temperature at the side ends of the endless belt is lower than that at a central portion of the belt.

The fixing device 100 includes an endless belt (a fixing belt) 110 as a rotary member to be circulated, a pressure roller 120 as a rotary member to be brought into pressing contact with the endless belt 110, a backup roller 130 as a backup member for supporting the endless belt 110 from the inner side thereof at the press contact portion, a heating roller 140 for heating the endless belt 110, the heating roller being disposed along the widthwise direction of the endless belt 110, and an oil roller 150 as an oil application mechanism for applying release oil or separating agent onto the surface of the endless belt 110. The endless belt 110 is suspended between the backup roller 130 and the heating roller 140.

The drive roller for rotating the endless belt 110 and the respective rollers may be any of rollers other than the oil roller 150. In the embodiment, the pressure roller 120 is used as the drive roller.

The pressure roller 120 is driven to rotate in the direction of an arrow (i.e., a counterclockwise direction) in FIG. 2 by a drive mechanism, not shown, (drive gear 260 in FIG. 18) provided in the main body of the image forming apparatus, and the backup roller 130, the endless belt 110, the heating roller 140 and the oil roller 150 rotate in a follower manner. Specifically, the endless belt 110 and the backup roller 130 are pressed against the pressure roller 120, and the endless belt 110 and the backup roller 130 follow in rotation the pressure roller 120. The endless belt 110 is wound on the heating roller 140, and the heating roller 140 follows in rotation the endless belt 110. The oil roller 150 is pressed against the endless belt 110, and the oil roller 150 follows in rotation the endless belt 110.

The endless belt 110 is formed such that a surface layer (for example, a silicone rubber layer), which exhibits good release characteristics from recording media and toner, is formed over a surface of a belt base of a thin member of metal (such as nickel) In FIG. 2, reference numeral 112 is a thermistor for sensing a temperature on a surface portion of the endless belt 110 where the belt is put on the backup roller 130. The thermistor 112 is located upstream of a press contact portion (fixing nip) N between the endless belt 110 and the pressure roller 120.

The backup roller 130 is formed with a core member 131 of metal and a relatively thin, elastic layer 132 layered over the surface of the core member 131. The backup roller 130 is supported by a shaft 131*a* of the core member 131 while being rotatable with respect to a side plate 101 of the frame of the fixing device 100. The elastic layer 132 is preferably formed of a layer of silicone rubber, about 7 mm thick, and a low friction layer layered on the silicone rubber layer. The low friction layer may be formed by covering the elastic layer 132 with a PFA tube.

The heating roller 140, shaped like a pipe, is made of a material having a good thermal conductivity (for example, aluminum). It contains a heating member 141 as a heat source disposed therein.

As shown in FIG. 3, in the embodiment, a length H (heating width measured in the widthwise direction of the endless belt 110) of a heating portion 141*a* of the heating member 141 is shorter than a width O of oil application formed by the oil roller 150. Also, in the embodiment, a heat distribution when viewed in the heating width direction (widthwise direction of the endless belt 110) is profiled such that a temperature in each end portion H2 of the endless belt 110 is lower than that in a central portion H1 thereof. To obtain such a profile of the heat distribution, in a case where the heating member 141 is formed of a spiral nichrome wire, a winding density of the nichrome wire in the central portion H1 is higher than in each end portion H2.

The heating member 141 may be a halogen lamp. In other embodiments than the present embodiment, the heating member 141 may have a uniform heat distribution over the heating width H.

The heating roller 140 is capable of rapidly heating the endless belt 110 at a position where it is put on the endless belt 110. In the embodiment, the heating roller 140 is constructed as a tension roller, and is urged in a straining direction (direction of an arrow F in FIG. 3) of the endless belt 110 by an appropriate urging mechanism (144, see FIG. 7). In FIG. 3, reference numerals 142 and 142 indicate flange portions or bearing members to which the urging mechanism is coupled. In FIG. 2, reference numeral 143 represents a thermistor for sensing a temperature of the heating roller 140.

The pressure roller 120 is formed of a pipe-like core member 121 having a good thermal conductivity, a relatively thin, elastic layer 122 which is formed on the core member 121 and is harder than the elastic layer 132 of the backup roller 130, and a surface layer 122*a* which is formed on a surface of the elastic layer 122 and well separable from the recording media and toner. A halogen lamp 123 as a heat source is disposed within the core member 121. The halogen lamp 123 serves as an auxiliary heating mechanism.

The pressure roller 120 is rotatably supported by a frame side plate 101 of the fixing device 100, and it is rotated in the direction of an arrow in FIG. 2 by a drive mechanism provided on the main body of the image forming apparatus. The pressure roller is mounted non-movable in the radial direction. It is pressed against the backup roller 130 by the utilization of elastic forces of the elastic layer 122 and the elastic layer 132 of the backup roller 130, with the endless belt 110 being interposed therebetween. The elastic layer 132 of the backup roller 130 is thicker and softer than the elastic layer 122 of the pressure roller 120. Therefore, the fixing nip N is deflected in a convex manner toward the backup roller 130. In FIG. 2, reference numeral 124 designates a thermistor for sensing a surface temperature of the pressure roller 120.

The oil roller 150 includes a shaft 151 and a thick, oil holder layer 152 fastened around the shaft 151. The oil holder layer 152 is made of porous material or fibrous material. The oil holder layer 152 is impregnated with release oil. In order to adjust an oil application amount or secure a uniform application of oil, the surface of the oil holder layer 152 is coated with a thin film sheet having an oil permeability, such as a porous PTFE sheet 153. A hardness of the oil roller 150 is preferably JIS-A30° or smaller, more preferably JIS-A20° or smaller.

The oil roller 150 is pressed against the endless belt 110 by an appropriate urging mechanism (for example, 155 in FIG. 7), and it is rotated in a follower manner to apply release oil, such as silicone oil, onto the surface of the endless belt 110. In FIG. 2, reference numeral 154 designates a cleaning member made of felt or the like, for cleaning the surface of the oil roller 150. The cleaning member 154 is pressed against the surface of the oil roller 150.

A frame 101 includes a guide 102 for guiding a recording medium S having a toner image formed (transferred) thereon at the secondary transfer portion T2 (see FIG. 1) into a press contact portion (nip) N between the endless belt 110 and the pressure roller 120. An air hole is formed in a guide 102. The transporting of the recording medium S is stabilized by a suction fan (102' in FIG. 15), with provision of the air hole of the guide 102. A guide 104 and a sheet-discharge roller pair 103 are provided downstream of the press contact portion N. The guide 104 guides the recording medium S of which the toner image has been fixed, to the sheet discharge path 60. The respective thermistors are connected to the control unit (not shown). The control unit controls a value of current fed to each of the heat sources 123 and 141 in accordance with a temperature sensed by the related thermistor.

Next, dimensions of the endless belt 110 and the respective rollers will be described with reference to FIG. 3.

B indicates a belt width of the endless belt 110.

H indicates a length of a heating portion of the heating member 141 as a heat source of the heating roller 140.

O represents a length of the oil holder layer 152 of the oil roller 150, viz., an oil application width.

P represents a maximum passing width of the recording medium S which may be supplied for theimage formation. The image forming apparatus of this embodiment allows a recording medium of the A3 size as a maximum size to pass therethrough in a vertical orientation. Therefore, the maximum passing width P of the recording medium S is a length of the short side of the A3 size recording medium (=a length of the longitudinal side of the recording medium of the A4 size).

I indicates a maximum image-forming width within which an image may be formed on the recording medium.

As seen from the above description, in the embodiment, the oil application width O of the oil application mechanism (oil roller) 150 is shorter than the width B of the endless belt 110 (B>O).

The oil application width O is set to be shorter than the maximum passing width P of the recording medium S that may be supplied for the image formation (P>O). Further, it is set to be longer than the maximum image-forming width I within which an image may be formed on the recording medium S (O>I). Hence, B>P>O>I. This relationship will yield advantages even when the heat distribution is uniform over the heating width H.

As described above, a length (heating width measured along the width wise direction of the endless belt 11) H of the heating portion 141*a* of the heating member 141 is shorter than the oil application width O of the oil roller 150 (O>H). A heat distribution along the heating width direction (widthwise direction of the endless belt 110) is profiled such that a temperature in each end portion H2 of the endless belt 110 is lower than that in a central portion H1 thereof.

Hence, B>P>O>H>I.

The fixing device thus constructed operates in the following way and has the following advantageous effects.

(101) A toner image is formed on a recording medium S, and the recording medium S having the toner image thereon passes through the press contact portion N of the fixing device 100, which includes the endless belt 110 heated by the heating roller 140 as the heating mechanism, the pressure roller 120 as a rotary member on which the endless belt 110 is pressingly put, and the backup roller 130 as a backup member for supporting the endless belt 110 on the inner side thereof at the press contact portion N between them. When passing through the press contact portion N, the toner image is heated and fused to be fixed on the recording medium S. The fixing device 100 is provided with the oil roller 150 as the oil application mechanism for applying release oil on the surface of the endless belt 110. With this, an offset phenomenon hardly occurs.

(102) The oil application width O of the oil application mechanism 150 is shorter than the belt width B of the endless belt 110. Therefore, the end portions of the surface of the endless belt 110 contains area portions not coated with oil (in the embodiment, the area portions B1 in FIG. 3). The portions B1 serves as portions to block the spreading of the oil. Therefore, the oil that has been applied onto the top side of the endless belt 110 is prevented from flowing to the back side of the belt (at least the applied oil flowing to the back side of the belt is remarkably reduced in amount.).

For this reason, according to the embodiment, not only in a case where the endless belt 110 is driven by the drive roller disposed on the inner side of the belt (for example, when the backup roller 130 is used as a drive roller), but also in a case where it is drive by a drive roller located outside the belt (for example, when the pressure roller 120 is used as the drive roller), the endless belt is stably driven because of the presence of the area portions not coated with oil, and as a result, a fixing operation is also stable.

(103) The heating width H of the heating roller 140, which is measured along the widthwise direction of the endless belt 110, is shorter than the oil application width O of the oil roller 150. Further, the heat distribution along the heating width direction of the heating roller 140 is profiled such that a temperature in each end portion of the endless belt 110 is lower than that in the central portion of the endless belt 110. Therefore, the oil roller 150 is heated to a relatively high temperature in the central portion H1 of the endless belt 110, and it is heated to a relatively low temperature in the end portions H2 thereof.

For this reason, a relatively large amount of oil is applied to the central portion Hi of the endless belt 110, but a relatively small amount of oil is applied to the end portions H2 of the belt.

Therefore, an area portion coated with a small amount of oil is present in each of the end portions H2 on the surface of the endless belt 110. Those area portions function to block the spreading of a relatively large amount of oil applied to the central portion H1. Therefore, the oil applied to the top surface of the endless belt 110 is prevented from flowing to the back side of the endless belt 110 (at least the oil flowing to the back side of the belt is remarkably reduced in amount.).

Therefore, in the embodiment, not only in a case where the endless belt 110 is driven by the drive roller disposed on the inner side the belt (for example, the backup roller 130 is used as a drive roller), but also in a case where it is drive by a drive roller located outside the belt (for example, the pressure roller 120 is used as the drive roller), the endless belt is stably driven and as a result, a stable fixing operation is secured.

(104) Since the oil application width O is shorter than the maximum passing width P of the recording medium S that may be supplied for image formation, the embodiment has the following advantageous effects in addition the advantageous effects of items (101), (102) and (103) described above.

When a recording medium S that may be supplied for the image formation is a recording medium of the maximum passing width P, the oil applied by the oil roller 150 is mostly absorbed by or transferred to the recording medium S. Accordingly, the amount of the oil left on the endless belt 110 (particularly in its end portions) after the recording medium runs past is zero or extremely small. Recording media of various sizes are supplied for the image formation. Accordingly, there is a case where a recording medium having a passing width shorter than the oil application width O (for example, a recording medium S1 having a smaller passing width P1 shorter than the oil application width O shown in FIG. 3 (e.g., a recording medium of B5 size placed in a vertical orientation)) is supplied for the image formation, and oil is accumulated in area potions (indicated by A in FIG. 3) on the endless belt. In this case, when a recording medium S of the maximum passing width P is then supplied for the image formation and passes through the fixing device 100, the oil accumulated in the area portions A is mostly absorbed by or transferred to the recording medium of the maximum passing width. Therefore, the oil that is accumulated on the endless belt 110 (particularly on its side end potions) after the recording medium runs past is also reduced to zero or remarkably reduced in amount.

Therefore, the area portions B1 coated with a little (or no) oil on the end portions (or edges) of the surface of the endless belt 110 is satisfactorily secured, and therefore, the oil applied to the top side or surface of the endless belt 110 is prevented from flowing to the back surface thereof.

Accordingly, in the embodiment, a further stable fixing operation is ensured.

(105) In the embodiment, the oil application width O is longer than the maximum image-forming width I on the recording medium S. In other words, the maximum image-forming width I is shorter than the oil application width 0. Therefore, an offset phenomenon is prevented with certainty and a beautiful image can be reproduced.

(106) Also in the embodiment, the oil application width O is shorter than the maximum passing width P of the recording medium S that may be supplied for the image formation, and it is longer than the maximum image-forming width I within which an image may be formed on the recording medium S. Therefore, the embodiment has the advantageous effects of (104) and (105) above.

Thus, according to this embodiment, a more stable fixing operation is performed, the offset phenomenon is reliably prevented, and a beautiful image is reproduced.

(107) As recalled, the image forming apparatus of FIG. 1 is capable of forming toner images on both sides of the recording mediums. Therefore, sometimes, a recording medium S having toner images formed on both sides thereof passes through the press contact portion N of the fixing device 100.

The toner present on the recording medium S hinders the absorption of oil by the recording medium S. Accordingly, where toner images are formed on both sides of the recording medium S, oil is less absorbed by the recording medium S when comparing with a case where a toner image is formed on only one side of the recording medium S. In the case of the recording medium S having toner images on both sides thereof, an amount of oil flowing to the back side of the belt is large in the conventional fixing device, and hence the above-mentioned slip will occur easily.

On the other hand, in the embodiment, the oil application width O of the oil application mechanism is shorter than the belt width B of the endless belt 110. Therefore, even in the case of the recording medium S having toner images on both sides thereof, a stable fixing operation is secured.

(108) The embodiment is designed so as to satisfy at least the following two conditions: 1) the heating width H of the heating roller 140, which is measured along the widthwise direction of the endless belt 110, is shorter than the oil application width O of the oil roller 150, and 2) the heat distribution along the heating width direction of the heating roller 140 is profiled such that a temperature in each end portion H2 of the endless belt 110 is lower than that in the central portion H1 of the endless belt 110. Therefore, even when toner images are formed on both sides of the recording medium S, a stable fixing operation is secured.

(109) The FIG. 1 image forming apparatus is capable of forming a full color image by superimposing toner of a plurality of different colors. Therefore, there is a case that a recording medium S having a full color image formed on one side thereof passes the press contact portion N of the fixing device 100.

As described above, toner present on the recording medium S hinders the absorption of oil by the recording medium S. Therefore, in a case where a full color image that results from the superimposing of toner of a plurality of different colors is formed on the recording medium S, the recording medium S less absorbs the oil than in a case where only the monochromatic image is formed on the recording medium. In the case of the recording medium S having the full color image by superimposing toner a plurality of colors, an amount of oil flowing to the back side of the belt is large in the conventional fixing device, and hence, a possibility that the above-mentioned slip will occur more easily is increased.

On the other hand, the oil application width O of the oil application mechanism is shorter than the belt width B of the endless belt 110. Therefore, even where a full color image is formed by superimposing toner of a plurality of colors, a stable fixing operation is secured.

(110) The embodiment is designed so as to satisfy at least the following two conditions: 1) the heating width H of the heating roller 140, which is measured along the widthwise direction of the endless belt 110, is shorter than the oil application width O of the oil roller 150, and 2) the heat distribution along the heating width direction of the heating roller 140 is profiled such that a temperature in each end portion H2 of the endless belt 110 is lower than that in the central portion H1 of the endless belt 110. Therefore, even when a full color image is formed by superimposing a plurality of colors, a stable fixing operation is secured.

This embodiment is capable of forming a stable full color image, and further forming (fixing) stable full color images on both sides of a recording medium S.

The first embodiment has the features and advantages as mentioned above, and additionally those which will be described in items 401 to 405, 407, 408, 411, 414 and 418.

In the first embodiment, an oil absorbing member for absorbing oil may be provided. For a mechanical arrangement preferred in providing the oil absorbing member, reference is made to a second embodiment and its modifications.

A blade for gathering oil may be additionally provided in the first embodiment. An arrangement preferred for the provision a of the gathering blade, reference is made to a third embodiment.

The first embodiment makes use of part of a layout of the backup roller, the pressure roller and the heating roller which is used in a fourth embodiment and its modification 1. However, it is understood that the roller layout of the first embodiment is not limited to the described one but any other suitable roller layout may be used for the first embodiment. For a preferred layout and construction of the oil roller, reference is made to the fourth embodiment and its modifications 1 and 2.

In the first embodiment, the backup roller maybe urged toward the pressure roller, and it may be fixed in a radial direction. For a preferred mechanical arrangement preferred in fixing a axis-to-axis distance between the backup roller and the pressure roller, reference is made to a fifth embodiment and its modifications 1 and 2.

Figure 21:
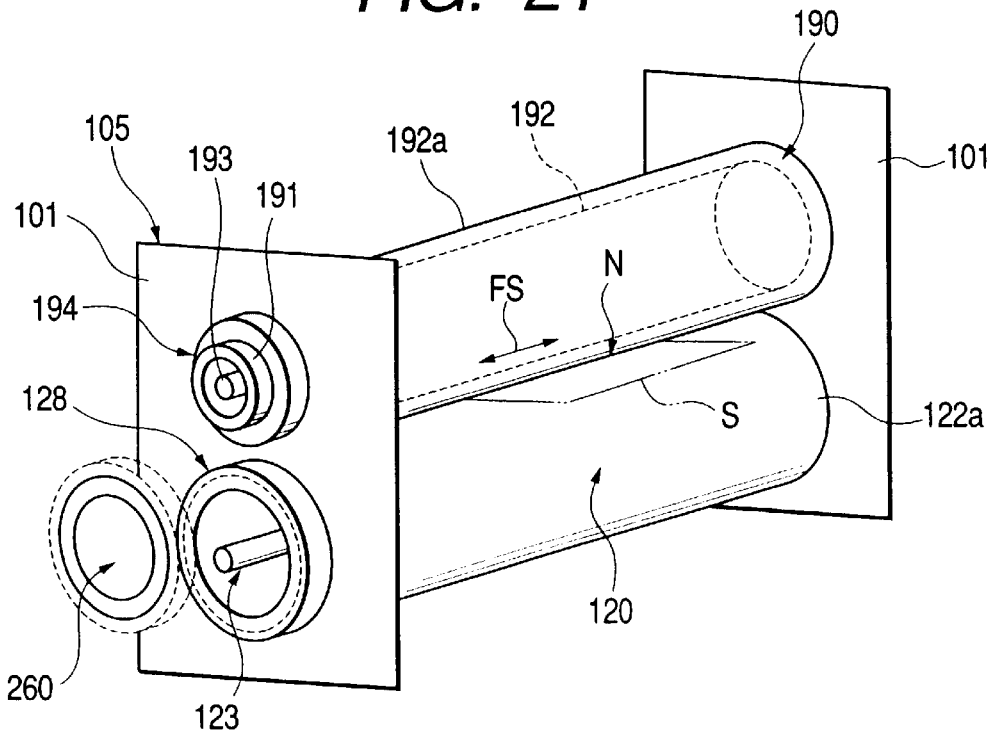
FIG. 21 schematically shows a third modification of the fifth embodiment.

The first embodiment has been described with reference to the fixing device of a type in which an endless belt is utilized. The features of the first embodiment maybe applied to the fixing device of another type in which a pressure roller and a fixing roller are contacted with each other to form a nip as shown in FIG. 21. That is, the oil application mechanism may apply oil onto a fixing roller 190, and in this case a dimensional relationship between the oil application mechanism 150 and the endless belt 110 as explained with reference to the first embodiment may be applied to a dimensional relationship between the oil application mechanism and the fixing roller 190. Further, the features of the heat application mechanism 141 as explained with reference to the first embodiment may be applied to a heating mechanism 193 and/or an auxiliary heating mechanism 123 of the fixing device shown in FIG. 21.

<Second Embodiment>

Figure 4:
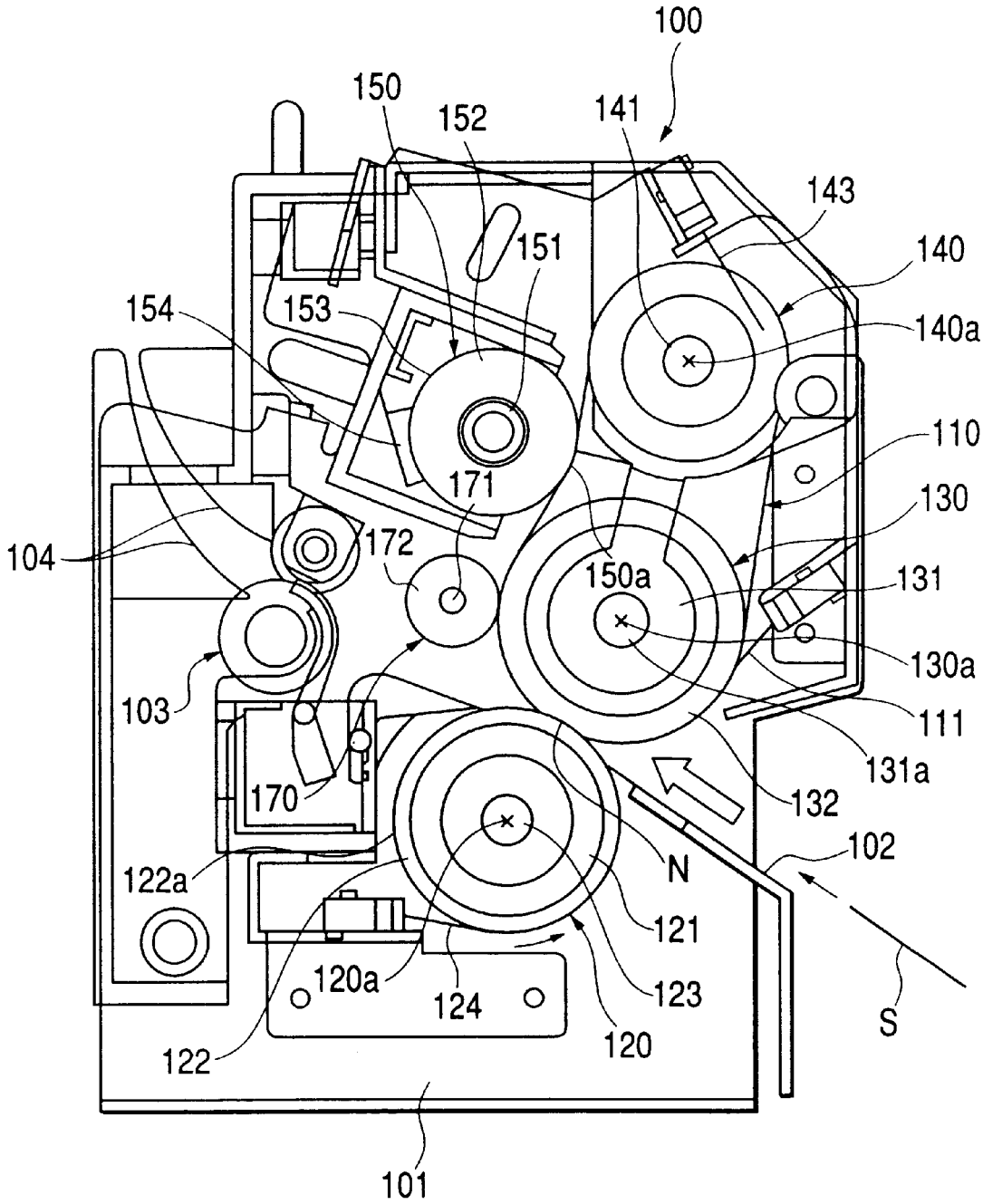
FIG. 4 schematically shows a major portion of a fixing device which constitutes a second embodiment of the present invention.
Figure 5:
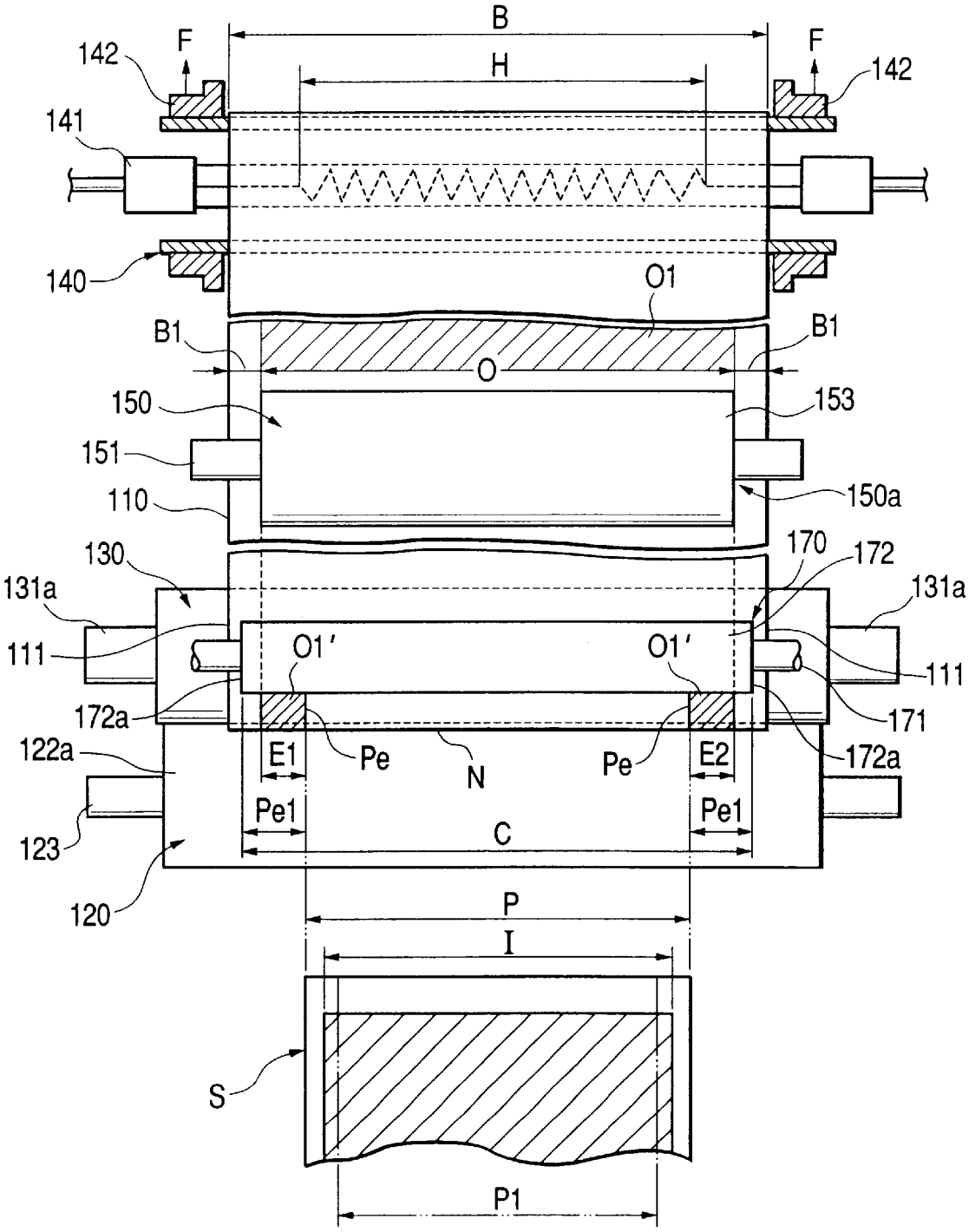
FIG. 5 schematically shows the fixing device shown in FIG. 4.

FIG. 4 is a view schematically showing a major portion of a fixing device 100 which constitutes a second embodiment of the present invention. FIG. 5 is a side view showing a major portion of the fixing device. One of the key features of the second embodiment resides in provision of an oil absorbing member. In FIGS. 4 and 5, like or equivalent portions are designated by like reference numerals in FIGS. 1 to 3.

A fixing device 100 includes an endless belt 110, an pressure roller 120 as a rotary member to be brought into pressing contact with the endless belt 110, a backup roller 130 as a backup member for supporting the endless belt 110 on the inner side thereof at the press contact portion N, a heating roller 140 for heating the endless belt, an oil roller 150 as an oil application mechanism for application the surface of the endless belt 110 with release oil, and an oil absorbing roller 170 as an oil absorbing member. The endless belt 110 extends around the backup roller 130 and the heating roller 140.

The drive roller for rotating the endless belt 110 and the respective rollers may be any of rollers other than the oil roller 150 and the oil absorbing roller 170. In the embodiment, the pressure roller 120 is used as the drive roller.

Since the oil absorbing roller 170 is pressed against the endless belt 110, the oil absorbing roller 170 follows the endless belt 110 in rotation.

The oil absorbing roller 170 is located downstream of the press contact portion N as viewed in the circulating direction of the endless belt 110 of which the surface is coated with release oil, but upstream of the oil application position 150a by the oil roller 150.

The oil absorbing roller 170 includes an oil absorbing layer 172 which is fastened around a shaft 171. The oil absorbing layer 172 is made of porous material or fibrous material (for example, felt), which is excellent in release oil absorption.

The oil absorbing roller 170 is pressed against the endless belt 110 by an appropriate urging mechanism (175 in FIG. 7), and rotates in a follower manner to absorb release oil adhering to the surface of the endless belt 110.

This oil absorbing roller 170 is brought into contact with the endless belt 110 at a position where the endless belt 110 is put on the backup roller 130. Specifically, the oil absorbing roller 170 is pressed against the backup roller 130 with the endless belt 110 being interposed therebetween, by an urging mechanism.

In this embodiment, a halogen lamp is used as a heating member 141, and a heat distribution of it is substantially uniform over the heating width H.

Next, dimensions of the endless belt 110, the respective rollers and the like will be described with reference to FIG. 5.

C indicates a length of an oil absorbing layer 172 of the oil absorbing roller 170, viz., an oil absorbing width.

As seen from FIG. 5, in the second embodiment, the length C of the oil absorbing roller 170 is set to be longer than a maximum passing width P of a recording medium that may be supplied for the image formation (C>P). Accordingly, the oil absorbing roller 170 comes in contact with the endless belt 110 at least 1) at end portions Pe of a passing area of a recording medium S of which the passing width (=maximum passing width P) is the largest of those recording media that may be supplied for the image formation, and 2) at portions of the belt corresponding to portions Pe1 respectively extended outward beyond the end portions Pe when viewed in the widthwise direction, whereby it absorbs the oil.

The length C of the oil absorbing layer 172 of the oil absorbing roller 170 is shorter than the belt width B of the endless belt 110 (B>C). Therefore, both side end portions 172*a* of the oil absorbing layer 172 as an oil absorbing member as viewed in the widthwise direction of the endless belt 110, respectively, are located within the side edges 111.

The length dimensions may be summarized as B>C>O>I. Where the oil absorbing roller 170 is provided, C>P suffices for the maximum passing width P of the recording medium. Hence, P>O>I or O>P>I will do.

The thus constructed fixing device has the following useful results.

(201) Further, for the endless belt 110 of which the surface is coated with release oil, the oil absorbing roller 170 for absorbing the oil on the surface of the endless belt 110 is provided at a position located downstream of the fixing nip N but upstream of the oil application position 150*a* of the oil application roller 150 as viewed in the circulating direction o the endless belt 110. With provision of the oil absorbing roller 170, even if, after passing the fixing nip N, the oil adheres to the surface of the endless belt 110 at a position located downs stream of the fixing nip N, it is absorbed by the oil absorbing roller 170 at a position located upstream of the oil application position 150*a*.

Therefore, the oil is prevented from being accumulated on the endless belt 110 and flowing onto the back side of the endless belt 110 (at least the amount of oil flowing onto the back side of the endless belt is considerably reduced). Further, occurrence of a slip of the endless belt 110 relative to the rollers and the recording medium can be prevented since no oil is accumulated on the endless belt.

More specifically, area portions E1 and E2 in FIG. 5 indicate area portions of oil 01' adhering thereto. That is, oil 01 of the oil application width O applied by the oil application mechanism 150 reaches the press contact portion N. Its central portion is absorbed by the recording medium S, and remains on and adheres, as surplus oil 01', to the surface of the endless belt 110 at a region located downstream of the press contact portion N.

Even if the oil 01', having passed the press contact portion N adheres to the surface of the endless belt 110 at a location downstream of the press contact portion N, the oil 01' is absorbed by the oil absorbing roller 170 located upstream of the oil application position 150*a*.

There is a little chance that oil is accumulated on the endless belt 110 (oil 01 is additionally applied to surplus oil) and as a result, it flows onto the back side of the endless belt 110 (at least the amount of oil flowing onto the back side of the endless belt is considerably reduced) Further, occurrence of a slip of the endless belt 110 relative to the rollers and the recording medium can be prevented.

For this reason, in the embodiment, when the endless belt 110 is driven by the drive roller disposed on the inner side the belt (for example, when the backup roller 130 is used as a drive roller), it is natural that the endless belt is stably driven and as a result, a stable fixing operation is secured. The same thing is true also when it is drive by a drive roller located outside the belt (for example, the pressure roller 120 is used as the drive roller).

(202) The oil absorbing roller 170 is brought into contact with the endless belt 110 at a position where the endless belt 110 is put on the roller. Because of this, the oil absorbing roller 170 is reliably brought into contact with the endless belt 110. Therefore, the oil absorbing is ensured on the endless belt 110.

(203) Since the width C of the oil absorbing roller 170 when viewed in the widthwise direction of the endless belt 110 is selected to be larger than the maximum passing width P of the recording medium that may be supplied for the image formation, oil (e.g., surplus oil 01') that was not recorded on or not transferred to the recording medium S is absorbed by the oil absorbing roller 170, without fail.

Therefore, a more stable fixing operation is ensured.

(204) The oil absorbing member is formed with the oil absorbing roller 170 which absorbs oil while being in contact with the endless belt 110 and rotating in a follower manner. Therefore, a chance of damaging the endless belt 110 is lessened and a wear of the same is reduced.

(205) Both the side end portions 172*a* of the oil absorbing roller 170 as viewed in the widthwise direction of the endless belt 110, respectively, are located within the side edges 111. Even if oil which has been once absorbed by the oil absorbing roller 170 leaks for some reason or other, there is less chance that the leaking oil flows to the back side of the endless belt 110 (at least the amount of the leaking oil is remarkably reduced)

Accordingly, a more stable fixing operation is ensured.

In association with the endless belt 110 of which the surface is coated with release oil, the oil absorbing roller 170 for absorbing oil on the surface of the endless belt 110 is provided downstream of the press contact portion N in the circulating direction of the endless belt but upstream of the oil application position 150*a* by the base oil application mechanism. Provision of such an oil absorbing roller is effective in preventing the oil flowing to the back side of the endless belt 110 and the relative slip of the endless belt to the rollers and the recording medium.

The second embodiment has the features and advantages already described in items 101, 102, 105, 107 and 109, and those which will be described in items 401 to 405, 407, 408, 411, 414 and 418.

In the second embodiment, an oil absorbing member may be provided downstream of the oil application mechanism. For a mechanical arrangement preferred in providing the oil absorbing member, reference is made to a modification 4 of the second embodiment.

A blade for gathering oil may be additionally provided in the second embodiment. For a mechanical arrangement preferred in providing the gathering blade, reference is made to a third embodiment.

The second embodiment makes use of part of a layout of the backup roller, the pressure roller and the heating roller which is used in a fourth embodiment and its modification 1. However, it is understood that the roller layout of the first embodiment is not limited to the described one but any other suitable roller layout may be used for the first embodiment. For a preferred layout and construction of the oil roller, reference is made to the fourth embodiment and its modifications 1 and 2.

In the second embodiment, the backup roller may be urged toward the pressure roller, and it may be fixed in a radial direction. For a preferred mechanical arrangement preferred in fixing a axis-to-axis distance between the backup roller and the pressure roller, reference is made to a fifth embodiment and its modifications 1 and 2.

<Modification 1>

Figure 6:
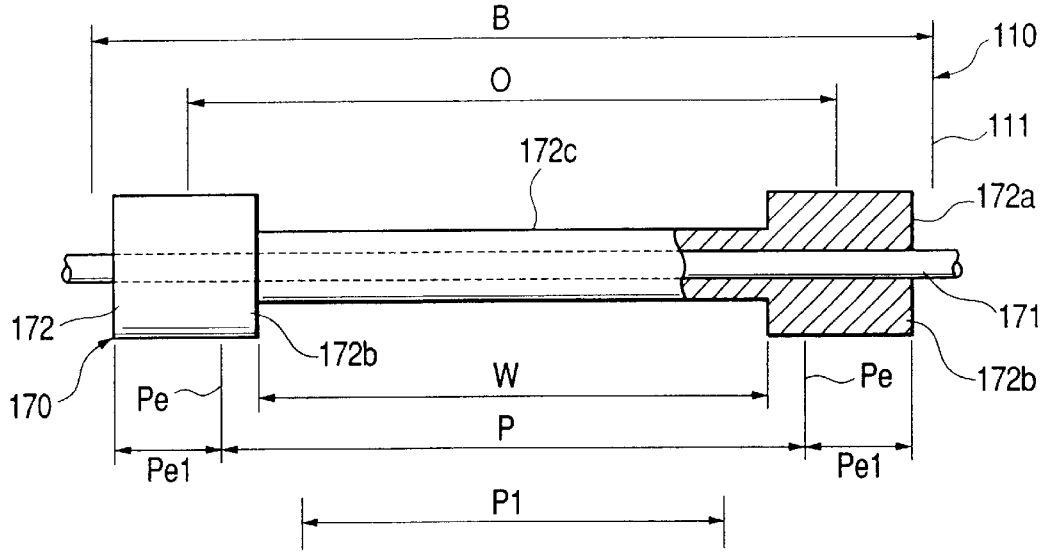
FIG. 6 schematically shows a first modification of the second embodiment.

FIG. 6 is a fragmentary sectional view showing a modification 1 of the second embodiment of a fixing device according to the present invention. In the figure, like or equivalent portions are designated by like reference numerals and characters in the figures referred to in the description of the first embodiment of the invention.

A difference of the modification 1 from the second embodiment resides in that the oil absorbing roller 170 as an oil absorbing member is different in configuration from the corresponding one in the second embodiment.

As shown in FIG. 6, a feature of the oil absorbing roller 170 resides in that it comes in contact with the endless belt 110 only 1) at end portions Pe of a passing area of a recording medium of which the passing width (=maximum passing width P) is the largest of those recording media that may be supplied for the image formation, and 2) at portions of the belt corresponding to portions Pe1 respectively extended outward beyond the end portions Pe when viewed in the widthwise direction, whereby it absorbs the oil.

To be more specific, the oil absorbing layer 172 of the oil absorbing roller 170 includes large diameter portions 172*b* and a small diameter portion 172*c* interconnecting those large diameter portions 172*b*. Only the large diameter portions 172*b* are brought into contact with the endless belt 110. When an amount of oil absorbed by the large diameter portions 172*b* reaches a predetermined level of amount, it creeps to the small diameter portion 172*c* and is held there.

Recording media of various sizes are supplied for the image formation. Accordingly, there is a case where a recording medium of which the passing width (P1 in FIGS. 6 and 5) is shorter than the width W between the large diameter portions 172*b* is supplied to the fixing device and oil remains in an area out of the passing width P1 but within the width W. In this case, when a recording medium S of the maximum passing width P is then supplied for the image formation and it passes through the fixing device 100, the residual oil is almost all absorbed by or transferred to the recording medium S.

(206) In the modification 1, the oil absorbing member comes in contact with the endless belt 110 only 1) at end portions Pe of a passing area of a recording medium of which the passing width (=maximum passing width P) is the largest of those recording media that maybe supplied for image formation thereon, and 2) at portions of the belt corresponding to portions Pe1 respectively extended outward beyond the end portions Pe when viewed in the widthwise direction, whereby it absorbs the oil.

The oil (e.g., surplus oil 01') that was not absorbed by or not transferred to the recording medium S having the maximum passing width P is effectively absorbed by the oil absorbing roller.

(207) In the modification, the oil absorbing roller 170 is not brought into contact with the endless belt 110 within the passing area of the recording medium having the maximum passing width P (=area within a distance W between the large diameter portions 172*b*). Therefore, a chance of damaging the endless belt 110 is lessened and a wear of the same is reduced.

The modification 1 of the second embodiment has advantageous effects similar to those of the second embodiment, and the advantageous effect of item (211) to be described later.

(1) The modification 1 of the second embodiment employs the oil absorbing roller 170 for the oil absorbing member located downstream of the press contact portion N but upstream of the oil roller 150. The oil absorbing member may be a pad-like member made of material excellent in oil absorption (see FIG. 9), such as felt.

(2) The provision of the small diameter portion 172*c* is not essential to the modification 1.

Figure 7:
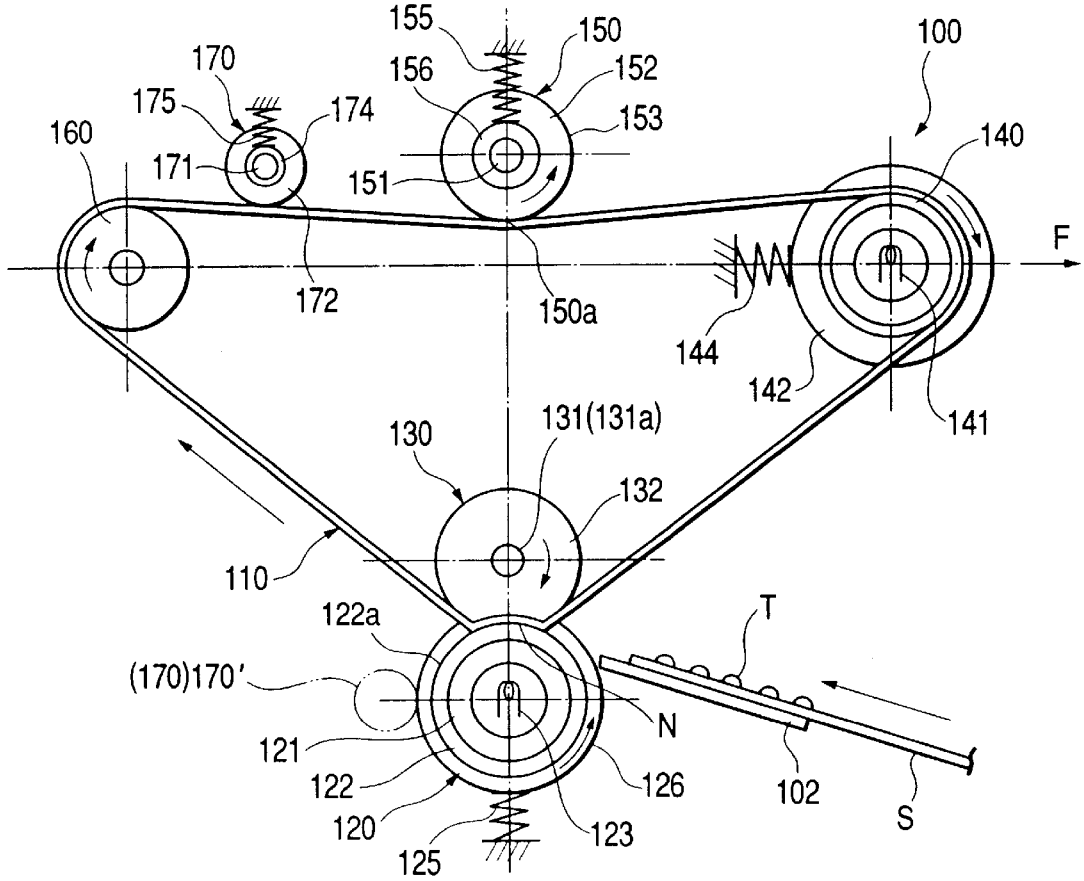
FIG. 7 schematically shows a second modification of the second embodiment.

(3) In the modification 1 of the second embodiment, the oil absorbing member 170, which is located downstream of the press contact portion N but upstream of the oil roller 150, may be brought into contact with the endless belt at a position other than the position where the belt is put on the roller (see FIG. 7).

(4) The oil absorbing member 170 may be brought into contact with the pressure roller 120, not the endless belt 110 (see FIG. 7). In this case, the roller may be used as a rotary member to be heated, in place of the endless belt 110 (see FIG. 21).

<Modification 2>

FIG. 7 is a diagram schematically showing a fixing device 100 which a second modification of the second embodiment. In the modification 2, the endless belt 110 extends around three end rollers 130, 160 and 140.

Any of the rollers 130, 160 and 140 may be used for a drive roller for rotating the endless belt 110 and those rollers. In the modification, the roller 160 is used for for the drive roller. The roller 130 is constructed as a backup roller as a backup member for supporting the endless belt 110 from the inner side thereof in order to form a press contact portion N between the endless belt 110 and the pressure roller 120. The roller 140 is constructed as a heating roller as a heating mechanism for heating the endless belt 110, and also as a tension roller for applying a tension to the endless belt 110.

The pressure roller 120 is urged to the backup roller 130 by means of an urging mechanism 125, through a bearing member 126 intervening therebetween. Accordingly, the pressure roller 120 is pressed against the backup roller 130 by means of the urging mechanism 125, in a state that the endless belt 110 is interposed between them.

The oil roller 150 rotates in a follower manner while being pressed against the endless belt 110 by means of an appropriate urging mechanism 155, with a bearing member 154 intervening therebetween, whereby it applies, for example, silicone oil tot he surface of the endless belt 110. The sheet supplying unit 50 is pressed against the endless belt 110 at a location between the drive roller 160 and the heating roller 140.

The oil absorbing roller 170 is located downstream of the press contact portion N as viewed in the rotational direction of the endless belt 110 of which the surface is coated with release oil, but upstream of the oil application position 150*a* by the oil roller 150.

The oil absorbing roller 170 is pressed against the endless belt 110 through an appropriate bearing member 174 by an appropriate urging mechanism 175, and rotates in a follower manner to absorb release oil adhering to the surface of the endless belt 110.

The oil absorbing member 170 is brought into contact with the endless belt at a position other than the position where the endless belt 110 is put on the roller, viz., between the drive roller 160 and the oil application mechanism 150 in this embodiment.

Figure 8:
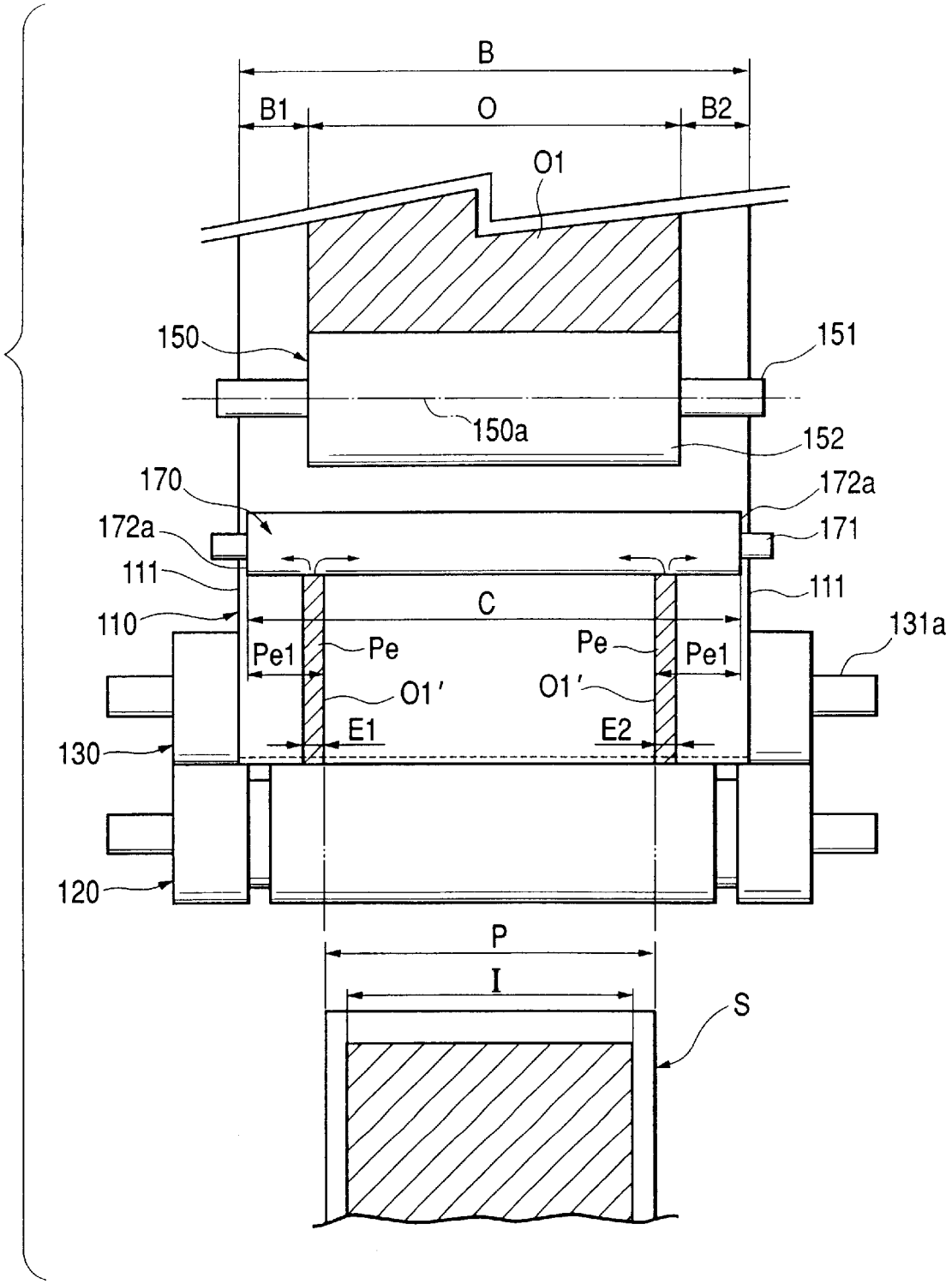
FIG. 8 schematically shows a third modification of the second embodiment.

FIG. 8 is a diagram showing dimensions of the endless belt 110 and the related rollers. As seen, the length dimensions of those components maybe summarized as: B>C>O>I. C>P suffices for the maximum passing width P of the recording medium. Hence, P>O>I or O>P>I will do.

(208) The modification 2 has the advantageous effects of a), b), e), g), i), k), m) to o) already described, and further the following advantageous effects. The oil absorbing member 170 is brought into contact with the endless belt 110 at a position other than the position where the endless belt is put on the roller upstream of the oil application position 150*a*, and over the entire oil application width O of the oil application mechanism 150. With the contact of them, a state of the endless belt 110 is stabilized at a position before it reaches the oil application position 150*a*, and creases that are likely to be formed on the endless belt 110 are lessened in their state. Therefore, a good oil application state is obtained.

The modification 2 has also the features and advantages already described in items 101, 102, 105, 107, 109, 201, 203, 204 and 205, and those which will be described in items 401 and 405.

In the modification 2, an oil absorbing member may be provided downstream of the oil application mechanism. For a mechanical arrangement preferred in providing the oil absorbing member, reference is made to a modification 4 of the fourth embodiment.

A blade for gathering oil may be additionally provided in the modification 2. A mechanical arrangement preferred in providing the gathering blade, reference is made to a third embodiment.

In the modification 2, the length of the oil application mechanism is shorter than the belt width. A mechanical arrangement and layout which are preferred in realizing such a dimensional relation, reference is made to a modification 2 of a fourth embodiment of the invention.

In the modification 2, the pressure roller is urged to the backup roller by means of the urging mechanism. Instead of this, a axis-to-axis distance between the backup roller and the pressure roller may be fixed. For a preferable mechanical arrangement for the fixing of the axis-to-axis distance, reference is made to a fifth embodiment and its modifications 1 and 2.

The features described with reference to FIGS. 14 and 15 may be applied to this modification 2.

<Modification 3>

A difference of a modification 3 of the second embodiment from the modification 2 is that as indicated by a phantom line 170' in FIG. 7, the oil absorbing roller 170 as an oil absorbing member is not associated with a rotary member (in this case, the endless belt 110) of which the surface is coated with release oil, but is associated with the pressure roller 120 as a rotary member (the other rotary member) of which the surface is not coated with release oil, and it absorbs oil transferred from the surface of the photosensitive member unit 10 onto the surface of the pressure roller 120.

In the thus constructed fixing device, oil applied on the surface of the endless belt 110 as the one of the rotary members is transferred onto the pressure roller 120 as the other rotary member. If no measure is taken, there is a chance that oil is accumulated on both end portions of both the rotary members (a real portions indicated by E1 and E2 in FIG. 8 and their near portions) where those members are not in contact with the recording medium S.

In the modification 3, the oil absorbing member 170' for absorbing the oil having been transferred from the endless belt 110 surface to the roller is provided in association with the pressure roller 120 of which the surface is not coated with release oil. Therefore, the oil on both the rotary members is absorbed by the oil absorbing member 170', with the pressure roller 120 intervening therebetween.

Therefore, there is no chance that oil is accumulated on the rotary members 110 and 120. The result is that a slip occurring relatively between the driving rotary member and the rotary member follower or between the rotary member and the recording medium is prevented and a stable fixing operation is ensured.

The modification 3 of the second embodiment has also advantageous effects similar to those of the modification 2.

(1) While the modification 3 employs the endless belt 110 for a first rotary member to be heated, a roller may be used for the same (see FIG. 21).

(2) While the modifications 2 and 3 each employ the oil absorbing roller 170 for an oil absorbing member, the oil absorbing member may be a pad-like member made of material excellent in oil absorption (see FIGS. 9 and 10), such as felt.

(3) In the modifications 2 and 3, the rollers shown in FIG. 6 may be used for the oil absorbing rollers 170 and 170'. In this case, the small diameter portion 172*c* is not essential.

<Modification 4>

Figure 9:
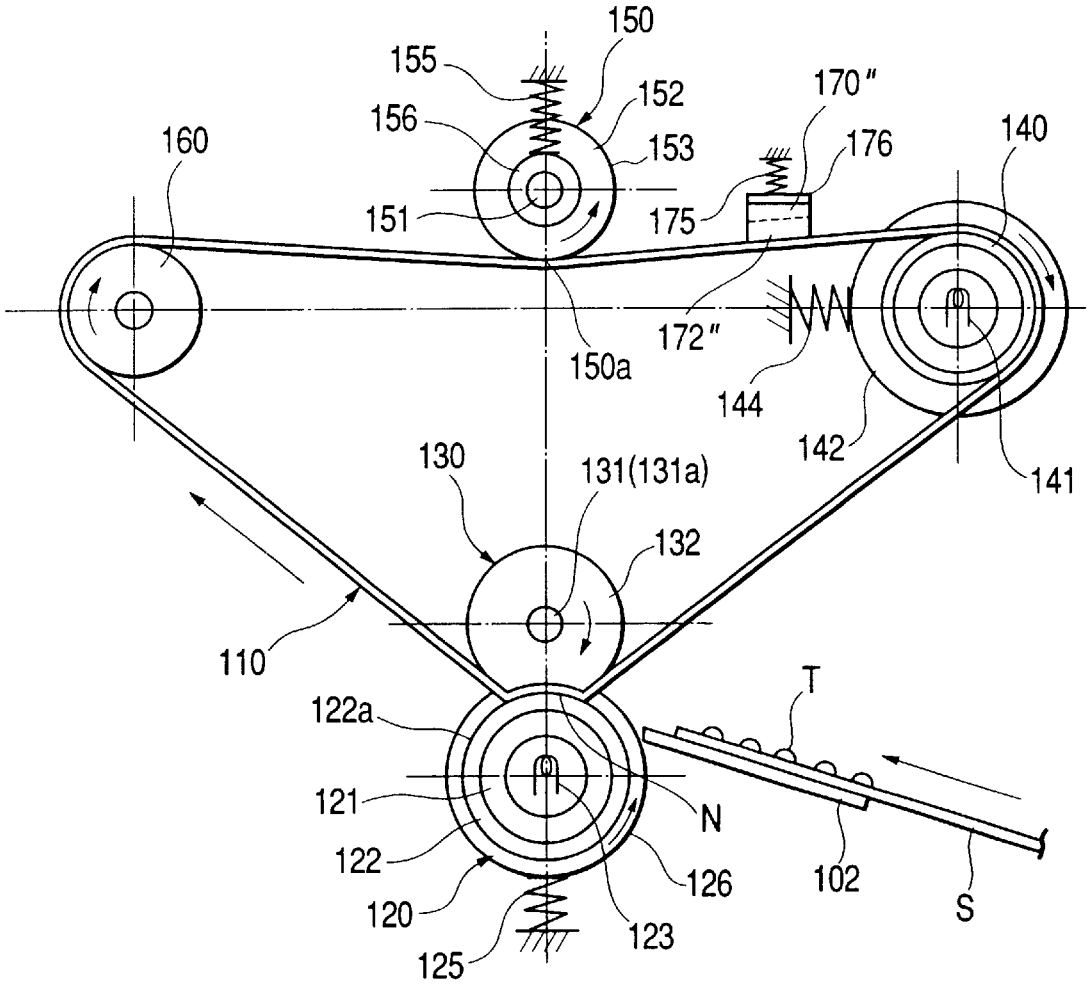
FIG. 9 schematically shows a fourth modification of the second embodiment.
Figure 10B:
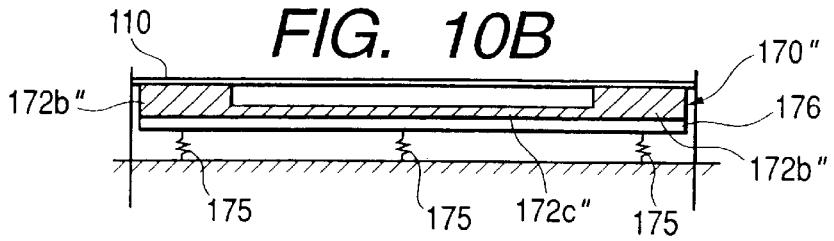
FIGS. 10A and 10B schematically show the fourth modification of the second embodiment.
Figure 10A:
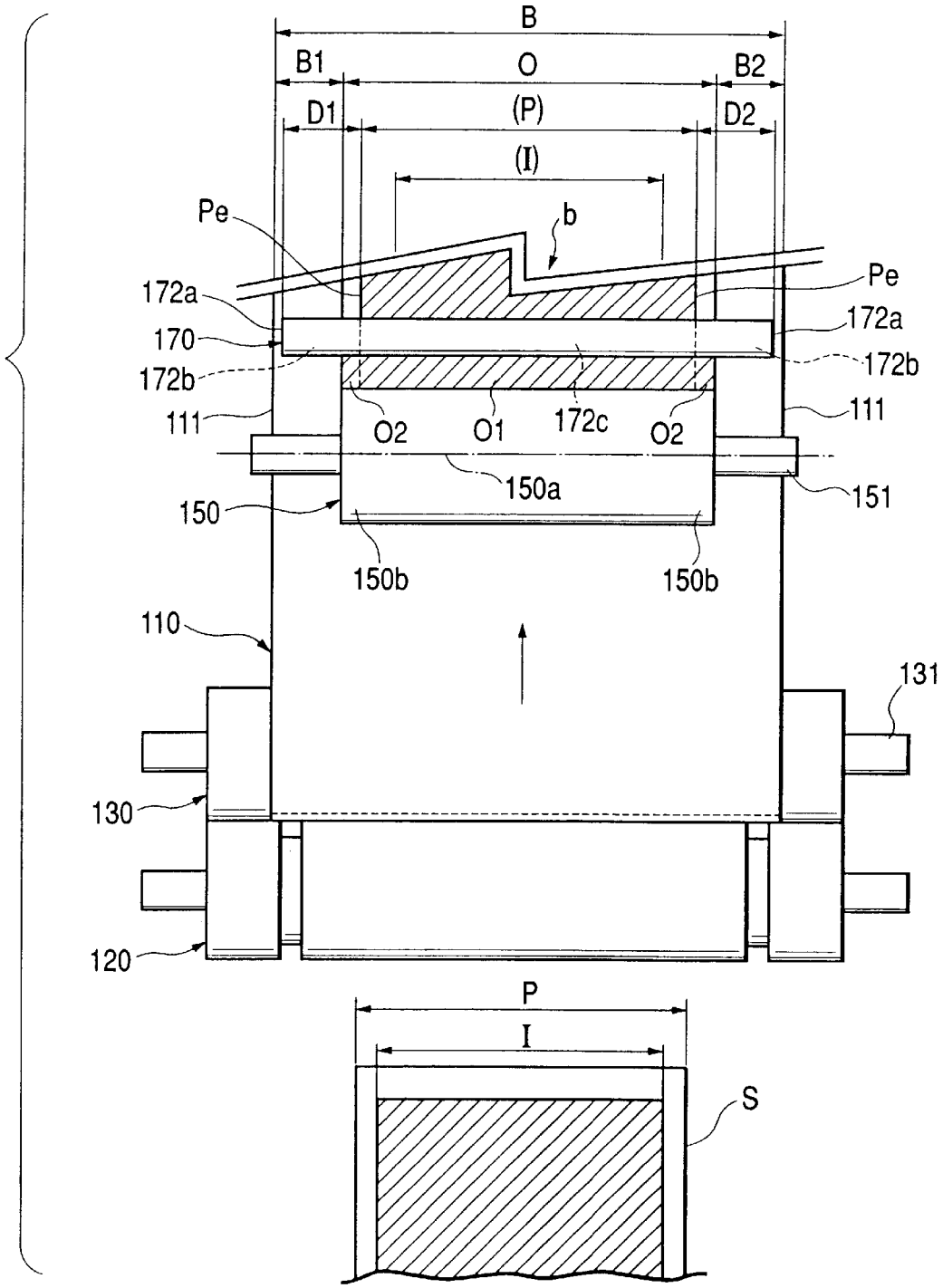

FIG. 9 is a diagram schematically showing a fixing device 100 which a modification 4 of the second embodiment. FIG. 10A is a development, partly omitted, showing a major portion of the fixing device. FIG. 10B is a sectional view of the fixing device when viewed in the direction of an arrow "b" in FIG. 10A.

In the modification 4, an oil absorbing pad 170" is used for the oil absorbing member 170.

The oil absorbing pad 170" is located downstream of the press contact portion N as viewed in the rotational direction of the endless belt 110 of which the surface is coated with release oil, but upstream of the oil application position 150*a* by the oil roller 150.

The oil absorbing pad 170" is formed with a support plate 176 and an oil absorbing layer 172" fastened onto the support plate 176. The oil absorbing layer 172" is made of porous material or fibrous material (for example, felt), which is excellent in release oil absorption.

The oil absorbing layer 172" includes a pair of contact portions 172*b*" which are brought into contact with endless belt 110 at portions thereof which are coated with oil by both ends 150*b* of the oil application roller 150, to thereby absorb the oil as part of oil 01 applied by the oil application roller 150, and an oil holder portion 172*c*", which interconnects the contact portions 172*b*", for holding the oil absorbed from those contact portions 172*b*" in a state that it is not brought into contact with the endless belt 110.

The oil absorbing pad 170" is brought into pressing contact with the endless belt 110 by an appropriate urging mechanism 175, with the support plate 176 intervening therebetween, and slidably contacts with the endless belt 110. The thus arranged oil absorbing pad 170" absorbs, by the contact portions 172*b*", only the oil O2 applied to the belt surface by the ends 150*b* of the oil application roller, which the oil is part of oil 01 applied by the oil application roller 150.

Dimensions of the endless belt 110, the oil absorbing roller 170 and the like will be described with reference to FIG. 10.

D1 and D2 indicate the lengths of the contact portions 172*b*" of the oil absorbing layer 172" of the oil absorbing pad 170", viz., oil absorbing widths.

As seen from the figure, the oil absorbing roller 170 comes in contact with the endless belt 110 at least at portions (a real portions D1 and D2) of the belt corresponding to portions respectively extended outward beyond the end portions Pe when viewed in the widthwise direction, whereby it absorbs the oil, the end portions Pe being those of a passing area of a recording medium S of which the passing width (=maximum passing width P) is the largest of those recording media that may be supplied for the image formation.

In the modification, the oil application width O of the oil application roller 150 is shorter than the belt width B of the endless belt 110. Both side edges 172*a*" of the oil absorbing pad 170" as viewed in the widthwise direction of the endless belt 110 are located within the side edges 111 of the endless belt 110.

A application width (=P in this modification) of a part of the oil 01 applied by the oil application roller 150, which is not absorbed by the oil absorbing roller 170, is selected to be longer than the maximum image-forming width I within which an image may be formed on the recording medium S.

The thus constructed modification 4 of the second embodiment has the following advantageous effects.

(209) In the modification 4, the oil absorbing pad 170" is provided, which is located downstream of the press contact portion N as viewed in the rotational direction of the endless belt 110 of which the surface is coated with release oil, but upstream of the oil application position 150*a* by the oil roller 150, and absorbs only the oil O2 applied to the belt surface by the ends 150*b* of the oil application roller, and forms part of oil 01 applied by the oil application roller 150. Therefore, of oil 01 applied by the oil application roller 150, the oil O2 applied to the belt surface by the ends 150*b* of the oil application roller is absorbed by the oil absorbing pad 170".

When a relatively large amount of oil is applied by the ends 150*b* of the oil application roller 150, the oil O2 is absorbed by the oil absorbing pad 170" before it reaches the press contact portion N. For this reason, in this modification, no oil is accumulated at the ends of the rotary member, while the oil accumulation there at is inevitable in the convention art.

The result is that a slip occurring relatively between the driving rotary member (in this case, endless belt 110) and the rotary member follower (in this case, the pressure roller 120) or between the rotary member and the recording medium S is prevented, and a stable fixing operation is ensured.

(210) The oil absorbing roller 170" comes in contact with the endless belt 110 at least at portions (a real portions D1 and D2) of the belt corresponding to portions respectively extended outward beyond the end portions Pe when viewed in the widthwise direction, whereby it absorbs the oil, the end portions Pe being those of a passing area of a recording medium S of which the passing width (=maximum passing width P) is the largest of those recording media that maybe supplied for the image formation. Therefore, the oil that is not absorbed by the recording medium S of he maximum passing width P or not transferred to the same in the fixing device not provided with the oil absorbing pad 170", is effectively absorbed before it reaches the press contact portion N.

Accordingly, the present modification can perform a fixing operation more stably.

Additionally, it is noted that the oil absorbing pad 170" is not in contact with the endless belt 110 in a zone within the passing area P of the recording medium S of the maximum passing width P (the zone=the entire range of the passing area P in this modification). Therefore, a chance of damaging the passing area P of the endless belt 110 is lessened and a wear of the same is reduced.

(211) The oil absorbing member 170" includes a pair of contact portions 172*b*" and an oil holder portion 172*c*", which interconnects the contact portions 172*b*". The contact portions 172*b*" are brought into contact with endless belt 110 at portions thereof which are coated with oil by both ends 150*b* of the oil application roller 150, to thereby absorb the oil O2 as part of oil 01 applied by the oil application roller 150. The oil holder portion 172*c*" holds the oil absorbed by the oil absorbing layer 172" in a state that it is not brought into contact with the endless belt 110. When an amount of oil absorbed by the contact portions 172*b*" increases to a predetermined level of amount, it moves from the contact portions 172*b*" to the oil holder portion 172*c*", and is held there.

Accordingly, the amount of oil that can be absorbed by the oil absorbing pad 170" is increased when comparing with the fixing device provided with only the oil absorbing layer 172".

(212) A application width (=P in this modification), viz., a width of oil entering the press contact portion N, of a part of the oil 01 applied by the oil application roller 150, which is not absorbed by the oil absorbing roller 170, is selected to be longer than the maximum image-forming width I within which an image may be formed on the recording medium. Therefore, an offset phenomenon is prevented without fail.

(213) As recalled, the image forming apparatus of FIG. 1 is capable of forming toner images on both sides of the recording medium S. Therefore, sometimes a recording medium S having toner images on both sides passes through the press contact portion N of the fixing device 100.

The toner present on the recording medium S hinders the absorption of oil by the recording medium S. Accordingly, where toner images are formed on both sides of the recording medium S, oil is less absorbed by the recording medium S when comparing with a case where a toner image is formed on only one side of the recording medium S. In the case of the recording medium S having toner images on both sides thereof, the above-mentioned slip is easier to occur in the conventional fixing device.

On the other hand, in this modification, at least the oil absorbing pad 170" is provided, which is located downstream of the press contact portion N as viewed in the rotational direction of the endless belt 110 of which the surface is coated with release oil, but upstream of the oil application position 150*a* by the oil roller 150, and absorbs only the oil O2 applied to the belt surface by the ends 150*b* of the oil application roller and is part of oil 01 applied by the oil application roller 150. Therefore, even in the case where the toner images are formed on both sides of the recording medium S, a stable fixing operation is ensured.

Thus, the fixing device is capable of forming (fixing) images on both sides of the recording medium S through a stable fixing operation.

(214) The FIG. 1 image forming apparatus is capable of form a full color image by superimposing toner of a plurality of different colors. Therefore, there is a case that a recording medium S having a full color image formed on one side thereof passes the press contact portion N of the fixing device 100.

As described above, toner present on the recording medium S hinders the absorption of oil by the recording medium S. Therefore, in a case where a full color image that results from the superimposing of toner of a plurality of different colors is formed on the recording medium S, the recording medium S less absorbs the oil than in a case where only the monochromatic image is formed on the recording medium. In the case of the recording medium S having the full color image by superimposing toner a plurality of colors, the above-mentioned slip will occur more easily.

On the other hand, in this modification, at least the oil absorbing pad 170" is provided, which is located downstream of the press contact portion N as viewed in the rotational direction of the endless belt 110 of which the surface is coated with release oil, but upstream of the oil application position 150*a* by the oil roller 150, and absorbs only the oil O2 applied to the belt surface by the ends 150*b* of the oil application roller and is part of oil 01 applied by the oil application roller 150. Therefore, even in the case where a full color image by superimposing toner of a plurality of colors is formed on the recording medium S, a stable fixing operation is ensured.

Thus, the fixing device is capable of forming a stable full color image, and further forming (fixing) full color images on both sides of the recording medium S through a stable fixing operation.

The modification 4 has also the features and advantages already described in items 101, 102, 207, and those which will be described in items 401 and 405.

In the modification 4, an oil absorbing member may be provided downstream of the oil application mechanism. For a mechanical arrangement preferred in providing the oil absorbing member, reference is made to a modification 2 of the fourth embodiment.

In the modification 4, the pressure roller is urged to the backup roller by means of the urging mechanism. Instead of this, a axis-to-axis distance between the backup roller and the pressure roller may be fixed. For a preferable mechanical arrangement for the fixing of the axis-to-axis distance, reference is made to the fifth embodiment and its modifications 1 and 2.

Figure 11:
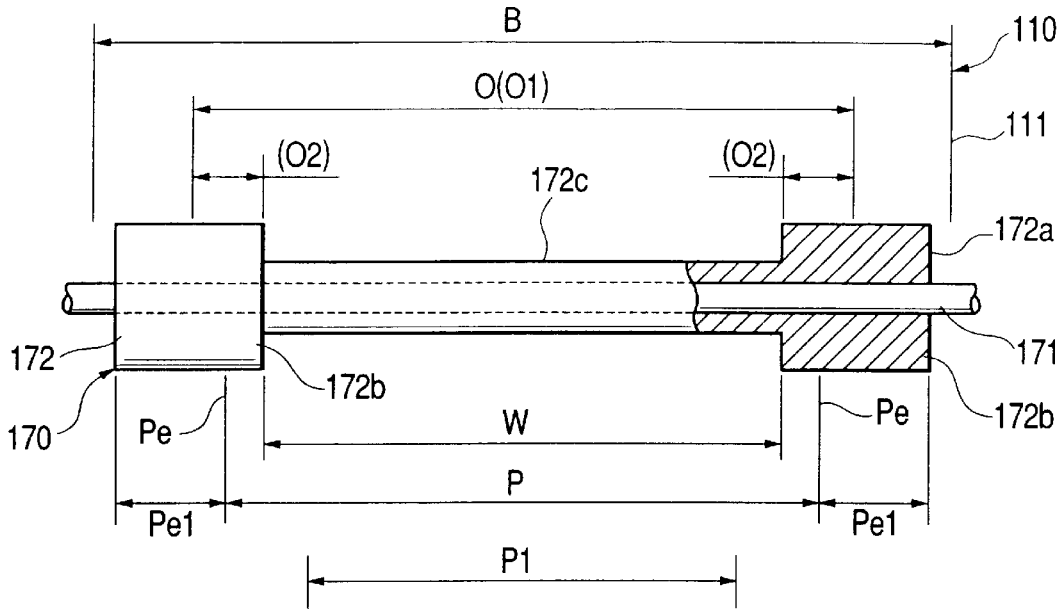
FIG. 11 schematically shows an oil absorbing roller.

(1) In the modification 4, an oil absorbing roller 170 shown in FIG. 11 (similar in construction to the corresponding one in FIG. 6) maybe used for the oil absorbing member 170. The oil absorbing layer 172 includes a pair of large diameter portions 172*b* and a small diameter portion 172*c*, which interconnects those large diameter portions 172*b*. The oil absorbing layer 172 is brought into contact with endless belt 110 at portions (O2) thereof which are coated with oil by both ends 150*b* of the oil application roller 150, to thereby absorb the oil as part of oil 01 applied by the oil application roller 150 (FIG. 3). The small diameter portion 172*c* holds the oil absorbed by the large diameter portions 172*b* in a state that it is not brought into contact with the endless belt 110.

The oil absorbing roller 170 absorbs only the oil (O2) coated by the ends 150*b* of the oil application roller 150, which is part of the oil (01) coated by the oil application roller 150, by use of the large diameter portions 172*b* in a state that the oil absorbing roller 170 is pressed against the endless belt 110 by an appropriate urging mechanism with its shaft 171 intervening therebetween, and rotates in a follower manner. When an amount of oil absorbed by the large diameter portions 172*b* reaches a predetermined level of amount, it creeps from the large diameter portions 172*b* to the small diameter portion 172*c*, and is held there.

The oil absorbing member 170 is formed with a roller which absorbs the oil in a state that it is pressed against the endless belt 110 and rotates in a follower manner. Therefore, a chance of damaging the endless belt 110 is lessened and a wear of the same is reduced.

(2) While in the modification 4, the endless belt 110 is used for a first rotary member to be heated, a roller may be used for the same (see FIG. 2A).

(3) In this modification 4, a blade mechanism which will be described with reference to the fourth embodiment may be added to a position upstream or downstream of the oil absorbing mechanism 170".

(4) The features which will be described with reference to FIGS. 14 and 15 may be applied to this modification 4.

<Third Embodiment>

Figure 12:
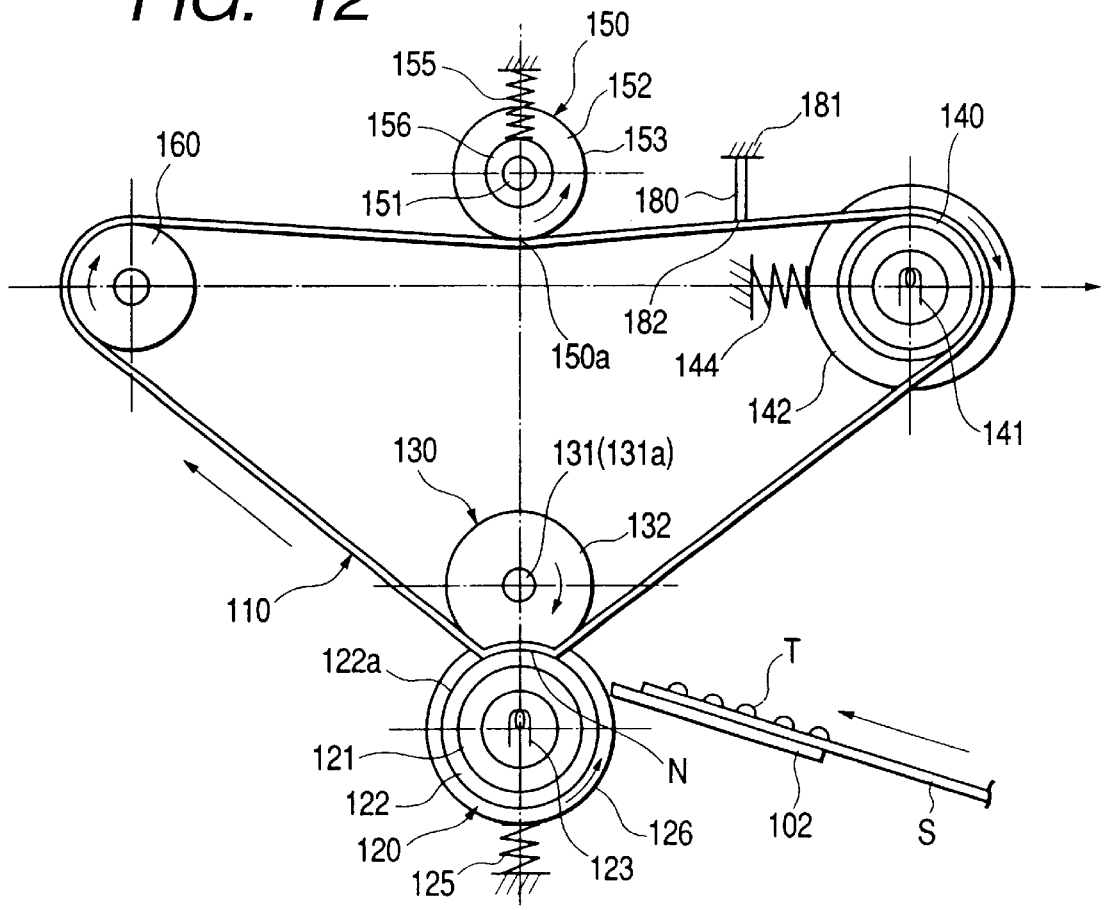
FIG. 12 schematically shows a third embodiment of the present invention.
Figure 13:
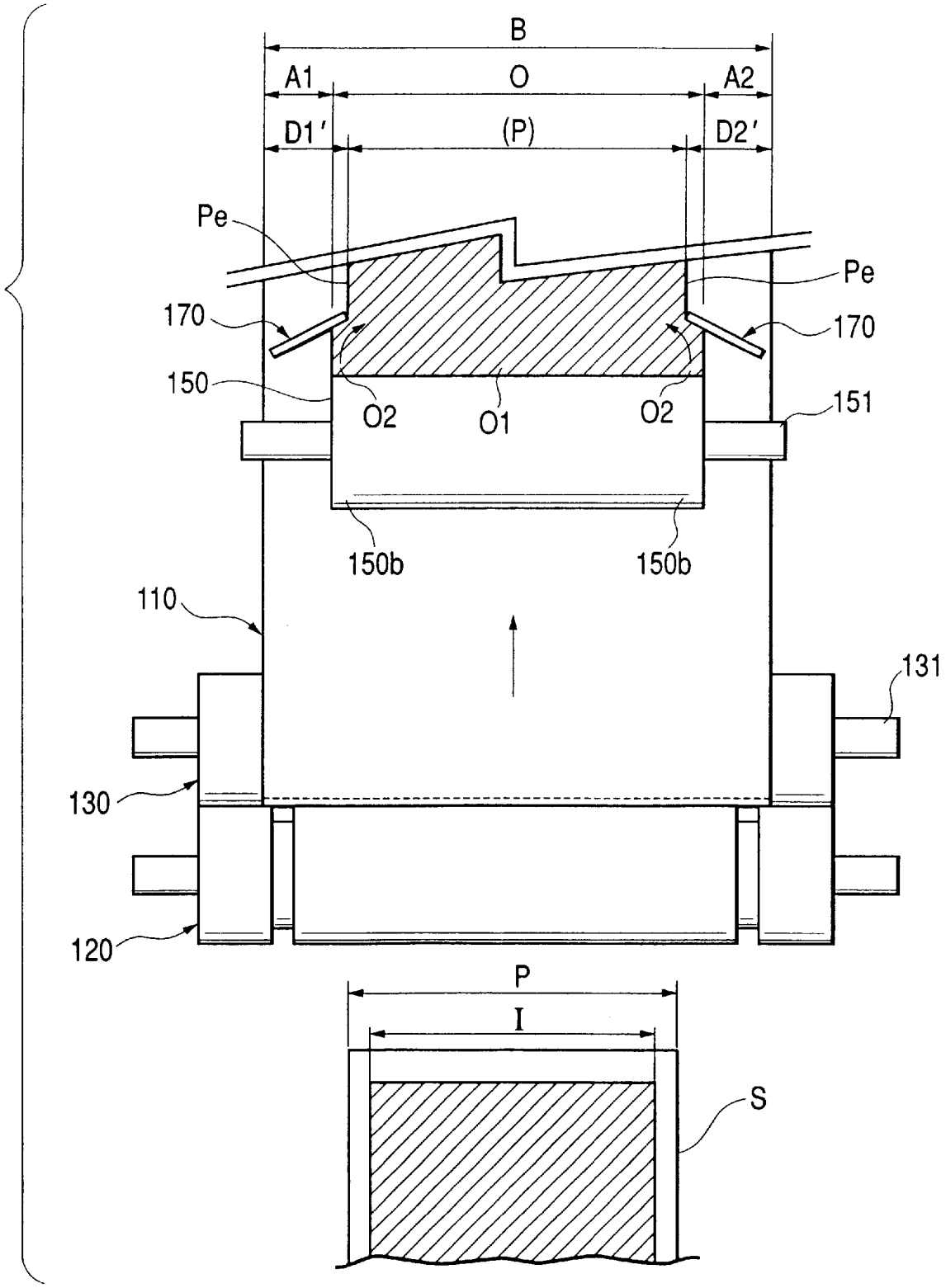
FIG. 13 schematically shows the third embodiment.

One of the major features of a third embodiment of the present invention resides in that a blade for gathering oil, which is applied to portions of the surface of the endless belt by the ends of the oil application roller 1, toward a central portion of the belt surface. In FIGS. 12 and 13, reference numeral 180 designates a blade 180.

The blade 180 is located downstream of the press contact portion N as viewed in the rotational direction of the endless belt 110 of which the surface is coated with release oil, but upstream of the oil application position 150*a* by the oil roller 150.

The blade 180 is supported on a frame (for example, 101) of a fixing device 100 by an appropriate supporting member 151. A bottom 182 of the blade 180 is pressed against the endless belt 110.

To more specific, a pair of blades 180 are disposed such that when viewed in a direction at a right angle to the belt surface (in FIG. 13), a distance between the paired blades 180 increases from the bottom to the top. The blades 180 gathers oil O2, which is applied to portions of the belt surface by the ends 150*b* of the oil application roller 150 and is part of oil 01 applied by the oil application roller 150, toward a central part of the surface of the endless belt 110. The blades 180 comes in contact with the endless belt 110 at portions (a real portions D1 and D2 in FIG. 13) of the belt corresponding to portions respectively extended outward beyond the end portions Pe, when viewed in the widthwise direction, which the portions are those of a passing area of a recording medium S of which the passing width (=maximum passing width P) is the largest of those recording media that may be supplied for the image formation, and gathers the oil 02 to within the maximum passing width P.

Dimensions of the endless belt 110, the blades 180 and the like will be described with reference to FIG. 13.

D1' and D2' indicate the contact lengths of the blades 180 and the endless belt 110 when viewed in the circulating direction of the endless belt 110.

An oil length (=P in this embodiment) after the oil is gathered by the blades 180 is selected to be longer than the maximum image-forming width I within which an image may be formed on the recording medium S.

(301) In the third embodiment, the blades 180 are provided which is located downstream of the press contact portion N as viewed in the circulating direction of the endless belt 110 but upstream of the oil application position 150*a* by the oil roller 150, and which gathers oil O2, which is applied to portions of the belt surface by the ends 150*b* of the oil application roller 150 and forms part of oil 01 applied by the oil application roller 150, toward a central part of the surface of the endless belt 110.

Therefore, the oil O2, which is applied to portions of the belt surface by the ends 150*b* of the oil application roller 150 and forms part of oil 01 applied by the oil application roller 150, is gathered toward a central part of the surface of the endless belt 110 by the support member 180.

When a relatively large amount of oil is applied by the ends 150*b* of the oil application roller 150, the oil O2 is gathered toward the central part of the endless belt 110 by the blade 180 before it reaches the press contact portion N. For this reason or other, there is less chance that the oil applied to the surface of the endless belt 110, in particular the oil O2 which is applied to portions of the belt surface by the ends 150*b* of the oil application roller 150, flows to the back side of the endless belt 110 (at least the amount of such oil is remarkably reduced).

Therefore, in the image forming apparatus of the embodiment, when the endless belt 110 is driven by the drive roller disposed on the inner side of the belt (for example, by the drive roller 160), it is natural that the endless belt is stably driven and as a result, a stable fixing operation is secured. The same thing is true also when it is drive by a drive roller located outside the belt (for example, the pressure roller 120 is used as the drive roller).

(302) The blades 180 comes in contact with the endless belt 110 at portions (a real portions D1 and D2 in FIG. 13) of the belt corresponding to portions respectively extended outward beyond the end portions Pe, when viewed in the widthwise direction, which the portions are those of a passing area of a recording medium S of which the passing width (=maximum passing width P) is the largest of those recording media that may be supplied for the image formation, and gathers the oil O2 to at least within the maximum passing width P. When a recording medium that may be supplied for the image formation is a recording medium S of the maximum passing width P, the oil gathered toward the central part of the surface of the photosensitive member unit 10 is almost all absorbed by or transferred to the recording medium when it passes through the fixing device 100. Recording media of various sizes are supplied for the image formation. Accordingly, there is a case where a recording medium of a small passing width is supplied to the fixing device and oil remains in an area out of the passing width. In this case, when a recording medium S of the maximum passing width P is then supplied for the image formation and it passes through the fixing device 100, the residual oil is almost all absorbed by or transferred to the recording medium S of the maximum passing width P, however.

When a relatively large amount of oil O2 is applied by the ends 150*b* of the oil application roller 150, there is a lesser chance that the oil O2 flows to the back side of the endless belt 110. As a result, a more stable fixing operation is secured.

(303) An oil length (=P in this embodiment) after the oil is gathered by the blades 180 is selected to be longer than the maximum image-forming width I within which an image may be formed on the recording medium S. With this feature, the offset phenomenon is prevented with certainty.

(304) As recalled, the image forming apparatus of FIG. 1 is capable of forming toner images on both sides of the recording medium S. Therefore, sometimes a recording medium S having toner images on both sides passes through the press contact portion N of the fixing device 100.

The toner present on the recording medium S hinders the absorption of oil by the recording medium S. Accordingly, where toner images are formed on both sides of the recording medium S, oil is less absorbed by the recording medium S when comparing with a case where a toner image is formed on only one side of the recording medium S. In the case of the recording medium S having toner images on both sides thereof, the above-mentioned slip is easier to occur in the conventional fixing device.

On the other hand, in this embodiment, at least the blades 180 are provided which is located downstream of the press contact portion N as viewed in the rotational direction of the endless belt 110 of which the surface is coated with release oil but upstream of the oil application position 150*a* by the oil roller 150, and which gathers oil O2, which is applied to portions of the belt surface by the ends 150*b* of the oil application roller 150 and is part of oil 01 applied by the oil application roller 150, toward a central part of the surface of the endless belt 110. Therefore, even in the case where toner images are formed on both sides of the recording medium S, a stable fixing operation is secured.

Thus, the fixing device is capable of forming (fixing) images on both sides of the recording medium S through a stable fixing operation.

(305) The FIG. 1 image forming apparatus is capable of form a full color image by superimposing toner of a plurality of different colors. Therefore, there is a case that a recording medium S having a full color image formed on one side thereof passes the press contact portion N of the fixing device 100.

As described above, toner present on the recording medium S hinders the absorption of oil by the recording medium S. Therefore, in a case where a full color image that results from the superimposing of toner of a plurality of different colors is formed on the recording medium S, the recording medium S less absorbs the oil than in a case where only the monochromatic image is formed on the recording medium. In the case of the recording medium S having the full color image by superimposing toner a plurality of colors, the above-mentioned slip will occur more easily.

In this embodiment, at least the blades 180 are provided-which is located downstream of the press contact portion N as viewed in the rotational direction of the endless belt 110 of which the surface is coated with release oil but upstream of the oil application position 150*a* by the oil roller 150, and which gathers oil O2, which is applied to portions of the belt surface by the ends 150*b* of the oil application roller 150 and is part of oil 01 applied by the oil application roller 150, toward a central part of the surface of the endless belt 110. Therefore, even in the case where a full color image by superimposing toner of a plurality of colors is formed on the recording medium S, a stable fixing operation is secured.

Thus, the fixing device is capable of forming a stable full color image, and further forming (fixing) full color images on both sides of the recording medium S through a stable fixing operation.

The third embodiment has also the features and advantages already described in items 101 and 102, and those which will be described in items 401 and 405.

In the third embodiment, an oil absorbing member may be provided downstream of the oil application mechanism. For a mechanical arrangement preferred in providing the oil absorbing member, reference is made to a modification 2 of the fourth embodiment.

In the third embodiment, the pressure roller is urged to the backup roller by means of the urging mechanism. Instead of this, a axis-to-axis distance between the backup roller and the pressure roller may be fixed. For a preferable mechanical arrangement for the fixing of the axis-to-axis distance, reference is made to the fifth embodiment and its modifications 1 and 2.

The features which will be described with reference to FIGS. 14 and 15 may be applied to the third embodiment.

<Fourth Embodiment>

Figure 14A:
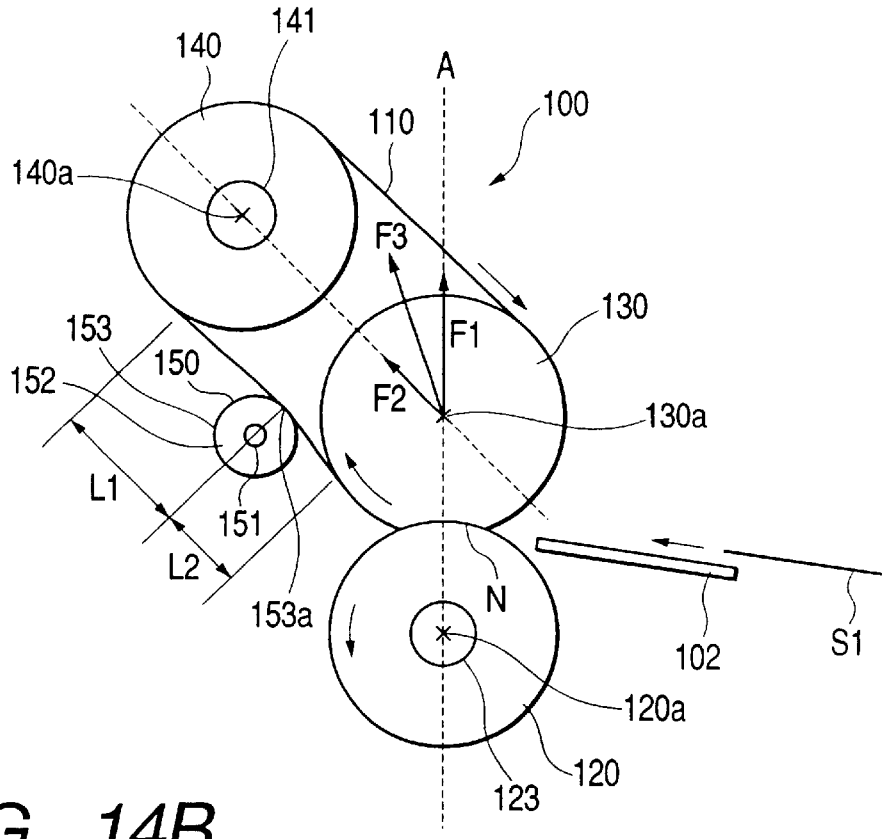
FIGS. 14A and 14B schematically show a fourth embodiment of the present invention.
Figure 14B:
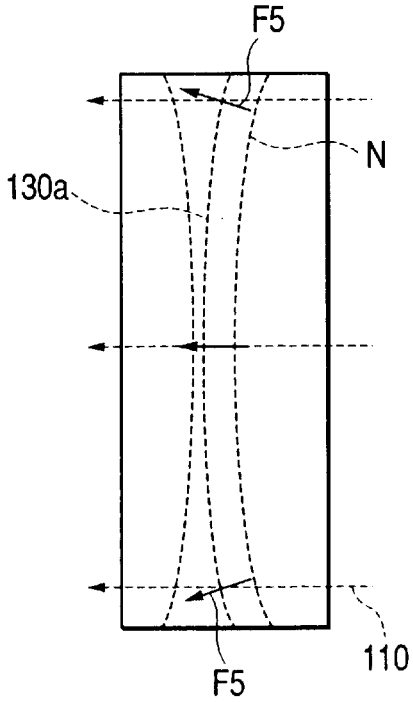

FIGS. 14A and 14B schematically show a major portion of a fixing device 100 which is a fourth embodiment of the present invention. The fourth embodiment of the invention concerns a preferred arrangement of the backup roller, the pressure roller and the heating roller, and a preferred arrangement of those rollers when the fixing device is provided with an oil application mechanism.

Specifically, one of the features of the fourth embodiment resides in that the oil application roller 150 is located above an auxiliary heating mechanism 123 of the pressure roller 120 and downstream of the fixing nip N when viewed in the traveling or passing direction of the recording medium S. In this embodiment, a release-agent holding portion 152 and a contact portion 153*a* are both located above the auxiliary heating mechanism 123 of the pressure roller 120, and downstream of the fixing nip N when viewed in the traveling direction of the recording medium S. If required, one of the a release-agent holding portion 152 and the contact portion 153*a* may be located above the auxiliary heating mechanism 123 of the pressure roller 120, and downstream of the nip N when viewed in the traveling direction of the recording medium S.

One of the features of the embodiment resides in that when viewed in the axial direction of the backup roller 130, the rotational center 140*a* of the heating roller 140 is located downstream of a straight line A connecting the rotational centers 130*a* and 120*a* of the backup roller 130 and the pressure roller 120 with respect to a passing direction (arrow S) of the recording medium passing through the fixing nip N.

Another feature of the embodiment resides in that the oil application roller 150 is brought into contact with the endless belt at a position closer to the backup roller 130 than a mid position between a winding-end position of the endless belt onto the backup roller 130 and a winding-start position of the same onto the heating roller 140, viz., closer to the pressure roller 120. Specifically, a relation L1>L2 is set up where L1 is a distance from the contact position of the oil application roller 150 with the endless belt 110 to the winding-start position of the endless belt 110 onto the heating roller 140, and L2 is a distance from the winding-end position of the endless belt 110 onto backup roller 130 to the contact position of the endless belt 110 with the oil application roller 150.

The fixing device 100 of this embodiment has the advantageous effects.

(401) The fixing device includes the endless belt 110 which circulates in a state that it extends around the heating roller 140 and the backup roller 130, the pressure roller 120 which is pressed against the backup roller 130 with the endless belt 110 intervening therebetween, to thereby form a fixing nip N, and the auxiliary heating mechanism 123 for heating the pressure roller 120. Therefore, when a recording medium S having a toner image formed thereon passes through the fixing nip N, the toner image is fused and permanently affixed onto the recording medium S. The fixing device further includes the release agent application roller 150. Because of this, an offset phenomenon rarely occurs in which the toner image is transferred from the recording medium S to the endless belt 110. The release agent application roller 150 applies release agent onto the endless belt 110 in a state that it comes in contact with the endless belt at a position located downstream of the fixing nip N but upstream of the heating roller 140. This feature eliminates such an desired situation that a temperature of the endless belt 110 heated by the heating roller 140 drops by application it with release agent before it reaches the fixing nip N.

(402) In the fixing device 100, the oil application roller 150 is located above an auxiliary heating mechanism 123 of the pressure roller 120 and downstream of the fixing nip N when viewed in the passing direction (arrow S) of the recording medium S. Radiation heat and hot air stream that are derived from the auxiliary heating mechanism 123 smoothly reach the release agent application roller 150 without any interruption by the backup roller 130 and the endless belt 110.

The release agent application roller 150 is directly heated not only by its contact with the endless belt 110 but also by the radiation heat and the hot air stream from the auxiliary heating mechanism 123. For this reason, the release agent application roller 150 is relatively quickly heated in an initial stage of the operation of the fixing device 100. Its temperature settles down quickly.

When the recording medium S passes through the fixing nip N and as a result, a temperature of the endless belt 110 becomes different in its widthwise direction (perpendicular to the paper surface in FIG. 14), and in this state the endless belt 110 comes in contact with the release agent application roller 150, the temperature difference reflects a lesser influence on the temperature of the release agent application roller 150. As a result, the amount of release agent by the release agent application roller 150 becomes less different in the belt width direction and hence a chance of formation of an irregularity on the fixed image is lessened.

Thus, the fixing device 100 has such an advantage effect that it hardly gives rise to a application irregularity of the release agent.

The advantageous effect is also obtained also in a case that at least one of the a release-agent holding portion 152 and the contact portion 153*a* of the release agent application roller 150 as release agent application mechanism is located above the auxiliary heating mechanism 123 of the pressure roller 120 and downstream of the fixing nip N in the passing direction of the recording medium S.

(403) In the embodiment, the release-agent holding portion 152 and the contact portion 153*a* of the release agent application roller 150 as release agent application mechanism is located above the auxiliary heating mechanism 123 of the pressure roller 120 and downstream of the fixing nip N in the passing direction of the recording medium S. Therefore, the releaseagent holding portion 152 and the contact portion 153*a* of the release agent application roller 150 are relatively quickly heated in an initial stage of the operation of the fixing device 100. Their temperature settles down quickly.

Therefore, a chance that the temperature of the release-agent holding portion 152 and the contact portion 153*a* become different in the belt width direction is further lessened. As a result, a chance of causing a difference in the amount of application release agent when viewed in the belt width direction is further lessened. The same thing is true for the formation of an irregularity in the fixed image.

(404) In the embodiment, when viewed in the axial direction of the backup roller 130, the rotational center 140*a* of the heating roller 140 is located downstream of a straight line A connecting the rotational centers 130*a* and 120*a* of the backup roller 130 and the pressure roller 120 with respect to a passing direction of the recording medium passing through the fixing nip N. With this feature, the endless belt 110 guides a hot air stream heated by the auxiliary heating mechanism 123 of the pressure roller 120 and increases its hitting on the release agent application roller 150.

Accordingly, the release agent application roller 150 is relatively quickly heated in an initial stage of the operation of the fixing device 100. Its temperature settles down quickly.

Therefore, a chance that the temperature of the release agent application roller 150 become different in the belt width direction is further lessened. As a result, a chance of causing a difference in the amount of application release agent when viewed in the belt width direction is further lessened. The same thing is true for the formation of an irregularity in the fixed image.

(405) The release agent application roller 150 also functions as a cleaning mechanism to remove toner offset to the endless belt 110. With this function, there is no chance that the toner offset to the endless belt 110 is transferred onto the recording medium to impair the quality of the reproduced image.

Meanwhile, in the conventional fixing unit shown in FIG. 4, a temperature rise of the oil application roller R4 is dull in the initial stage of the fixing unit operation. Because of this, improvement of the toner arresting capability of the oil application roller R4 is difficult. On the other hand, in this embodiment, the oil application roller 150 is relatively quickly heated in the initial stage of the operation of the fixing device 100. Its temperature quickly rises. Also in the initial stage, an excellent cleaning performance by the oil application roller 150 is secured.

Further, the endless belt 110 is heated by the auxiliary heating mechanism 123 of the pressure roller 120 over a range from the fixing nip N to the oil application roller 150. Because of this, hardening of the toner offset to the endless belt 110 (viz., increase a fixing force of the toner to the endless belt 110) is impeded, so that a more excellent cleaning performance is secured.

(406) The oil application roller 150 is brought into contact with the endless belt at a position closer to the backup roller 130 than a mid position between a winding-end position of the endless belt onto the backup roller 130 and a winding-start position of the same onto the heating roller 140, viz., closer to the pressure roller 120. With this feature, the temperature of the release agent application mechanism 150 is stabilized earlier.

(407) In the embodiment, when viewed in the axial direction of the backup roller 130, the rotational center 1140*a*of the heating roller 140 is located downstream of a straight line A connecting the rotational centers 130*a* and 120*a* of the backup roller 130 and the pressure roller 120 with respect to a passing direction of the recording medium passing through the fixing nip N. Therefore, a force F2 acting on the backup roller 130, which caused by a tension of the endless belt 110 extending around the backup roller 130 and the heating roller 140, is directed downstream with respect to the passing direction (direction of an arrow S) of the recording medium. The resultant force of a force F1 acting on the backup roller 130 when it is pressed against the pressure roller 120 and the force F2 is also directed downward with respect to the passing direction of the recording medium.

Therefore, as shown in FIG. 14B, the rotational center 130a of the backup roller 130 is deflected downstream with respect to the passing direction of the recording medium.

Accordingly, a transporting force acting on the endless belt 110 at the fixing nip N is represented by forces F5 acting in directions in which the endless belt 110 is spread outward at both sides of the recording medium S.

As described above, the endless belt 110 is compressed together between the backup roller 130 and the pressure roller 120 by the strong force F1. Therefore, the transporting force acting on the endless belt 110 at the fixing nip N has a large effect on the endless belt 110.

Accordingly, when the forces F5 to spread the belt 110 outward act at the fixing nip N, the endless belt 110 is not creased in a region located downstream of the fixing nip N. Because of this, a uniform contact is set up between the oil application roller 150 and the endless belt 110, and as a result, no irregularity is formed in the oil applied to the endless belt 110.

The endless belt 110 extends around the heating roller 140 and the backup roller 130. Accordingly, its construction is relatively simple.

In the fixing device 100 of this embodiment, an oil application irregularity can be prevented by a relatively simple structure.

Also in a case where the backup roller 130 is used for driving the endless belt 110, when release agent is applied to the belt 110, it creeps to the back side of the belt. As a result, the endless belt 110 is easy to slip at locations just before and after the fixing nip N. A force having a direction in which the endless belt 110 is thrust at a location where the belt is put on the backup roller 130 is extremely small in contribution when comparing with a force having a direction in which the endless belt 110 is thrust at the fixing nip N. Also in a case where the pressure roller 120 is used for driving the endless belt 110, the endless belt 110 follows in rotation the backup roller 130 at the fixing nip N. A force of the thrust direction acts similarly. In a location adjacent the fixing nip N, the transmission of a drive force by a position where the belt is put on the backup roller 130 is not performed. Therefore, the force of the thrust direction is extremely small at the position where the belt is put on the backup roller. For this reason, the present invention is valid for both the case of driving the backup roller 130 and the case of driving the pressure roller 120.

(408) In the conventional fixing device, because of presence of creases of the belt, there is the possibility that toner flows out through the creases. On the other hand, in the fixing device of the embodiment, the belt is not creased and the oil application roller having a cleaning function is provided. Accordingly, a chance that toner flows out through the creases is substantially removed.

(409) The oil application roller 150 is brought into contact with the endless belt at a position closer to the backup roller 130 than a mid position between a winding-end position of the endless belt onto the backup roller 130 and a winding-start position of the same onto the heating roller 140, viz., closer to the pressure roller 120. Therefore, the oil application roller 150 is in contact with the endless belt 110 at a position near a position that it reaches immediately after the belt passes through the fixing nip N while being spread outward by the nip.

For this reason, the endless belt 110 does not crease easily, and as a result, formation of an irregularity of the oil application is prevented more reliably.

(410) Also in the embodiment, the oil application roller 150 is located closer to the backup roller 130 than the heating roller 140, and the oil application roller 150 is located below the heating roller 140. Therefore, the fixing device has the advantageous effects.

Silicone oil is generally used for the release agent. The silicone oil is a polymer of organosiloxane. An example of it is dimethyl silicone oil (polydimethyl siloxane) as a polymer of dimethyl siloxane.

Accordingly, the silicone oil is a mixture of polydimethyl siloxane of polymer of different polymerization degrees and contains organosiloxane olygomer of low-molecular-weight component.

For this reason, when the silicone oil is left at high temperature, the low-molecular-weight component evaporates, so that a viscosity of the silicone oil increases.

The amount of the release agent application applied by the oil application roller 150 depends on a viscosity of the release agent. Therefore, if the oil application roller 150 is excessively heated by the heating roller 140, and the viscosity of the silicone oil excessively increases, the application amount of silicone oil decreases on the surface of the oil application roller 150 where it faces the heating roller 140, in an extreme case, the entire surface of the oil application roller 150. A nonuniformity in the application of the release agent on the endless belt 110, brings about problems, such as, a gloss nonuniformity of the image, and an offset of toner to the endless belt 110.

In the embodiment, the above problems are not created since at least the oil application roller 150 is located closer to the backup roller 130 than the heating roller 140.

As described above, the silicone oil contains an alkyl group as a substituent group coupled to silicon (Si) (methyl group as a substituent group in the case of dimethyl silicone oil). Many other substituent groups may be used. An example of those substituent groups is a called amino denatured silicone oil containing an amino group as part of the alkyl group).

An affinity of the amino denatured silicone oil with the silicone oil is lower than that of dimethyl oil. Therefore, the amino denatured silicone oil is hard to penetrate into the silicone oil.

For this reason, in a case that the silicone rubber is used as the surface layer of the endless belt 110 or the pressure roller 120, if dimethyl silicone oil is used as release oil, the release agent is easy to penetrate into the surface layer of the endless belt 110 or the pressure roller 120. Therefore, it is necessary to increase the amount of its application. In this case, if the amino denatured silicone oil is used, the amount of the release agent application may be small since it is hard to penetrate into the surface layer.

When the amino denatured silicone oil is placed at high temperature, the amino group of the substituent group separates away from the amino denatured silicone oil, and the amino denatured silicone oil deactivates (it, like the dimethyl silicone oil, is easy to penetrate into the silicon rubber, and as a result, the application of the release agent is non-uniform, and a toner offset occurs).

Further, when the amino group separates away from the amino denatured silicone oil, ammonia is generated. Accordingly, bad smell is emitted and the fixing device and its peripheral members are corroded.

On the other hand, in the present embodiment is from the above problems since at least the oil application roller 150 is located closer to the backup roller 130 than the heating roller 140. In this respect, the fixing device effectively operates when the amino denatured silicone oil is used.

<Modification 1>

Figure 15A:
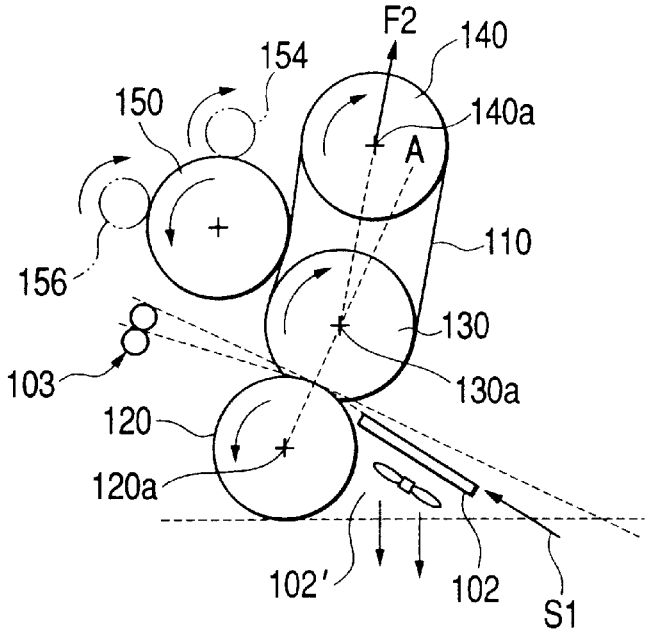
FIGS. 15A and 15B schematically show a first modification of the fourth embodiment.
Figure 15B:
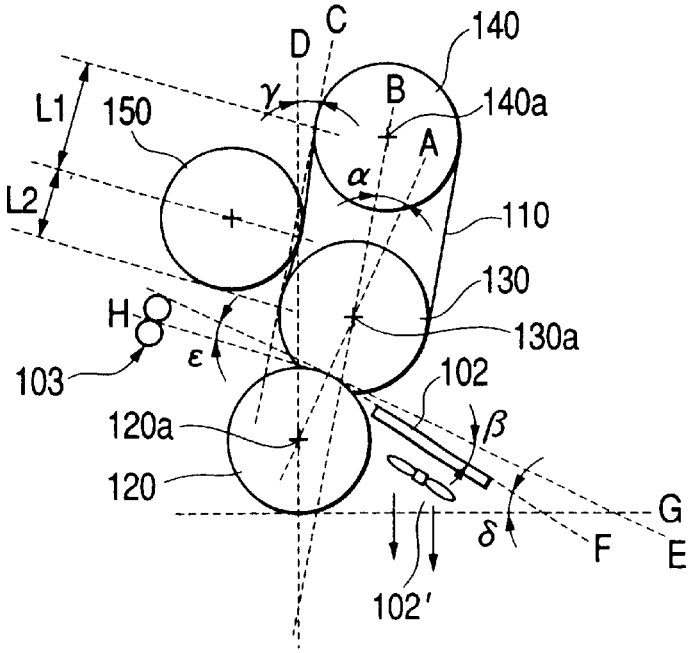

FIGS. 15A and 15B schematically show a major portion of a fixing device which is a modification of the fourth embodiment of the present invention. In those figures, like or equivalent portions are designated by like reference numerals and characters used in the embodiment.

As shown in FIG. 15B, an inclination γ of a line circumscribed line C drawn on the surfaces of the backup roller 130 and the heating roller 140 which are to be in contact with the oil application roller 150 is inclined toward the heating roller 140 (upward in the figure) and toward the upstream side with respect to the passing direction (arrow direction S1) of the recording medium beyond a perpendicular line D passing through the rotational center 120*a* of the pressure roller 120.

The inclination y is within a range from −45° to +45°, preferably −20° to +20°.

The thus constructed modification 1 of the fourth embodiment has the following advantageous effects, in addition to those of the fourth embodiment.

(411) The inclination γ of a line circumscribed line C drawn on the surfaces of the backup roller 130 and the heating roller 140 which are to be in contact with the oil application roller 150 is inclined toward the heating roller 140 (upward in the figure) and toward the upstream side with respect to the passing direction (arrow direction S) of the recording medium beyond a perpendicular line D passing through the rotational center 120*a* of the pressure roller 120. Therefore, the influence of a vibration, which is caused by the weight of the endless belt 110, on the fixing device is lessened. A contact state of the oil application roller 150 and the endless belt 110 is stable, so that the oil application nonuniformity is further reliably prevented.

<Modification 2>

Figure 16A:
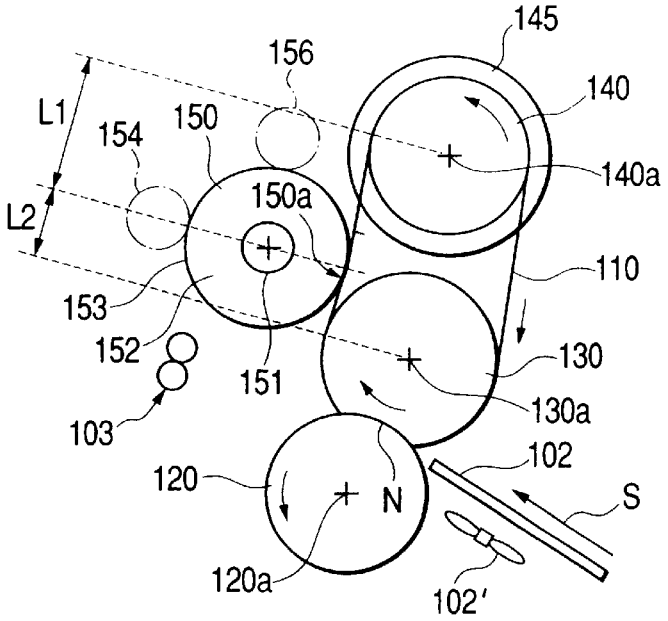
FIGS. 16A and 16B schematically show a second modification of the fourth embodiment.
Figure 16B:
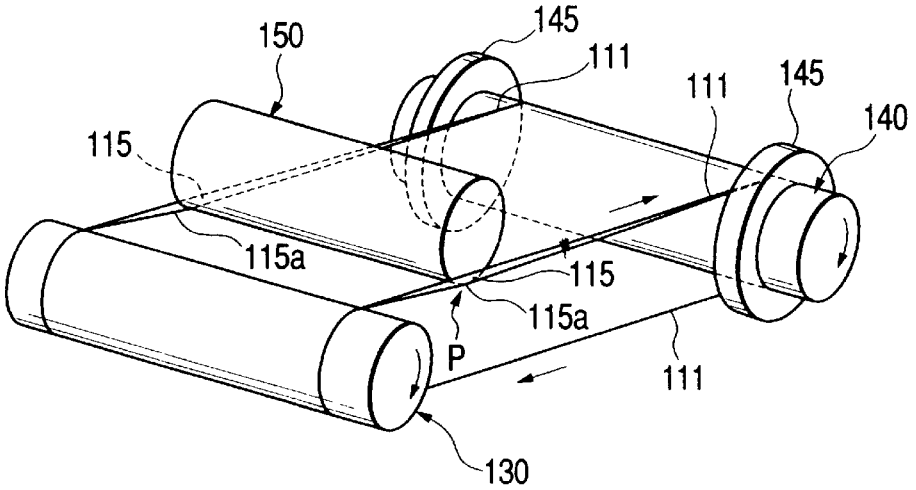

FIGS. 16A and 16B are diagram showing a modification 2 of the fourth embodiment of the present invention. The modification 2 is different from the modification 1 in that a first roller (heating roller) 140, which is located just downstream of an oil application position 150*a* of a release-agent application/tension applying mechanism (oil application roller) 150 as viewed in the circulating direction of the fixing belt 110, is provided with guide rings 145 as restricting portions which come in contact with the side edges 111 of the fixing belt 110 to restrict such a behavior of the traveling fixing belt 110 as to move aside.

The release-agent application/tension applying mechanism 150 is designed to have a length shorter than the width of the fixing belt 110. A hardness of the oil application roller 150 is JIS-A30° or lower.

The modification 2 has the following advantageous effects.

(412) The first roller 140, which is located just downstream of the press contact portion 150*a* of a release-agent application/tension applying mechanism 150 as viewed in the circulating direction of the fixing belt 110, is provided with guide rings 145 as restricting members which come in contact with the side edges 111 of the fixing belt 110 to restrict such a behavior of the traveling fixing belt 110 as to move aside. Therefore, the behavior of the traveling fixing belt 110 as to move aside is restricted.

(413) Further, as shown in FIG. 16B, the release-agent application/tension applying mechanism 150 is brought into pressing contact with the fixing belt at a position closer to the pressure roller 120 than a mid position between a winding-start position of the fixing belt 110 onto the first roller 140 and a winding-end position of the fixing belt 110 onto on the second roller 130, which is located just upstream of the first roller 140. In the modification, both sides of the fixing belt are bent at the press contact portion 150*a* of the release-agent application/tension applying mechanism 150 (the bending of those sides is denoted as 115), and when the fixing belt is wound on the first roller 140, a degree of the bending 115 is smaller than that in a case where the release-agent application/tension applying mechanism 150 is located at a position closer to the first roller 140 than the mid position.

Accordingly, a stress that is generated, as mentioned above, in the belt side edges 115 of the endless belt 110 when the endless belt is wound on the first roller 140 and the bending is removed is also small. As a result, the belt side edges and their vicinal portions are rarely damaged.

As described above, in the fixing device of the modification, the above-mentioned slip is hard to occur, a stable fixing operation is performed, and the fixing belt is not broken easily.

(414) When the force F5 to expand the fixing belt 110 outward acts on the belt at both sides of the fixing nip N, a sag is hard, by the action of the force F5, to occur in the widthwise direction in the fixing belt 110 at a downstream location of the fixing nip N. Therefore, a degree of bending at each of the both side edges 115 of the endless belt 110 of the oil application roller 150 is small.

For this reason, a stress that is generated, as described above, in the side edges 111 when the fixing belt 110 is put on the first roller 140 and the bending is removed, is further reduced, and as a result, the vicinal portions of the belt side edges 111 are harder to be damaged.

Thus, in the fixing device of the modification, the above-mentioned slip is hard to occur, a stable fixing operation is performed, and the difficulty of damaging the fixing belt is raised to a higher degree.

Figure 16C:
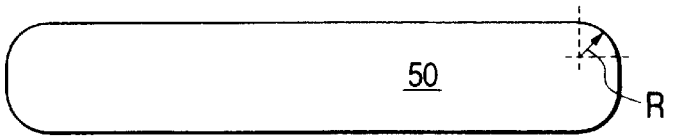
FIG. 16C schematically shows curved ends of a rigid roller.

(415) The release-agent application/tension applying mechanism 150 is an elastic roller and its hardness is JIS-A30° or less. Therefore, a chance of damaging vicinal portions of the side edges 111 is further reduced.

Where the release-agent application/tension applying mechanism 150 is an elastic roller, if its hardness is JIS-A30° or greater, the bending 115 at both sides edges of the fixing belt at the press contact portion 150*a* of the release-agent application/tension applying mechanism 150 is acute (an angle corresponding to a bending angle θ in FIG. 16C is large). On the other hand, its hardness is JIS-A30° or smaller, the bending is gentle.

Accordingly, in the fixing device of the modification 2, a stress that is generated, as described above, in the side edges 111 when the fixing belt 110 is put on the first roller 140 and the bending is removed, is further reduced, and as a result, the damaging of the vicinal portions of the belt side edges 111 is harder.

In the modification 2, when a rigid roller is used for the release-agent application/tension applying mechanism 150, the following mechanical arrangement is preferable. As shown FIG. 16C, the ends of the rigid roller 150 are each formed to have a curved surface of 0.1 mm or longer in radius (R=0.1 mm or longer). When such a rigid roller (e.g., a roller made of metal or rigid synthetic resin) is used for the release-agent application/tension applying mechanism 150, the rigid roller 150 is brought into contact with an oil supply roller 156 as indicated by a phantom line in FIG. 16A, and in this state oil is applied to the related one. In the figure, reference numeral 154 is a cleaning roller for cleaning the surface of the rigid roller 150.

(416) Where the release-agent application/tension applying mechanism 150 is a rigid roller, if each end of it is shaped to have acute corners of which the radius is 0.1 mm or shorter, the bending 115 at both sides edges of the fixing belt at the press contact portion 150*a* of the release-agent application/tension applying mechanism 150 (in this case, see a bending corner 115*a* (FIG. 16B)) is acute, and the possibility of damaging the bending corner 115a itself is increased, in addition to the damage by the above-mentioned stress. On the other hand, if it is shaped to have a curved surface of which the radius is 0.1 mm or longer, the bending corner 115*a* itself is not damaged easily.

Thus, in the modification, the bending corner 115*a* itself is not damaged easily although the release-agent application/tension applying mechanism 150 is the rigid roller. A stress that is generated, as described above, in the side edges 111 when the fixing belt 110 is put on the first roller 140 and the bending is removed, is further reduced, and as a result, the vicinal portions of the belt side edges 111 is more difficult to be damaged.

<Modification 3>

Figure 17:
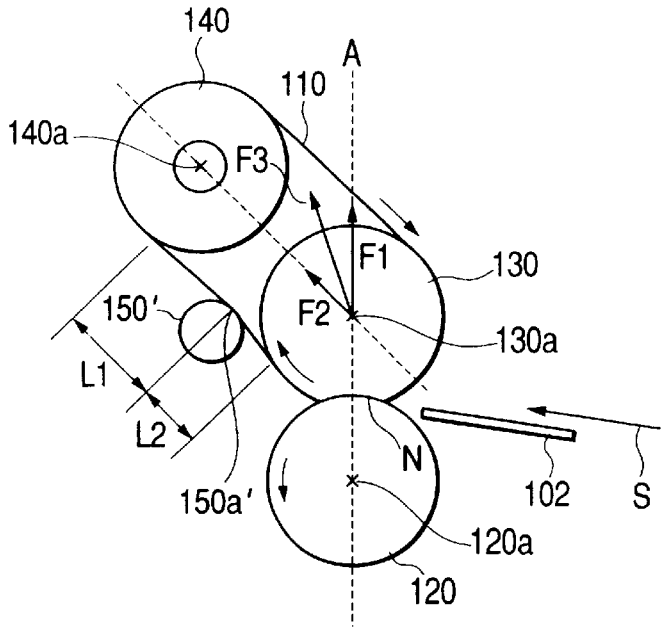
FIG. 17 schematically shows a third modification of the fourth embodiment.

FIG. 17 is a diagram schematically showing a modification 3 of the fourth embodiment of the present invention. A difference of the modification 3 from the fourth embodiment resides in that a press contact member 150', which is shorter in width than the fixing belt 110, is used in place of the release-agent application/tension applying mechanism 150.

In the modification, the press contact member 150' is formed with a cleaning roller for cleaning the surface of the endless belt 110. Examples of other pressing members than it are a cleaning blade and a cleaning pad.

The first roller 140, which is located just downstream of the press contact portion 150*a'* of the press contact member 150' as viewed in the circulating direction of the fixing belt 110, is provided with restricting members 145 which come in contact with the side edges of the fixing belt 110 to restrict such a behavior of the traveling fixing belt 110 as to move aside (see FIG. 16).

(417) The press contact member 150' is shorter in length than the width of the fixing belt 110, and is pressed against the fixing belt 110 to apply a tension to the latter. The press contact member 150' is brought into pressing contact with the fixing belt at a position closer to the pressure roller 120 than a mid position between a winding-start position of the fixing belt 110 onto the first roller 140 and a winding-end position of the fixing belt 110 onto on the second roller 130, which is located just upstream of the first roller 140. In the modification, both sides of the fixing belt are bent at the press contact portion 150*a'* of the press contact member 150', and when the fixing belt is wound on the first roller 140, a degree of the bending (115 in FIG. 16B)is smaller than that in a case where the release-agent application/tension applying mechanism 150 is located at a position closer to the first roller 140 than the mid position.

Accordingly, a stress that is generated, as mentioned above, in the belt side edges of the endless belt 110 when the endless belt is wound on the first 140 and the bending is removed is also small. As a result, it rarely happens that the belt side edges and their vicinal portions are damaged.

As described above, in the fixing device of the modification, the above-mentioned slip is hard to occur, the fixing belt is not broken easily, although the fixing device is provided with the press contact member 150' having the shorter length than the width of the fixing belt 110.

(418) A tension (F2) applied to the second roller 130 by the fixing belt 110 is directed to the downstream side of the passing direction of the recording medium which passes through fixing nip N. Therefore, as stated in the description of the effects of the modification 2, the fixing belt 110 is hardly deflected in the widthwise direction in a location downstream of the fixing nip N, a degree of the bending of both side edges of the fixing belt 110 at the press contact portion 150*a'* of the press contact member 150' is small, so that the side edges of the endless belt 110 are more resistive to its damage.

(1) In the fourth embodiment and its modifications have described using a case where the fixing belt extends around two rollers. It is readily understood that the present invention is applicable to a case where the fixing belt extends around more than three end rollers.

(2) In the fourth embodiment and its modifications, the parting-agent application/tension applying mechanism 150 is an oil application roller 150; however, it may be an oil application pad.

In the fourth embodiment and its embodiments 1 and 2, a axis-to-axis distance between the backup roller and the pressure roller maybe fixed. Preferable mechanical arrangements for the fixing of the axis-to-axis distance will be described by use of the fifth embodiment and its modifications 1 and 2.

<Fifth Embodiment>

A fifth embodiment of the present invention relates to a support structure of the rollers in a fixing device, and one of the features of the embodiment resides in that a distance between the shafts of paired rollers being in pressing contact with each other (for instance, an pressure roller and a backup roller) is fixed.

Figure 18:
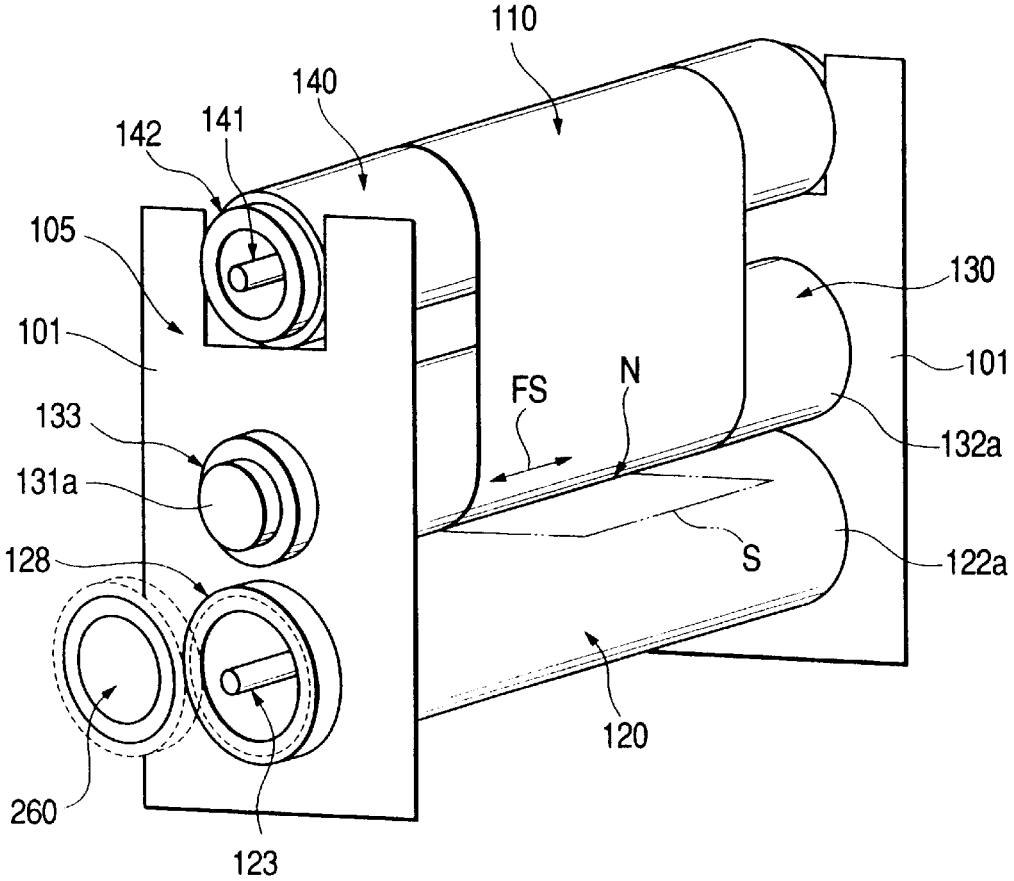
FIG. 18 schematically shows a fifth embodiment of the present invention.
Figure 19A:
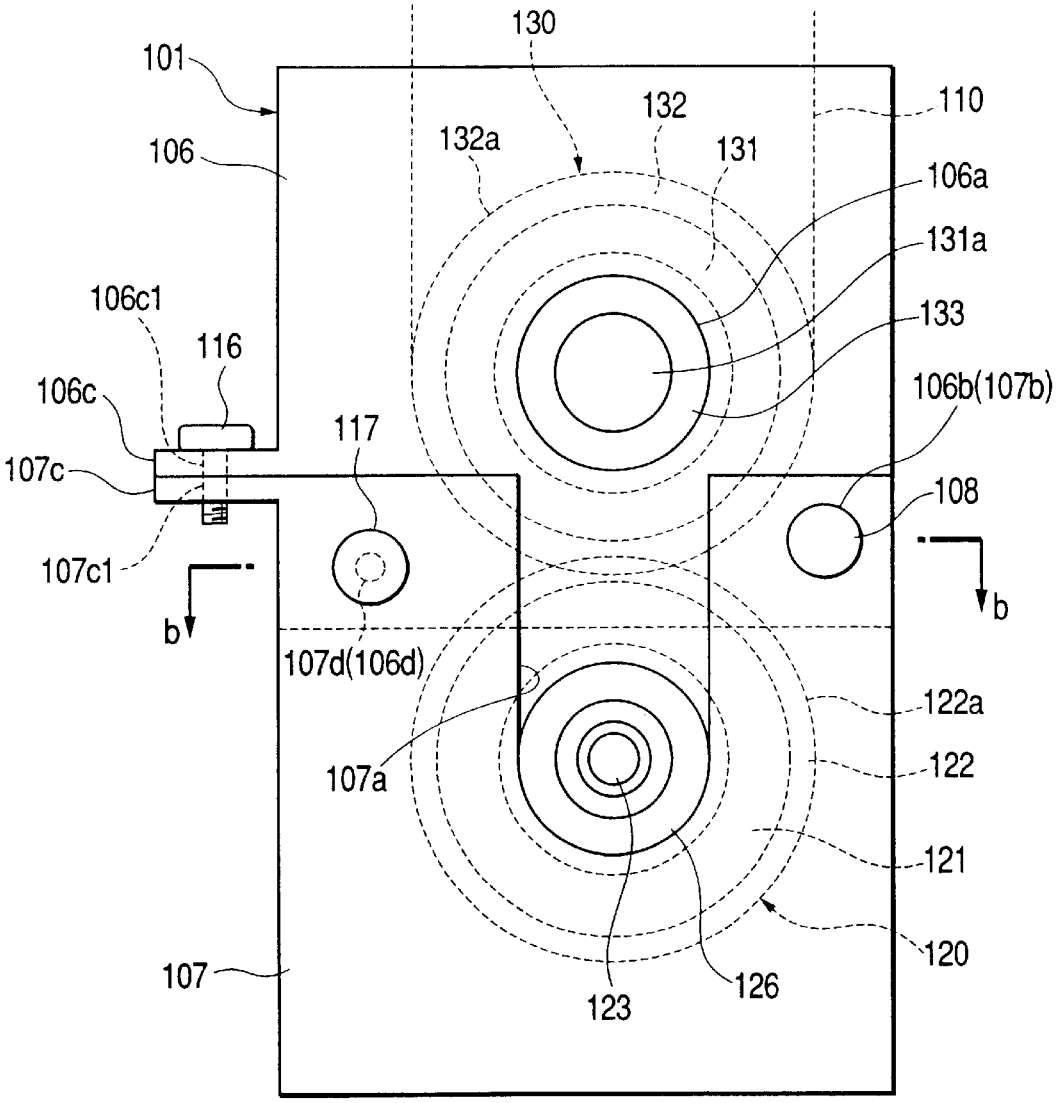
FIGS. 19A and 19B schematically show a first modification of the fifth embodiment.

The pressure roller 120 includes a core member 131 of metal (see FIG. 19A)and a relatively thin, elastic layer 132 layered over the surface of the core member 131 (see FIG. 19A). As shown in FIG. 18, a shaft 131a of the core member 131 is rotatably supported, by a bearing member 133, on a side plate 51 of a frame 50 of the fixing device.

The elastic layer 132 is preferably formed with a layer of silicone rubber, about 7 mm thick, and a low friction layer layered on the silicone rubber layer. The low friction layer maybe formed by covering the elastic layer 132 with a PFA tube.

The pressure roller 120 is formed with a core member 121 (for instance, an iron pipe) shaped like a pipe and having a good thermal conductivity (see FIG. 19A), an elastic layer 122 (see FIG. 19A) formed on the surface of the core member 121, and a surface layer 122*a* which is formed over the surface of the elastic layer 122 and is made of material exhibiting good release characteristics for recording material and toner. A halogen lamp 123 as a heat source is contained in the core member 121. The elastic layer 122 is thinner than the elastic layer 132 of the backup roller 130 or made of material which is harder than that of the elastic layer 132 of the backup roller 130. In the embodiment, the elastic layer 122 is a silicone rubber layer of about 1 mm thick, and it is coated with fluorine latex to form the surface layer 122*a* thereon.

As shown in FIG. 18, the pressure roller 120 is rotatably supported, by a bearing member 126 (FIG. 19A), on the frame side plate 101 of the fixing device. A gear 128 provided at the end of the pressure roller 120 is in mesh with a drive gear 260 provided in the main body of the image forming apparatus, whereby the pressure roller 120 is driven to rotate.

As described above, in the embodiment, the axis-to-axis distance between the pressure roller 120 and the backup roller 130 is fixed by use of the frame side plate 101. Specifically, the pressure roller 120 and the backup roller 130 are mounted while being immovable in the axial direction. The pressure roller 120 is pressed against the backup roller 130 in a state that the endless belt 110 is interposed therebetween, by the utilization of elastic forces of the elastic layer 122 of the pressure roller 120 and the elastic layer 132 of the backup roller 130. For the press contact portion N, the elastic layer 132 of the backup roller 130 is thicker than the elastic layer 122 of the pressure roller 120, and is easy to deform (or soft and is easily deformed). Because of this, it is shaped protruded toward the backup roller 130.

The thus constructed fixing device has the following advantageous effects.

(501) The axis-to-axis distance between the pressure roller 120 and the backup roller 130 is fixed, and at least one of the rollers (in this instance, both rollers) includes an elastic layer. Therefore, a pressing force acting between both the rollers, viz., the pressure roller 120 and the backup roller 130, is obtained by reaction force to the compression force of the elastic layer, viz., the elastic force of the elastic layer.

(502) Since the axis-to-axis distance between the pressure roller 120 and the backup roller 130 is fixed, a parallelism deviation between both the shafts is readily secured.

Therefore, a noticeable deviation of the transportation direction of the endless belt 110 is not created by both the rollers at the press contact portion N between the pressure roller 120 and the backup roller 130. As a result, the endless belt 110 does not crease easily and is not damaged easily. Accordingly, such a force as to move the endless belt 110 in its width direction (arrow FS in FIG. 18) is hard to generate. Hence, the surface of the endless belt 110 is little deteriorated, and this leads to elongation of the life of the endless belt 110.

(503) Since the axis-to-axis distance between the pressure roller 120 and the backup roller 130 is fixed and are immovable, when a relatively thick recording medium, for example, passes through the press contact portion N between both the rollers, the elastic layers are greatly compressed in accordance with the thickness of the passing recording medium. Therefore, the pressing force at the press contact portion N and the width of the same (see W in FIG. 7) when a relatively thick recording medium passes through the press contact portion are larger than those when a relatively thin recording medium passes therethrough.

Accordingly, when a relatively thick recording medium passes through the press contact portion N, a larger pressing force and heat are applied to the recording medium for a long time.

Thus, in the fixing device of the embodiment is capable of satisfactorily fixing a toner image even on a relatively thick recording medium in accordance with a thickness of the recording medium, without any special changing of fixing conditions.

As described above, when the fixing device of the embodiment is used, the endless belt 110 does not crease easily, and its life is elongated. A toner image can be formed even on a relatively thick recording medium in accordance with a thickness of the recording medium, without any special changing of fixing conditions.

<Modification 1>

Figure 19B:
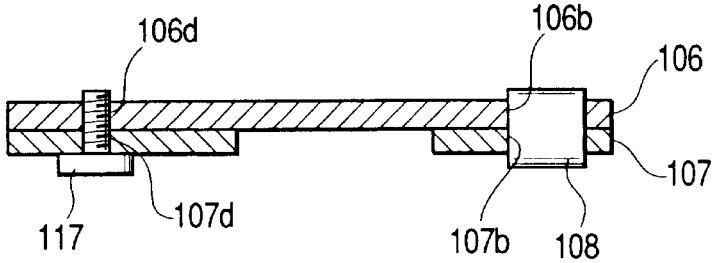

FIG. 19 is a view schematically showing a modification 1 of the fifth embodiment. FIG. 19A is a side view of the modification, and FIG. 19B is a cross sectional view taken on line b—b in FIG. 19A.

One of the features of the modification 1 of the fifth embodiment resides in that a side plate 101 of a frame 105 for fixing the Since the axis-to-axis distance between the rollers is divided into two first and second side plates 106 and 107 in order to secure an easy assembling of the fixing unit.

The first side plate 106 is used for supporting the backup roller 130, and has a hole 106*a* for supporting a bearing member 133.

The second side plate 107 is used for supporting the pressure roller 120 and has a U-shaped hole 107*a* for supporting a bearing member 126.

Those side plates 106 and 107 have holes 106*b* and 107*b* into which a positioning pin 108 is inserted, and further includes flanges 106*c* and 107*c*. A screw insertion hole 106*c*1 is formed in the first side plate 106. A screw hole 107*c*1 is formed in the flange 107*c*. A screw hole 106*d* is formed in the side plate 106, and a screw insertion hole 107*d* is formed in the second side plate 107.

To assembly the fixing device, an pressure roller 120 is inserted into the U-shaped hole 107*a* of the second side plate 107 from the upper side of the hole, as shown. In this case, the holes 106*b* and 107*b* of the first side plates 106 and second side plate 107, which are provided for the insertion of the positioning pin 108, are aligned with each other, and the positioning pin 108 is inserted into those holes in a press fitting manner (in this stage, the pressure roller 120 and the backup roller 130 are in slight contact with each other. That is, the first side plate 106 is slightly turned clockwise about the positioning pin 108 from a state shown in FIG. 19A. However, this state is not illustrated). Then, the first side plate 106 is turned counterclockwise in the figure about the positioning pin 108; the pressure roller 120 and the backup roller 130 are brought into pressing contact; the flanges 106*c* and 107*c* are coupled together; and the those flanges are fastened together by means of a screw 116. In this way, the first and second side plates 106 and 107 are positioned and coupled together, and a distance between the shafts of both rollers 120 and 130 are fixed. Thereafter, both the side plates 106 and 107 are fastened together by a screw 117 as shown in FIG. 19B to complete a fixing device.

As described above, the axis-to-axis distance between the pressure roller 120 and the backup roller 130 is fixed in a simple manner. The modification 1 has advantageous effects similar to those of the fifth embodiment.

<Modification 2>

FIG. 2 is a side view schematically showing a modification 2 of the fixing device of the fifth embodiment.

One of the features of the modification 2 resides in that to further improve the assembling of a fixing device with a fixed axis-to-axis distance of the rollers, a hole 101*a*' for supporting the bearing member 133 of the pressure roller 120, a hole 101*b*' for supporting the bearing member 126 of the pressure roller 120, and an insertion hole 101*c*', continuous to the hole 101*b*', having a diameter larger than the outside diameter of the pressure roller 120 are formed in the frame side plate 101' (only one of the side plates is illustrated).

To assemble the fixing device, the backup roller 130 is set to the side plate 101' as shown in the figure. Then, the pressure roller 120 with the bearing member 126 installed thereto is inserted into the insertion hole 101*c*', and the bearing member 126 is moved to the hole 101*b*' and inserted thereinto in a fitting manner. Thereafter, an anti-slipping-off member (not shown) is attached to he side plate 101', to thereby prevent the bearing member 126 from slipping off the hole 101*b*'. As a result, the axis-to-axis distance between the rollers 120 and 130 is fixed to complete a fixing device.

As described above, the axis-to-axis distance between the pressure roller 120 and the backup roller 130 is fixed in a simple manner. The modification 2 also has advantageous effects similar to those of the fifth embodiment.

<Modification 3>

FIG. 21 is a perspective view schematically showing a modification 3 of the fixing device of the fifth embodiment.

A fixing unit of the modification 3 includes a fixing roller 190 and an pressure roller 120 pressed against the fixing roller 190. A recording medium S passes through the press contact portion N between both the rollers while being compressed and heated, whereby a toner image is fused and permanently affixed to the recording medium S.

A drive roller for rotating fixing and pressure rollers 190 and 120 may be either of those rollers 190 and 120. In the modification 3, the pressure roller 120 is used for the drive roller.

The pressure roller 120 is driven to rotate by a drive gear 260 as a drive mechanism provided on the main body of the image forming apparatus into which the fixing device is incorporated, and the fixing roller 190 follows in rotation the pressure roller 120.

The fixing roller 190 is formed with a pipe-like core member 191 (for instance, an iron pipe) shaped like a pipe and having a good thermal conductivity, an elastic layer 192 formed on the surface of the core member 191, and a surface layer 192*a* which is formed over the surface of the elastic layer 192 and is made of material exhibiting good release characteristics for recording material and toner. A halogen lamp 193 as a heat source is contained in the core member 191. The elastic layer 192 is a layer, about 7 mm, made of silicone rubber. The elastic layer 182 is covered with a PFA tube to form a surface layer 192*a*.

The fixing roller 190 is rotatably supported on the side plate 101 of the frame 105 in such a manner that a core member 191 of the fixing roller is supported by a bearing member 194.

A structure of the pressure roller 120 is substantially the same as of the fifth embodiment, and hence no further description of it will be given.

Figure 20:
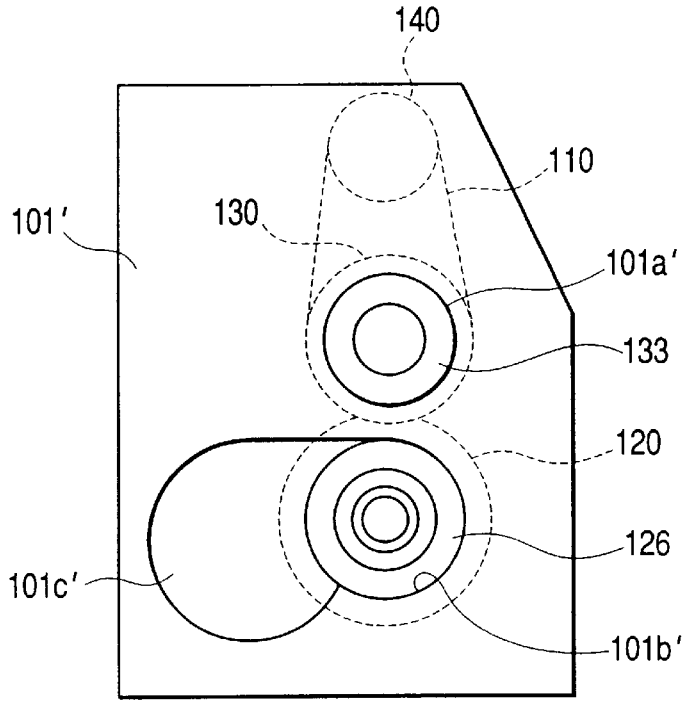
FIG. 20 schematically shows a second modification of the fifth embodiment.

A fixing structure for the pressure roller 120 may be the FIG. 19 fixing structure or the FIG. 20 fixing structure.

In the modification 3, a axis-to-axis distance between the pressure roller 120 and the fixing roller 190 is fixed by use of the side plate 101 of the frame. In the modification, the pressure roller 120 and the backup roller 190 are mounted while being immovable in the axial direction. The pressure roller 120 is pressed against the fixing roller 190 by the utilization of elastic forces of the elastic layer 122 of the pressure roller 120 (FIG. 19A) and the elastic layer 192 of the fixing roller 190. For the press contact portion N, the elastic layer 192 of the fixing roller 190 is thicker than the elastic layer 122 of the pressure roller 120, and is easy to deform (or soft and is easily deformed).

Because of this, it is shaped protruded toward the fixing roller 190.

The thus constructed fixing device has the following advantageous effects.

A recording medium S bearing a toner image formed thereon passes through the press contact portion N between the paired rollers 120 and 190 being pressed against each other, so that toner image is fixed on the recording medium.

The axis-to-axis distance between the pressure roller 120 and the fixing roller 190 is fixed, and at least one of the rollers includes an elastic layer. Therefore, a pressing force acting between both the rollers is obtained by a reaction force to the compression force of the elastic layer.

Since the axis-to-axis distance between the paired rollers 120 and 190 is fixed, a parallelism deviation between both the shafts of those rollers is readily secured.

Therefore, a noticeable deviation of the transportation direction of the recording medium S is not created by both the 20 rollers 120 and 190 at the press contact portion N between the rollers 120 and 190.

Since the axis-to-axis distance is not fixed, the elastic layer is more greatly compressed in accordance with a thickness of the recording medium S when the recording medium of a relatively thick passes through the press contact portion N between the rollers 120 and 190. Therefore, the pressing force at the press contact portion N and the width of the same (see W in FIG. 7) when a relatively thick recording medium passes through the press contact portion N are larger than those when a relatively thin recording medium passes therethrough.

Accordingly, when a relatively thick recording medium passes through the press contact portion N, a larger pressing force (also heat when the roller is a heating roller) is applied to the recording medium for a long time.

Thus, in the fixing device of the modification is capable of satisfactorily fixing a toner image even on a relatively thick recording medium in accordance with a thickness of the recording medium, without any special changing of fixing conditions.

As described above, when the fixing device of the modification is used, the recording medium S does not crease easily.

A toner image can be formed even on a relatively thick recording medium in accordance with a thickness of the recording medium, without any special changing of fixing conditions.

EXAMPLES

Two examples of the embodiments, in particular the fourth embodiment, will given for further specific descriptions thereof.

Example 1

(Distances L1 and L2)

The distance L2 from the winding-end position of the endless belt 110 onto backup roller 130 to the contact position of the endless belt 110 with the oil application roller 150 is approximately 13.9 mm. The distance L1 from the contact position of the oil application roller 150 with the endless belt to the winding-start position of the endless belt onto the heating roller 140 is approximately 23.2 mm. Accordingly, L1 (=23.2 mm)>L2 ( =13.9 mm).

(Angle γ)

The inclination angle γ of a line circumscribed line C, which is drawn on the surfaces of the backup roller 130 and the heating roller 140 which are to be in contact with the oil application roller 150, with respect to the perpendicular line D passing through the rotational center 120*a* of the pressure roller 120 is set at about 28.35°.

(Endless Belt 110)

Figure 22B:
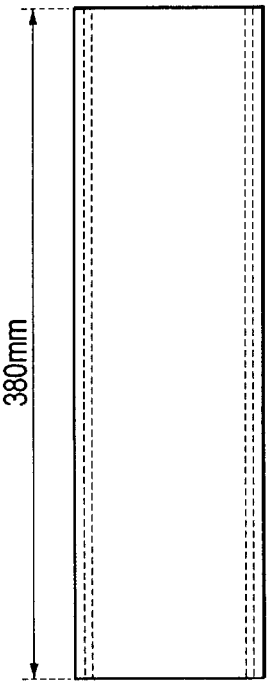
FIGS. 22A and 22B schematically show a specific example of an endless belt.
Figure 22A:
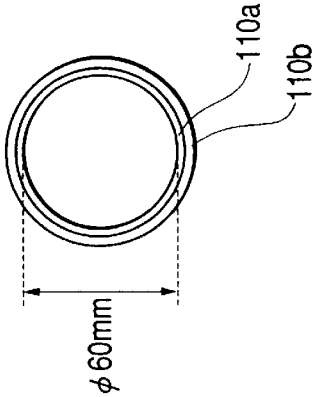

As shown in FIGS. 22A and 22B, the endless belt 110 is a seamless belt consisting of a belt base 110*a* made of polyimide (PI) and a surface layer 110*b* of silicone rubber layered on the belt base 110*a*. If required, an adhesive layer may be interposed between the belt base 110a and the surface layer 110*b*.

The width of the belt is 380 mm or there around, and the inside diameter is Ø60 mm or there around.

(Belt Base 110*a*)

A seamless belt of made of polyimide (PI) by use of a centrifugal process is used for the belt base 110*a*.

The belt base 110a contains carbon black and is conductive. Volume resistivity of the belt is within a range from $10^3$ Ω cm to $10^4$ Ω cm. This range of values is selected to prevent the endless belt 110 from being unnecessarily charged when the endless belt 110 is rubbed with the heating roller 140, the backup roller 130 or the like. If the volume resistivity is set at $10^2$ Ω cm or smaller, an additive amount of carbon black is excessive, so that a strength of the belt decreases.

The belt base 110*a* is black in color since the black carbon is contained. Therefore, it efficiently absorbs thermal energy radiated from the heating roller 140.

A thickness of the belt base 110*a* is within 50 μm to 200 μm, more preferably about 90 μm.

A surface roughness of the inner surface of the belt base 110*a* may take any value is within Ra 1 μm the center-line average surface roughness, more preferably Ra 0.3 μm.

(Surface Layer 110*b*)

Material of the surface layer 110*b* is silicone rubber. A thickness of it may be within a range from 50 to 400 μm, preferably 200 μm or there around.

A surface roughness of the inner surface of the surface layer 110*b* may take any value is within Ra 1 μm the center-line average surface roughness, more preferably Ra 0.3 μm.

(Modification of Endless Belt 110)

An Ni electroforming or fluorine plastic may be used for the belt base 110*a*, in addition to PI. The endless belt may consist of only the belt base. Preferably, a surface layer of silicone rubber, fluorine rubber, or fluorine plastic is layered on the belt base.

(Backup Roller 130)

Figure 23B:
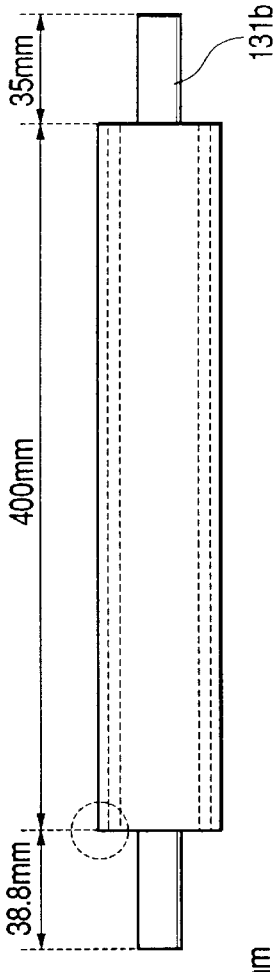
FIGS. 23A, 23B and 23C show a specific example of a backup roller.
Figure 23C:
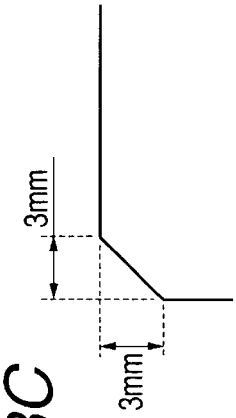
Figure 23A:
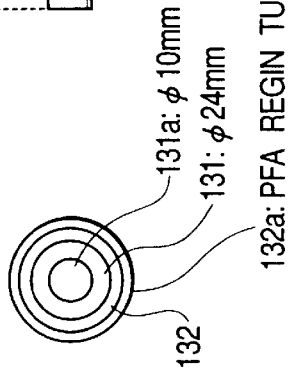

As shown in FIGS. 23A and 23B, the backup roller 130 is an aluminum roller, about Ø24, having shaft portions 131a of about Ø10, extended outward from both ends thereof. An elastic layer 132 of silicon rubber is applied to the outer peripheral surface of the aluminum roller. The elastic layer 132 is covered with a surface layer 132a of fluorine plastic.

The outside diameter of the backup roller 130 is approximately 38.5 mm.

The outer configuration of the backup roller is straightened out, and the end faces of it are beveled as shown in FIG. 23C.

The width of the roller exclusive of the protruded shaft portions 131*a* is approximately 400 mm.

A roller hardness is within JIS-A50° to 80°, more preferably

A surface roughness of the roller may be within RA5 μm, more preferably Ra1 μm.

(Elastic Layer 132)

Material of the elastic layer 132 is silicone rubber, and its thickness is approximately 7 mm. A rubber hardness is within JIS-A5° to 30°, preferably 10°.

(Surface Layer 132*a*)

Material of the surface layer 132*a* is PFA (tetrafluoroethylene perfluoroalkoxy ethylene copolymer) resin. To be more exact, a thermal shrinkage PFA resin tube is used.

The layer thickness after application is within 50 μm to 200 μm, more preferably about 100 μm.

A surface roughness of it after application is within Ra0.3 μm to 3 μm, more preferably Ra1 μm.

(Pressure Roller 120)

Figure 24B:
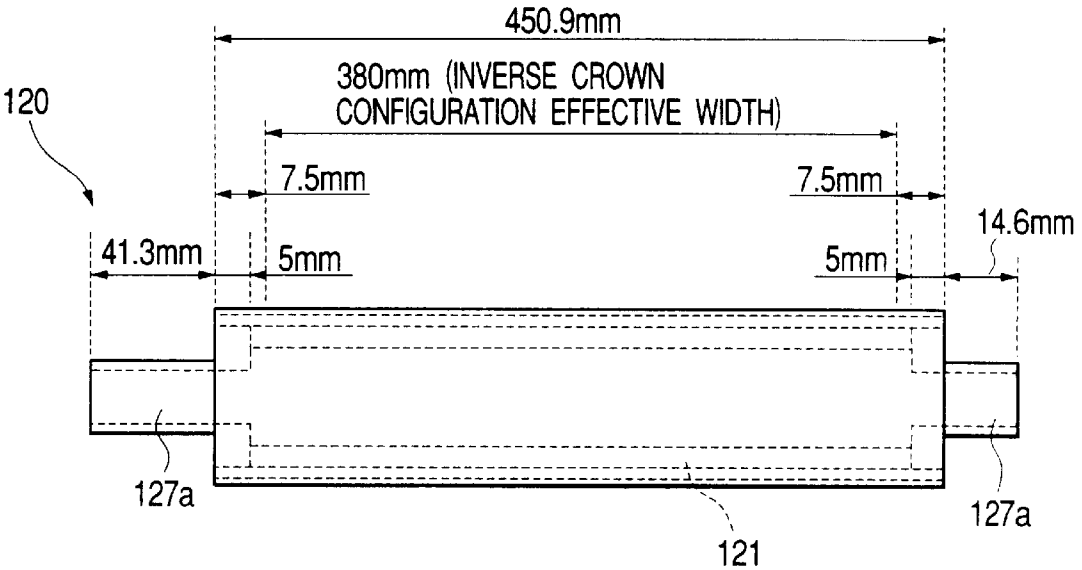
FIGS. 24A, 24B and 24C show a specific example of a pressure roller.
Figure 24A:
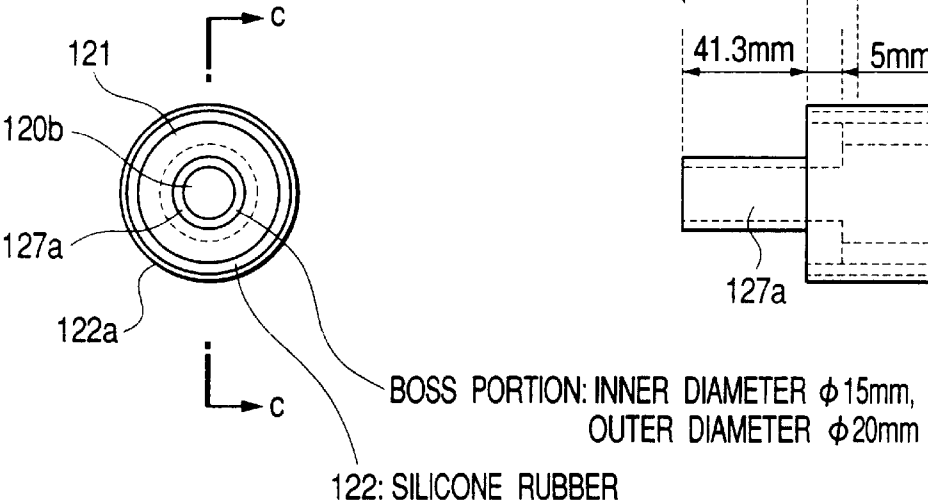
Figure 24C:
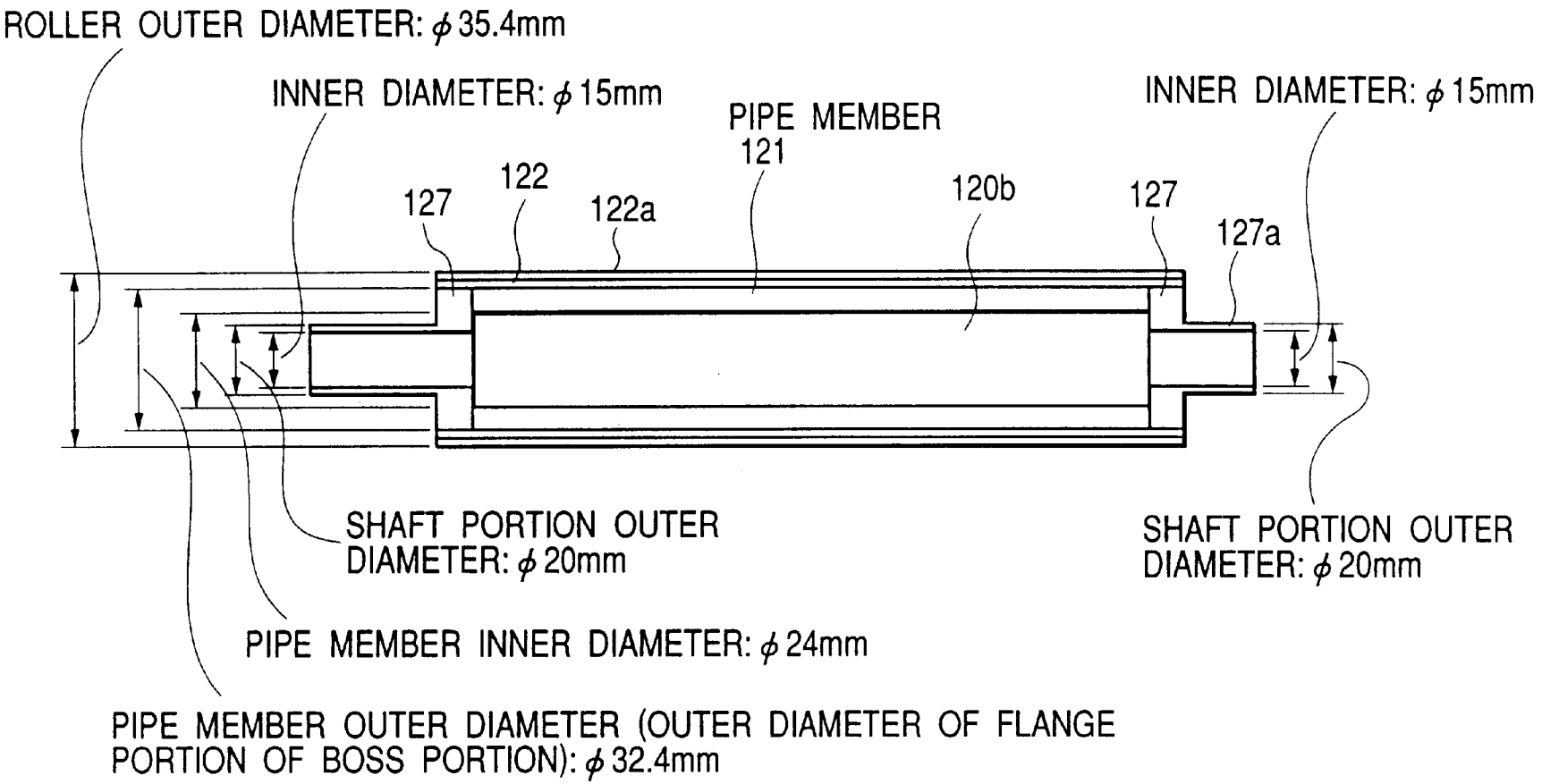

As shown in FIGS. 24A to 24*c*, the pressure roller 120 is an iron roller having bosses 127 made of iron (fee-cutting steel), hollow shaft portions 127*a* of about Ø20 at both ends. The outer circumferential surface of the iron roller is coated with silicone oil to form an elastic layer 122. A surface layer 122*a* of fluorine plastic is applied to the outer surface of the elastic layer 122.

A halogen lamp 123 as a heating source is located within a hollowed portion 120*b* thereof. A heating value of the halogen lamp 123 is within 200 to 300 W, more preferably 230 W.

The outside diameter of the pressure roller 120 is approximately 35.4 mm.

It is configured like an inverse crown, and a crown quantity (outside diameter difference between the end and the central portion) is within 0.0 mm to 02 mm, more preferably about 0.1 mm.

The roller width exclusive of the hollow shaft portions 127*a* is about 395 mm, and the inverse crown effective width is approximately 380 mm.

A roller hardness is within JIS-A70° TO 90°, more preferably about 80°.

A roller surface roughness is within Ra3 μm to 15 μm, more preferably Ra6 μm.

A pressing force to-the hollow shaft portions 127*a* of the backup roller 130 is about 70 Kg (totally 140 Kg). The backup roller 130 and the pressure roller 120 are fixedly mounted on the side plate 101 (the axis-to-axis distance between them is fixed), and any special pressing mechanism is not provided. The pressing load is generated in such a manner that the rollers 120 and 130 are fastened to the frame 101 so that the axis-to-axis distance is shorter than the sum of the outside diameters of the rollers 120 and 130, and one of those rollers bites into the other. A position where the load acts on each roller is a position where the roller is fastened to the frame. It is a position of the bearing member 126 as a bearing of the hollow shaft portion 127*a*.

A pressing mechanism, such as a coiled spring, may be installed to the backup roller 130 or the pressure roller 120, instead.

(Elastic Layer 122) Material of the elastic layer 122 is silicone rubber. A rubber hardness is within JIS-A5° to 30°, more preferably 20°. A layer thickness is approximately 1.5 mm.

(Surface Layer 122*a*)

The surface layer 122a is a application of fluorine latex formed such that fluorine latex is applied to the elastic layer and then is hardened. A thickness of the application is about 60 μ m.

(Modification of the Pressure Roller 120)

The pressure roller 120 may be covered with only the surface layer 122*a* made of fluorine plastic of good release characteristics, not using the elastic layer 122, or may be a metal roller not using both the elastic layer 122 and the surface layer 122*a*.

(Heating Roller 140)

Figure 25A:
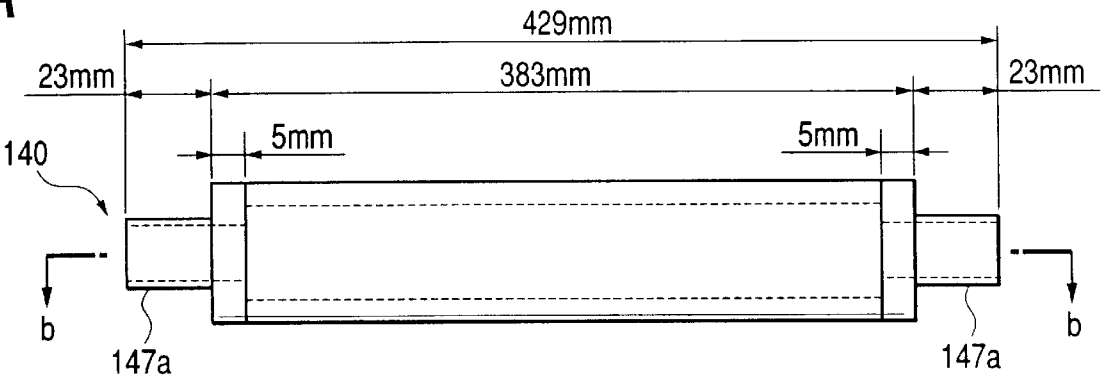
FIGS. 25A and 25B show a specific example of a heating roller.
Figure 25B:
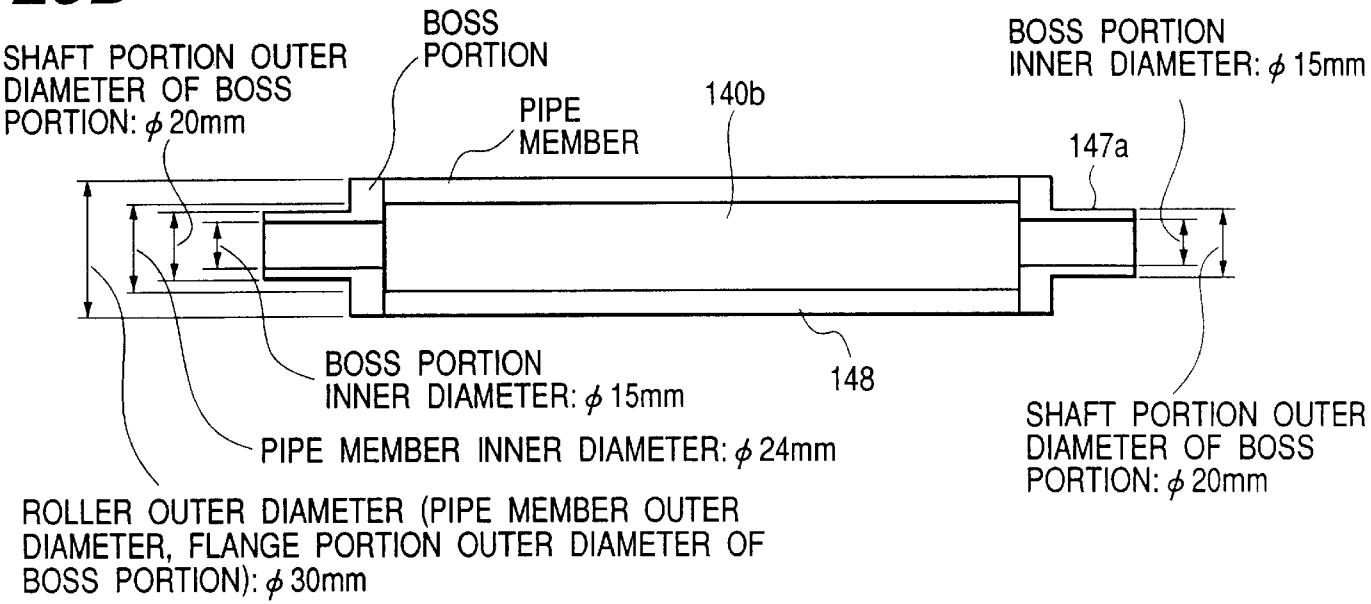

As shown in FIGS. 25A and 25B, the heating roller 140 is an aluminum roller including shaft portions 147*a* extended outward from both ends of the roller and a pipe portion 148 of about Ø 30.

The outside diameter of the roller is about 30 mm, and the roller is configured straightened. The width of the roller exclusive of the shaft portions 147*a* is about 383 mm.

A surface roughness of it is within Ra0.1 to 1, more preferably Ra0.3 μ m.

A heating mechanism 141 that is disposed within a roller hollow portion 140*b is* a halogen lamp. A heating value of the lamp is within 650 W to 850 W, more preferably about 720 W.

A pressing load to be applied to the endless belt 110 is applied to the shaft portions 147*a* of the roller. The pressing load applied to each of the end portions is 7 Kg (totally 14 Kg). To apply the load, a coiled spring is used which extends between one end of a tension rotary member (not shown), which supports at the other end the shaft portion 147*a*, and the frame 101. A position where the load is applied to the heating roller 140 is a bearing portion for the shaft portion 147*a*, which is provided at one end of the tension rotary member.

(Oil Application Roller 150)

Figure 26A:
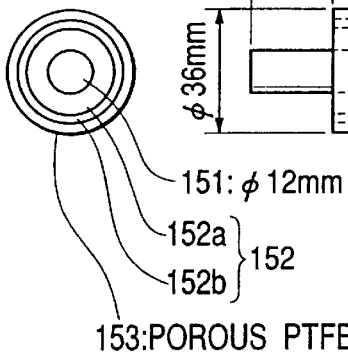
FIGS. 26A and 26B show a specific example of an oil application roller.
Figure 26B:
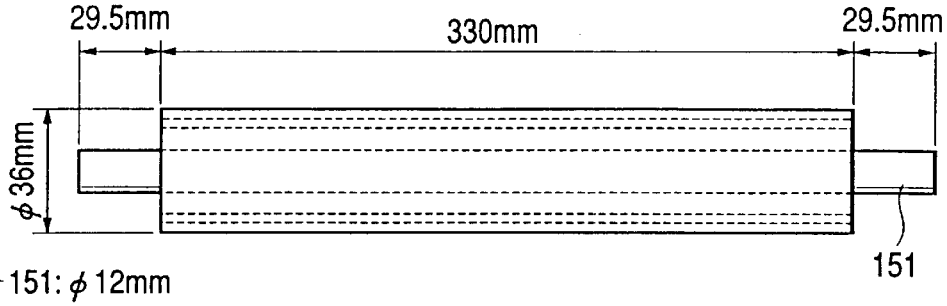

As shown in FIG. 26A and 26B, the oil application roller 150 is constructed such that an oil holding layer 152 including an oil impregnated layer 152*a* and an oil supplying layer 152*b* and a surface layer 153 are laminated on an iron shaft 151 of about Ø 12 mm.

The outside diameter of the oil application roller 150 is approximately 36 mm, and the roller width exclusive of the end portions is approximately 330 mm.

A roller hardness is within JIS-A5° to 30°, more preferably about 20°. A surface roughness is within Ra0.5 μm to 3 μm, more preferably Ra1 μm.

An oil impregnated layer 152*a* is formed of sponge or paper.

An oil supplying layer 152*b* is formed of felt or synthetic leather, and its thickness is about 1.2 mm.

A surface layer 153 is made of PTFE (polytetrafluoroethylene) resin. A thickness of the surface layer is within 30 μm to 120 μm, more preferably 60 μm.

A release agent is dimethyl silicone oil (amino denatured silicone oil is also available). A viscosity (at 20° C.) is within 80 cSt to 400 cSt, more preferably 100 cSt.

A contact load (pressing load) to the endless belt 110 is within 0.5 Kg to 2 Kg in total load, more preferably about 1 Kg.

A contact width between oil application roller 150 and the endless belt 110 (length viewed in the belt traveling direction) is approximately 3 mm.

(Modification of Oil Application Roller 150)

A pad, a blade or the like impregnated with release agent may be used in place of the oil application roller 150 impregnated with release agent.

For the roller of the release-agent impregnated type, the fixed load fastening rather than the fixed position fastening is preferable. The reason for this follows. When a pickup decreases as the result of application of the release agent, the roller outside diameter is reduced. In the case of the fixed position fastening, a contact of the oil application roller 150 also having a tension applying function with the endless belt 110 is also instable. As a result, a application regularity may occur.

The oil application roller 150 of the release-agent impregnated type may be substituted by another roller arrangement in which a bearing member 154 and a release agent supply roller 156 are disposed around the oil application roller 150 as indicated by a phantom line in FIG. 15A.

In this case, the oil application roller 150 is a rigid roller of aluminum or stainless steel or an elastic roller of silicon rubber or fluorine rubber. If necessary, a surface layer made of material having release characteristics, such as silicone rubber or fluorine plastic may additionally be used. The thus constructed roller may be used for the cleaning roller. The cleaning roller may be substituted by a cleaning blade. The release-agent supply roller 156 maybe the oil application roller of the release-agent impregnated type.

(Arrangement of Rollers and the Like)

A axis-to-axis distance between the heating roller 140 and the backup roller 130 is approximately 40.23 mm, and a axis-to-axis distance between the backup roller 130 and the pressure roller 120 is 35.2 mm. A axis-to-axis distance between the backup roller 130 and the oil application roller 150 is approximately 38.9 mm, and a axis-to-axis distance between the heating roller 140 and the oil application roller 150 is approximately 39.18 mm.

As shown in FIG. 15B, an angle α of a straight line A connecting the rotational centers 130*a* and 120*a* of the backup roller 130 and the pressure roller 120 with respect to a straight line B connecting the rotational centers 130*a* and 140*a* of the backup roller 130 and the heating roller 140 is approximately 4.43° toward the downstream side of the recording medium transporting direction with respect to the straight line A.

For a setting angle of the guide 102, an angle δ of a recording medium transporting surface F with respect to a horizontal line (a plane on which the image forming apparatus with the fixing device 100 is placed) G is approximately 31°. The angle δ is within a range from 10° to 50°, more preferably about 31°.

Provision of a suction fan 102' for attracting a recording medium, by absorbing, to the guide 102 is more preferable in that the leading end of the recording medium advancing to the fixing nip N is stable, and in that such a drawback that the trailing end of the recording medium rises and comes in contact with the backup roller 130 before it enters the fixing nip N to disturb an image, is prevented.

A medium advancing angle β (between the guide surface F and the horizontal line E of the fixing nip N (perpendicular line to a straight line connecting the rotational centers of the backup roller 130 and the pressure roller 120) is about 4°.

An angle ϵ of a straight line H connecting the contact position between the paired rollers 103 to the center of the fixing nip N (center as viewed in the medium transporting direction) with respect to a horizontal line E of the fixing nip N, is about 31.5°.

(Modification)

The rollers and the like may be slanted so that the transporting direction of the recording medium passing through the fixing nip N is substantially vertically oriented (nip horizontal line is substantially vertically oriented). cl Example 2

(Distances L1 and L2)

The distance L2 from the winding-end position of the fixing belt 110 onto backup roller 130 to the contact position of the endless belt 110 with the oil application roller 150 is approximately 13.9 mm. The distance L1 from the contact position of the oil application roller 150 with the fixing belt to the winding-start position of the fixing belt onto the heating roller 140 is approximately 23.2 mm. Accordingly, L1 (=23.2 mm)>L2 (=13.9 mm).

(Angle γ)

The inclination angle γ of a line circumscribed line C, which is drawn on the surfaces of the backup roller 130 and the heating roller 140 which are to be in contact with the oil application roller 150, with respect to the perpendicular line D passing through the rotational center 120*a* of the pressure roller 120 is set at about 28.35°.

(Pressure Roller 120)

A halogen lamp 123 as an auxiliary heating source of the pressure roller 120 is provided. A heating value of the halogen lamp 123 is within 200 to 300 W, more preferably 230 W.

(Heating Roller 140)

A heating mechanism 141 that is disposed within a roller hollow portion is a halogen lamp. A heating value of the lamp is within 650 W to 850 W, more preferably about 720 W.

(Oil Application Roller 150)

A roller hardness is within JIS-A5° to 30°, more preferably about 20°. A surface roughness is within Ra0.5 μm to 3 μm, more preferably Ra1 μm.

An oil impregnated layer 152*a* is formed of sponge or paper.

An oil supplying layer 152*b* is formed of felt or synthetic leather, and its thickness is about 1.2 mm.

A surface layer 153 is made of PTFE (polytetrafluoroethylene) resin. A thickness of the surface layer is within 30 μm to 120 μm, more preferably 60 μm.

A release agent is dimethyl silicone oil (amino denatured silicone oil is also available). A viscosity (at 20° C.) is within 80 cSt to 400 cSt, more preferably 100 cSt.

A contact load (pressing load) to the endless belt 110 is within 0.5 Kg to 2 Kg in total load, more preferably about 1 Kg.

A contact width between oil application roller 150 and the endless belt 110 (length viewed in the belt traveling direction) is approximately 3 mm.

(Modification of Oil Application Mechanism)

A pad, a blade or the like impregnated with release agent may be used in place of the oil application roller 150 impregnated with release agent.

For the roller of the release-agent impregnated type, the fixed load fastening rather than the fixed position fastening is preferable. The reason for this follows. When a pickup decreases as the result of application of the release agent, the roller outside diameter is reduced. In the case of the fixed position fastening, a contact of the oil application roller 150 also having a tension applying function with the endless belt 110 is also instable. As a result, a application regularity may occur.

The oil application roller 150 of the release-agent impregnated type may be substituted by another roller arrangement in which a bearing member 154 and a release agent supply roller 156 are disposed around the oil application roller 150 as indicated by a phantom line in FIG. 15A.

In this case, the oil application roller 150 is a rigid roller of aluminum or stainless steel or an elastic roller of silicon rubber or fluorine rubber. If necessary, a surface layer made of material having release characteristics, such as silicone rubber or fluorine plastic may additionally be used. The thus constructed roller may be used for the cleaning roller. The cleaning roller may be substituted by a cleaning blade. The release-agent supply roller 156 maybe the oil application roller of the release-agent impregnated type.

(Arrangement of Rollers and the Like)

A axis-to-axis distance between the heating roller 140 and the backup roller 130 is approximately 40.23 mm, and a axis-to-axis distance between the backup roller 130 and the pressure roller 120 is 35.2 mm. A axis-to-axis distance between the backup roller 130 and the oil application roller 150 is approximately 38.9 mm, and a axis-to-axis distance between the heating roller 140 and the oil application roller 150 is approximately 39.18 mm.

As shown in FIG. 15B, an angle a of a straight line A connecting the rotational centers 130*a* and 120*a* of the backup roller 130 and the pressure roller 120 with respect to a straight line B connecting the rotational centers 130*a* and 140*a* of the backup roller 130 and the heating roller 140 is approximately 4.43° toward the downstream side of the recording medium transporting direction with respect to the straight line A.

For a setting angle of the guide 102, an angle δ of a recording medium transporting surface F with respect to a horizontal line (a plane on which the image forming apparatus with the fixing device 100 is placed) G is approximately 31°. The angle δ is within a range from 10° to 50°, more preferably about 31°.

Provision of a suction fan 102' for attracting a recording medium, by absorbing, to the guide 102 is more preferable in that the leading end of the recording medium advancing to the fixing nip N is stable, and in that such a drawback that the trailing end of the recording medium rises and comes in contact with the backup roller 130 before it enters the fixing nip N to disturb an image, is prevented.

A medium advancing angle β (between the guide surface F and the horizontal line E of the fixing nip N (perpendicular line to a straight line connecting the rotational centers of the backup roller 130 and the pressure roller 120) is about 4°.

An angle ϵ of a straight line H connecting the contact position between the paired rollers 103 to the center of the fixing nip N (center as viewed in the medium transporting direction) with respect to a horizontal line E of the fixing nip N, is about 31.5°.

While some specific embodiments and examples of the present invention have been described, it should be understood that the invention is not limited to those embodiments and examples, but may variously be modified, altered and changed within the true spirits of the invention.

What is claimed is:

1. A fixing device comprising;

a first roller;

a second roller;

an endless belt suspended between said first and second rollers;

a third roller forming a nip in cooperation with said endless belt and said second roller; and an oil application mechanism, which applies oil to at least one of said endless belt and said third roller, wherein a rotational axis of said first roller is located in a downstream side of a traveling direction of a sheet with respect to an imaginary line connecting a rotational axis of said second roller to a rotational axis of said third roller, and said third roller is an elastic roller having a hardness of JIS-A30° or smaller, and wherein a width of said oil application mechanism is shorter than a width of said endless belt, and said oil application mechanism is located closer to a position at which said endless belt commences separation from said second roller than to a position at which said endless belt commences contact with said first roller.

2. A fixing device comprising:

a first roller having restricting portions;

a second roller;

an endless belt suspended between said first and second rollers;

a third roller forming a nip in cooperation with said endless belt and said second roller; and a tension application mechanism, which applies tension to said endless belt, wherein a width of said tension application mechanism is shorter than a width of said endless belt, and wherein said tension application mechanism is located closer to a position at which said endless belt commences separation from said second roller than to a position at which said endless belt commences contact with said first roller.

3. The fixing device according to claim 2, wherein said first roller is a heat roller.

4. The fixing device according to claim 2, wherein said second roller is a backup roller.

5. The fixing device according to claim 2, wherein said third roller is a pressure roller.

6. The fixing device according to claim 2, wherein said tension application mechanism applies oil to said endless belt.

7. The fixing device according to claim 2, wherein said tension application mechanism includes at least one of a roller and a pad.

8. The fixing device according to claim 2, wherein said third roller is an elastic roller having hardness of JIS-A30° or smaller.

9. The fixing device according to claim 2, wherein said tension application mechanism is a rigid roller having lateral end portions each curved at a radius of 0.1 mm or larger.

10. The fixing device according to claim 2 wherein a rotational axis of the first roller is located in a downstream side of a traveling direction of a sheet with respect to an imaginary line connecting a rotational axis of the second roller to a rotational axis of the third roller.

11. A fixing device comprising:

a first roller;

a second roller;

an endless belt suspended between the first and second rollers;

a third roller forming a nip in cooperation with the endless belt and the second roller; and an oil application mechanism which applies oil onto at least one of the endless belt and the third roller, wherein a hardness of the oil application mechanism is JIS-A30° or less.

12. The fixing device as claimed in claim 11, wherein a rotational axis of the first roller is located in a downstream side of a traveling direction of a sheet with respect to an imaginary line connecting a rotational axis of the second roller to a rotational axis of the third roller.

13. The fixing device as claimed in claim 11, wherein a common circumscribing line of the first and second rollers in a side where the oil application mechanism is provided is inclined toward an upstream side of a traveling direction of a recording medium with respect to an imaginary vertical line.

14. The fixing device as claimed in claim 11, further comprising:

a heating mechanism, which applies heat to the third roller, wherein the oil application mechanism is located above the heating mechanism, and wherein the oil application mechanism is located in a downstream side of a traveling direction of a sheet with respect to the nip.

15. A fixing device comprising:

a first roller;

a second roller;

an endless belt suspended between the first and second rollers;

a third roller forming a nip in cooperation with the endless belt and the second roller; and an oil application mechanism which applies oil onto at least one of the endless belt and the third roller, wherein each lateral end of the oil application mechanism is curved at a radius of 0.1 mm or more.

16. The fixing device as claimed in claim 15, wherein a rotational axis of the first roller is located in a downstream side of a traveling direction of a sheet with respect to an imaginary line connecting a rotational axis of the second roller to a rotational axis of the third roller.

17. The fixing device as claimed in claim 15, wherein a common circumscribing line of the first and second rollers in a side where the oil application mechanism is provided is inclined toward an upstream side of a traveling direction of a recording medium with respect to an imaginary vertical line.

18. The fixing device as claimed in claim 15, further comprising:

a heating mechanism, which applies heat to the third roller, wherein the oil application mechanism is located above the heating mechanism, and wherein the oil application mechanism is located in a downstream side of a traveling direction of a sheet with respect to the nip.

19. A fixing device comprising:

a first roller;

a second roller;

an endless belt suspended between the first and second rollers;

a third roller forming a nip in cooperation with the endless belt and the second roller; and an oil application mechanism which applies oil onto at least one of the endless belt and the third roller, wherein the oil application mechanism is located closer to a position at which the endless belt commences separation from the second roller than to a position at which the endless belt commences contact with the first roller, and wherein a rotational axis of the first roller is located in a downstream side of a traveling direction of a sheet with respect to an imaginary line connecting a rotational axis of the second roller to a rotational axis of the third roller.

20. A fixing device comprising:

a first roller;

a second roller;

an endless belt suspended between the first and second rollers;

a third roller forming a nip in cooperation with the endless belt and the second roller; and an oil application mechanism which applies oil onto at least one of the endless belt and the third roller, wherein the oil application mechanism is located closer to a position at which the endless belt commences separation from the second roller than to a position at which the endless belt commences contact with the first roller, and wherein a common circumscribing line of the first and second rollers in a side where the oil application mechanism is provided is inclined toward an upstream side of a traveling direction of a recording medium with respect to an imaginary vertical line.

21. A fixing device comprising:

a first roller;

a second roller;

an endless belt suspended between the first and second rollers;

a third roller forming a nip in cooperation with the endless belt and the second roller; and an oil application mechanism which applies oil onto at least one of the endless belt and the third roller, wherein the oil application mechanism is located closer to a position at which the endless belt commences separation from the second roller than to a position at which the endless belt commences contact with the first roller, and further comprising:

a heating mechanism, which applies heat to the third roller, wherein the oil application mechanism is located above the heating mechanism, and wherein the oil application mechanism is located in a downstream side of a traveling direction of a sheet with respect to the nip.

22. A fixing device comprising:

a first roller;

a second roller;

an endless belt suspended between the first and second rollers;

a third roller forming a nip in cooperation with the endless belt and the second roller; and a tension application mechanism which applies tension onto the endless belt, wherein a hardness of the tension application mechanism is JIS-A30° or less.

23. The fixing device as claimed in claim 22, wherein a rotational axis of the first roller is located in a downstream side of a traveling direction of a sheet with respect to an imaginary line connecting a rotational axis of the second roller to a rotational axis of the third roller.

24. The fixing device as claimed in claim 22, further comprising:

a heating mechanism, which applies heat to the third roller; and an oil application mechanism located above the heating mechanism, wherein the oil application mechanism is located in a downstream side of a traveling direction of a sheet with respect to the nip.

25. The fixing device as claimed in claim 22, wherein the tension application mechanism includes at least one of a roller and a pad.

26. A fixing device comprising:

a first roller;

a second roller;

an endless belt suspended between the first and second rollers;

a third roller forming a nip in cooperation with the endless belt and the second roller; and a tension application mechanism which applies tension onto the endless belt, wherein a width of the tension application mechanism is, smaller than a width of the endless belt.

27. The fixing device as claimed in claim 26, wherein a rotational axis of the first roller is located in a downstream side of a traveling direction of a sheet with respect to an imaginary line connecting a rotational axis of the second roller to a rotational axis of the third roller.

28. The fixing device as claimed in claim 26, further comprising:

a heating mechanism, which applies heat to the third roller, wherein said tension application mechanism comprises an oil application mechanism and is located above the heating mechanism and in a downstream side of a traveling direction of a sheet with respect to the nip.

29. The fixing device as claimed in claim 26, wherein the tension application mechanism includes at least one of a roller and a pad.

30. A fixing device comprising:

a first roller;

a second roller;

an endless belt suspended between the first and second rollers;

a third roller forming a nip in cooperation with the endless belt and the second roller; and a tension application mechanism which applies tension onto the endless belt, wherein each lateral end of the tension application mechanism is curved at a radius of 0.1 mm or more.

31. The fixing device as claimed in claim 30, wherein a rotational axis of the first roller is located in a downstream side of a traveling direction of a sheet with respect to an imaginary line connecting a rotational axis of the second roller to a rotational axis of the third roller.

32. The fixing device as claimed in claim 30, further comprising:

a heating mechanism, which applies heat to the third roller; and an oil application mechanism located above the heating mechanism, wherein the oil application mechanism is located in a downstream side of a traveling direction of a sheet with respect to the nip.

33. The fixing device as claimed in claim 30, wherein the tension application mechanism includes at least one of a roller and a pad.

34. A fixing device comprising:

a first roller;

a second roller;

an endless belt suspended between the first and second rollers;

a third roller forming a nip in cooperation with the endless belt and the second roller; and a tension application mechanism which applies tension onto the endless belt, wherein the tension application mechanism is located closer to a position at which the endless belt commences separation from the second roller than to a position at which the endless belt commences contact with the first roller, and wherein a rotational axis of the first roller is located in a downstream side of a traveling direction of a sheet with respect to an imaginary line connecting a rotational axis of the second roller to a rotational axis of the third roller.

35. A fixing device comprising:

a first roller;

a second roller;

an endless belt suspended between the first and second rollers, a third roller forming a nip in cooperation with the endless belt and the second roller; and a tension application mechanism which applies tension onto the endless belt, wherein the tension application mechanism is located closer to a position at which the endless belt commences separation from the second roller than to a position at which the endless belt commences contact with the first roller, and further comprising:

a heating mechanism, which applies heat to the third roller; and an oil application mechanism located above the heating mechanism, wherein the oil application mechanism is located in a downstream side of a traveling,direction of a sheet with respect to the nip.

* * * * *